US012655692B2

(12) United States Patent
Van der Veen et al.

(10) Patent No.: US 12,655,692 B2
(45) Date of Patent: Jun. 16, 2026

(54) DOWNHOLE TOOL EMPLOYING A WHIPSTOCK ASSEMBLY, PACKER ASSEMBLY AND A REMOTE OPEN/CLOSE VALVE

(71) Applicant: Halliburton Energy Services, Inc., Houston, TX (US)

(72) Inventors: Steffen Helgesen Van der Veen, Stavanger (NO); Luke Holderman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/040,238

(22) Filed: Jan. 29, 2025

(65) Prior Publication Data

US 2025/0243714 A1 Jul. 31, 2025

Related U.S. Application Data

(60) Provisional application No. 63/655,853, filed on Jun. 4, 2024, provisional application No. 63/627,565, filed on Jan. 31, 2024.

(51) Int. Cl.
*E21B 7/06* (2006.01)
*E21B 33/12* (2006.01)
(Continued)

(52) U.S. Cl.
CPC ..... *E21B 7/061* (2013.01); *E21B 33/12* (2013.01); *E21B 33/128* (2013.01); *E21B 34/06* (2013.01); *E21B 41/0035* (2013.01)

(58) Field of Classification Search
CPC ..... E21B 33/12; E21B 33/128; E21B 34/06; E21B 41/0035
See application file for complete search history.

(56) References Cited

U.S. PATENT DOCUMENTS 4,153,109 A 5/1979 Szescila
5,154,231 A * 10/1992 Bailey ..... E21B 7/061 166/298
(Continued)

FOREIGN PATENT DOCUMENTS

EP 0701045 B1 10/2003
JP 09165985 A 6/1997
(Continued)

OTHER PUBLICATIONS

PCT-ISR (Year: 2025).*
(Continued)

*Primary Examiner* — Steven A Macdonald
(74) *Attorney, Agent, or Firm* — Scott Richardson; Parker Justiss, P.C.

(57) ABSTRACT

Provided, in one aspect, is a downhole tool, a well system, and a method. The downhole tool, in one aspect, includes a whipstock assembly, the whipstock assembly including a whipface. The downhole tool, in one aspect, further includes a packer assembly coupled to the whipstock assembly, the packer assembly including a packer element configured to move between a radially retracted state and a radially expanded state. The downhole tool, in one aspect, may further include a remote open/close valve positioned to allow fluid into the whipstock assembly.

17 Claims, 50 Drawing Sheets

(51) Int. Cl.

| | |
|---|---|
| ***E21B 33/128*** | (2006.01) |
| ***E21B 34/06*** | (2006.01) |
| ***E21B 41/00*** | (2006.01) |

(56) References Cited

U.S. PATENT DOCUMENTS

| | | | | |
|---|---|---|---|---|
| 5,193,620 | A * | 3/1993 | Braddick | E21B 33/1292 175/81 |
| 5,775,428 | A * | 7/1998 | Davis | E21B 34/142 166/117.6 |
| 6,050,334 | A * | 4/2000 | McGarian | E21B 23/01 166/117.6 |
| 6,684,953 | B2 | 2/2004 | Sonnier | |
| 8,443,884 | B2 | 5/2013 | Crawford | |
| 8,820,437 | B2 * | 9/2014 | Ervin | E21B 7/061 166/117.6 |
| 8,915,296 | B2 | 12/2014 | McGarian | |
| 9,206,648 | B2 * | 12/2015 | Dewey | E21B 33/14 |
| 10,006,264 | B2 | 6/2018 | Glaser et al. | |
| 10,280,706 | B1 | 5/2019 | Sharp, III | |
| 11,591,871 | B1 | 2/2023 | Randall et al. | |
| 11,788,378 | B2 * | 10/2023 | Towers | E21B 34/066 166/66.6 |
| 12,018,565 | B2 * | 6/2024 | Al-Mousa | E21B 7/061 |
| 2002/0060096 | A1 * | 5/2002 | Brunnert | E21B 7/061 175/81 |
| 2004/0069496 | A1 | 4/2004 | Hosie et al. | |
| 2004/0159435 | A1 | 8/2004 | Plucheck et al. | |
| 2010/0294512 | A1 * | 11/2010 | Assal | E21B 7/061 166/384 |
| 2011/0253387 | A1 * | 10/2011 | Ervin | E21B 7/061 166/117.6 |
| 2013/0213654 | A1 * | 8/2013 | Dewey | E21B 33/13 166/117.6 |
| 2014/0338908 | A1 * | 11/2014 | Ervin | E21B 17/042 166/113 |
| 2014/0360723 | A1 * | 12/2014 | Utter | E21B 29/06 175/402 |
| 2015/0122493 | A1 | 5/2015 | Wood et al. | |
| 2015/0345241 | A1 * | 12/2015 | Glaser | E21B 29/06 166/117.6 |
| 2017/0081938 | A1 | 3/2017 | Richards et al. | |
| 2017/0284168 | A1 | 10/2017 | Zevenbergen et al. | |
| 2020/0291748 | A1 * | 9/2020 | Ali | E21B 23/0411 |
| 2021/0131246 | A1 | 5/2021 | Jamison | |
| 2021/0332658 | A1 | 10/2021 | Hepburn et al. | |
| 2022/0065071 | A1 * | 3/2022 | Towers | E21B 34/066 |
| 2023/0066633 | A1 | 3/2023 | Trisal et al. | |
| 2023/0069763 | A1 | 3/2023 | Maher et al. | |
| 2025/0243712 | A1 | 7/2025 | Van der Veen et al. | |
| 2025/0243713 | A1 | 7/2025 | Van der Veen et al. | |

FOREIGN PATENT DOCUMENTS

| | | | |
|---|---|---|---|
| WO | 2017189568 | A1 | 11/2017 |
| WO | 2020153961 | A1 | 7/2020 |
| WO | 2023081026 | A1 | 5/2023 |

OTHER PUBLICATIONS

PCT-WO (Year: 2025).*

Bruton, G., et al., "Whipstock Options for Sidetracking," Oilfield review, No. 1, Spring 2014, 10 pages.

* cited by examiner

DOWNHOLE TOOL EMPLOYING A WHIPSTOCK ASSEMBLY, PACKER ASSEMBLY AND A REMOTE OPEN/CLOSE VALVE

CROSS-REFERENCE TO RELATED APPLICATION

This application claims the benefit of U.S. Provisional Application Ser. No. 63/627,565, filed on Jan. 31, 2024, entitled "DOWNHOLE TOOL EMPLOYING A WHIPSTOCK ASSEMBLY, PACKER ASSEMBLY AND DOWNHOLE POWER UNIT," and U.S. Provisional Application Ser. No. 63/655,853, filed on Jun. 4, 2024, entitled "DOWNHOLE TOOL EMPLOYING A WHIPSTOCK ASSEMBLY, PACKER ASSEMBLY AND DOWNHOLE POWER UNIT," both of which are commonly assigned with this application and incorporated herein by reference in their entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing.

BRIEF DESCRIPTION

Reference is now made to the following descriptions taken in conjunction with the accompanying drawings, in which.

DETAILED DESCRIPTION

Figure 1:
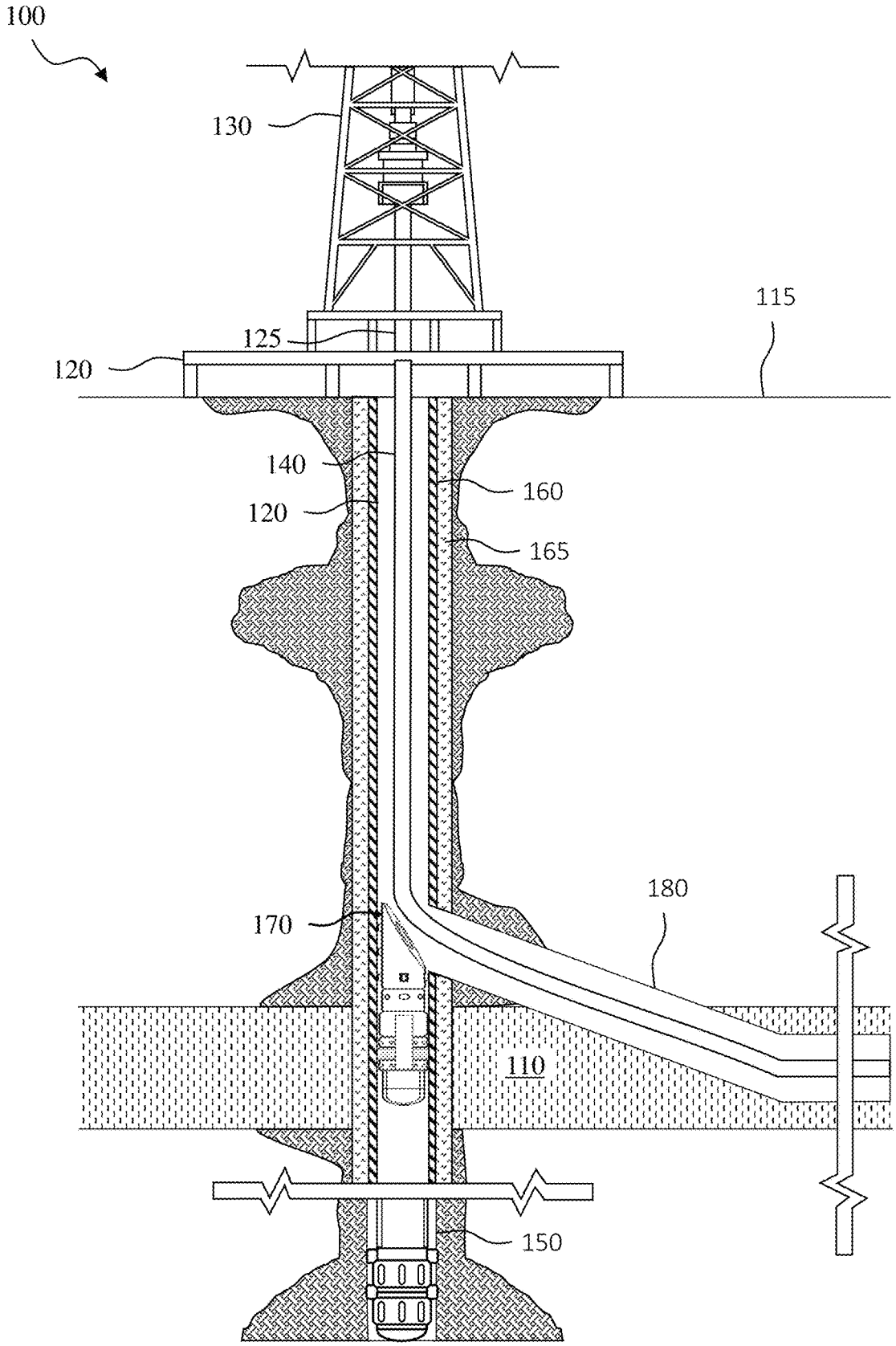
FIG. 1 illustrates a schematic partial cross-sectional view of an example well system designed, manufactured and formed according to one embodiment of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation" shall be construed as encompassing both areas below exposed earth and areas below earth covered by water such as ocean or fresh water.

Various values and/or ranges are explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The term "substantially XYZ," as used herein, means that it is within 10 percent of perfectly XYZ. The term "significantly XYZ," as used herein, means that it is within 5 percent of perfectly XYZ. The term "ideally XYZ," as used herein, means that it is within 1 percent of perfectly XYZ.

The monicker "XYZ" could refer to parallel, perpendicular, alignment, or other relative features disclosed herein.

The present disclosure is based, at least in part, on the acknowledgment that whipstock assemblies for conventional multilateral sidetracks are installed using either a mechanical anchor(s) (e.g., which require a mechanical set plug run in advance) or hydraulically set packer(s)/anchor(s) which require hydraulic access down to the packer(s)/anchor(s) (e.g., typically via hydraulic tubular lines from milling BHA down through whipstock to the packer(s)/anchor(s)). The present disclosure has recognized, for the first time, that such systems are problematic in nature, and further require tedious handling on the rig floor with personnel in the red zone.

Based, at least in part, on the foregoing, the present disclosure has developed a downhole tool that includes a Downhole Power Unit (DPU) (e.g., sacrificial downhole power unit), for example above the packer assembly, the downhole power unit configured to set the packer element once the whipstock assembly has been run to depth and oriented to the desired orientation. This would allow for circulation during running-in-hole, and orienting the whipstock assembly without the risk of prematurely setting the packer assembly. Further, no hydraulic connection would have to be made on the rig floor, as the downhole power unit could be attached to the packer assembly in advance. Once the whipstock assembly is run to depth and oriented to a desired orientation, the downhole power unit may be activated, for example either using a pressure activated switch (by pressuring up the annular well pressure) or via wired drill string and acoustic signals down to the downhole power unit, and the packer assembly will be set. Thus, in one embodiment, the present disclosure provides remote activation of the packer assembly without hydraulics or mechanical manipulation of the packer assembly. A similar operation could be done on Wireline.

In one or more scenarios, a wired drill string communication sub could be run above the milling assembly, sending acoustic signals to the downhole power unit, which could have an acoustic trigger to activate the downhole power unit. This would eliminate the need to pressure up the well, but would require being coupled to wired drill string for surface communication. This method could also be utilized on standalone plug(s)/anchor(s) that are typically installed on drill string in long reach and deviated wells, which would make it difficult to use a mechanical setting tool. This method could also be used in cases where the need for circulation may eliminate the possibility of using a hydraulic setting tool.

The disclosure, in one aspect, thus describes a new method for deploying, setting, and retrieving one or more features of a downhole tool including a whipstock assembly, as might be used to form a lateral wellbore from a main wellbore. In at least one embodiment, the downhole tool includes the whipstock assembly, the whipstock assembly including a whipface. In accordance with one embodiment of the disclosure, the downhole tool may further include a packer assembly coupled to the whipstock assembly, the packer assembly including a packer element configured to move between a radially retracted state and a radially expanded state. In accordance with yet another embodiment of the disclosure, the downhole tool may further include a downhole power unit coupled to the packer assembly, the downhole power unit configured to move the packer element between the radially retracted state and the radially expanded state.

FIG. 1 is a schematic view of a well system 100 designed, manufactured and operated according to one or more embodiments disclosed herein. The well system 100 includes an oil and gas platform 120 positioned over a subterranean formation 110 located below the earth's surface 115. The oil and gas platform 120, in at least one embodiment, has a hoisting apparatus 125 and a derrick 130 for raising and lowering one or more tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 (e.g., wellbore casing) may be positioned (e.g., at least partially cemented 165) within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a downhole tool 170 according to one or more embodiments of the present disclosure is positioned at a location in the main wellbore 150. Specifically, the downhole tool 170 could be placed at a location in the main wellbore 150 where it is desirable for a lateral wellbore 180 to exit. Accordingly, the downhole tool 170 may be used to support a milling tool used to penetrate a window in the main wellbore 150 (e.g., penetrate a window in the casing string 160).

The downhole tool 170, in at least one embodiment, may include a whipstock assembly, for example including a whipface. The downhole tool 170, in this embodiment, may further include a packer assembly coupled to the whipstock assembly, the packer assembly including a packer element configured to move between a radially retracted state and a radially expanded state. The downhole tool 170, in this embodiment, may additionally include a downhole power unit coupled to the packer assembly, the downhole power unit configured to move the packer element between the radially retracted state and the radially expanded state. In at least one embodiment, the downhole tool 170 additionally includes a ported sub coupled to the downhole power unit, the ported sub configured to hydraulically connect activation fluid to the downhole power unit (e.g., hydraulically connect fluid from an annulus of the wellbore to the downhole power unit), and thus move the packer element between the radially retracted state and the radially expanded state.

The elements of the downhole tool 170 may be positioned within the main wellbore 150 in one or more separate steps. For example, in at least one embodiment, elements of the downhole tool 170 are positioned within the main wellbore 150 in a single step, for example using the drill string 140. In this embodiment, after being set, the downhole tool 170 may be pressure tested. Thereafter, the drill string 140 may be disconnected from the downhole tool 170, and thus used to form the lateral wellbore 180. What may result is the well system 100 and downhole tool 170 illustrated in FIG. 1. In one or more embodiments, the downhole tool 170 according to the disclosure may remain within the main wellbore 150 after forming the lateral wellbore 180, such as shown in FIG. 1. However, in other embodiments the downhole tool 170 may be retrieved from the main wellbore 150 and returned uphole by a retrieval tool after forming the lateral wellbore 180.

Figure 2:
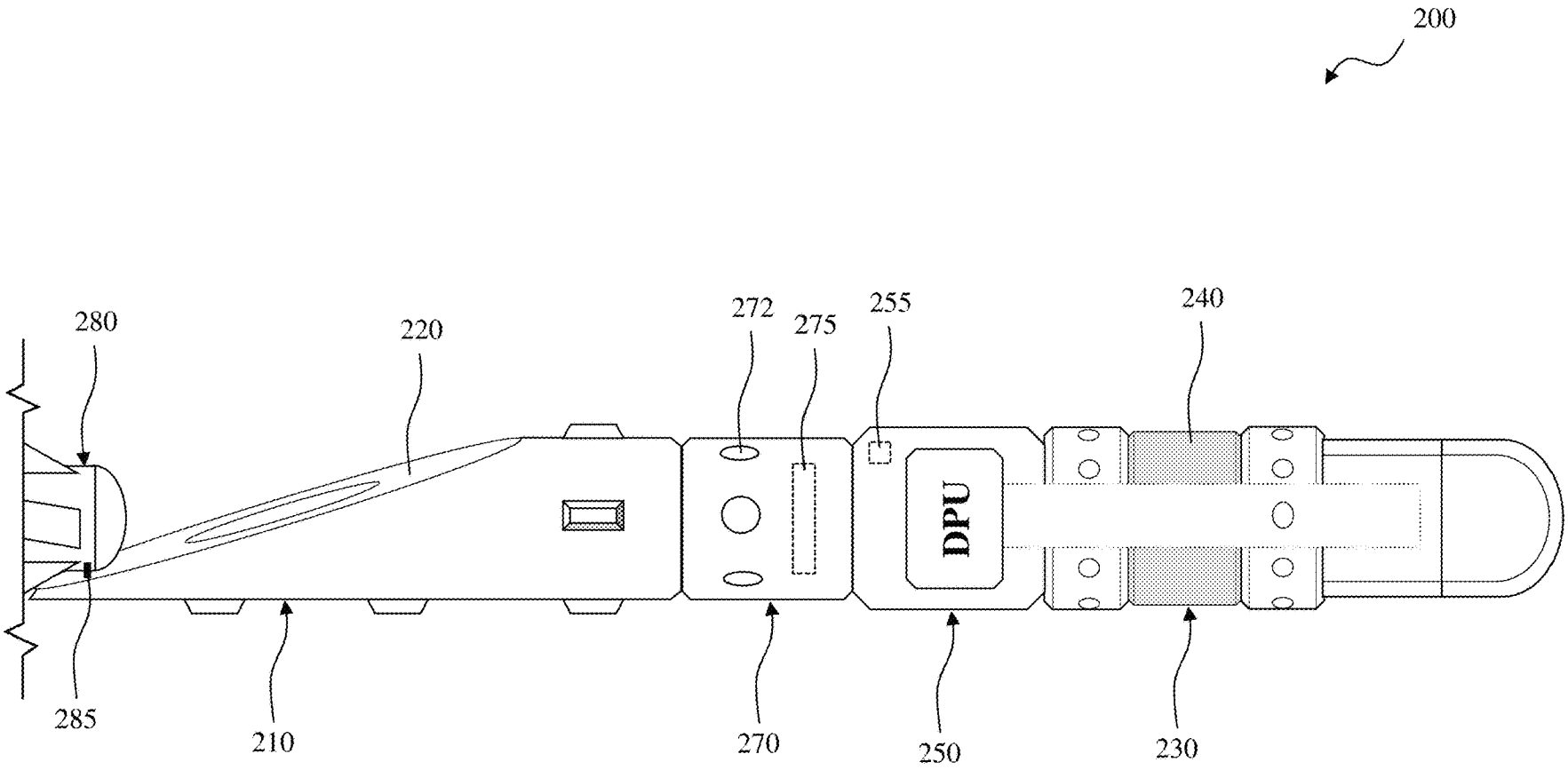
FIG. 2 illustrates a downhole tool designed, manufactured and/or formed according to one embodiment of the disclosure.

Turning to FIG. 2, illustrated is a schematic view of a downhole tool 200 designed, manufactured and/or operated according to one or more embodiments of the disclosure. The downhole tool 200, in the illustrated embodiment, includes a whipstock assembly 210. In the illustrated embodiment of FIG. 2, the whipstock assembly 210 includes a whipface 220. The whipface 220, in one or more embodiments, provides a surface for a drilling/milling assembly (e.g., milling assembly 280) to ride upon to form an opening (e.g., exit) in wellbore casing.

The downhole tool 200, in the illustrated embodiment, further includes a packer assembly 230 coupled to the whipstock assembly 210. In the illustrated embodiment of FIG. 2, the packer assembly 230 includes a packer element 240 configured to move between a radially retracted state (e.g., as shown) and a radially expanded state (e.g., not shown). Any known or hereafter discovered packer element that may move from the radially retracted state to the radially expanded state to seal a tubular may be used and remain within the scope of the disclosure. In at least one embodiment, the packer element is a polymer packer.

The downhole tool 200, in the illustrated embodiment, further includes a downhole power unit 250 coupled to the packer assembly 230. In one or more embodiments, the downhole power unit 250 is configured to move the packer element 240 between the radially retracted state (e.g., as shown) and the radially expanded state (e.g., not shown). In at least one embodiment, the downhole power unit 250 includes a self-contained power source, such as a battery or other self-contained power source. In the illustrated embodiment, the downhole power unit 250 is positioned uphole of the packer assembly 230, for example being positioned between the whipstock assembly 210 and the packer assembly 230. In yet in other embodiments the downhole power unit 250 is located elsewhere.

The downhole tool 200, in the illustrated embodiment, further includes a ported sub 270 coupled to the downhole power unit 250. In at least one embodiment, the ported sub 270 is configured to hydraulically connect activation fluid to the downhole power unit 250. For example, in at least one embodiment, the ported sub 270 is configured to hydraulically connect activation fluid from an annulus of a wellbore to the downhole power unit 250 using one or more ports 272.

In at least one embodiment, the downhole power unit 250 has a pre-determined activation pressure. In this embodiment, the downhole power unit 250 is configured to initiate a setting sequence of the packer assembly 230 after receiving activation fluid having at least the pre-determined activation pressure, for example from the ported sub 270. In at least one embodiment, the downhole power unit 250 has a pressure sensor 255, the pressure sensor 255 configured to sense for at least the pre-determined activation pressure before initiating the setting sequence. In at least one other embodiment, the ported sub 270 or the downhole power unit 250 has a burst disc 275, the burst disc 275 configured to burst upon receiving at least the pre-determined activation pressure before initiating the setting sequence.

Depending on the design of the downhole tool 200, the downhole power unit 250 may be configured to immediately initiate the setting sequence of the packer assembly 230 after receiving the activation fluid having at least the pre-determined activation pressure (e.g., from the ported sub 270). Alternatively, again depending on the design of the downhole tool 200, the downhole power unit 250 may be configured to start a pre-determined countdown to initiate the setting sequence of the packer assembly 230 after receiving the activation fluid having at least the pre-determined activation pressure (e.g., from the ported sub 270). Thus, the pre-determined countdown might be a matter of minutes, hours, etc., and the setting sequence would only begin after the matter of minutes, hours, etc. has passed.

In at least one embodiment, a milling assembly 280 is removably coupled to the whipstock assembly 210. For example, in one or more embodiments, the milling assembly 280 is removably coupled to the whipface 220 of the whipstock assembly 210 using a shear feature 285, such as a shear pin or shear bolt. In such an embodiment, a drill string (e.g., not shown) coupled to the milling assembly 280 (e.g., a drilling/milling assembly) may be used to run the whipstock assembly 210, and features attached thereto, downhole.

Figure 3A:
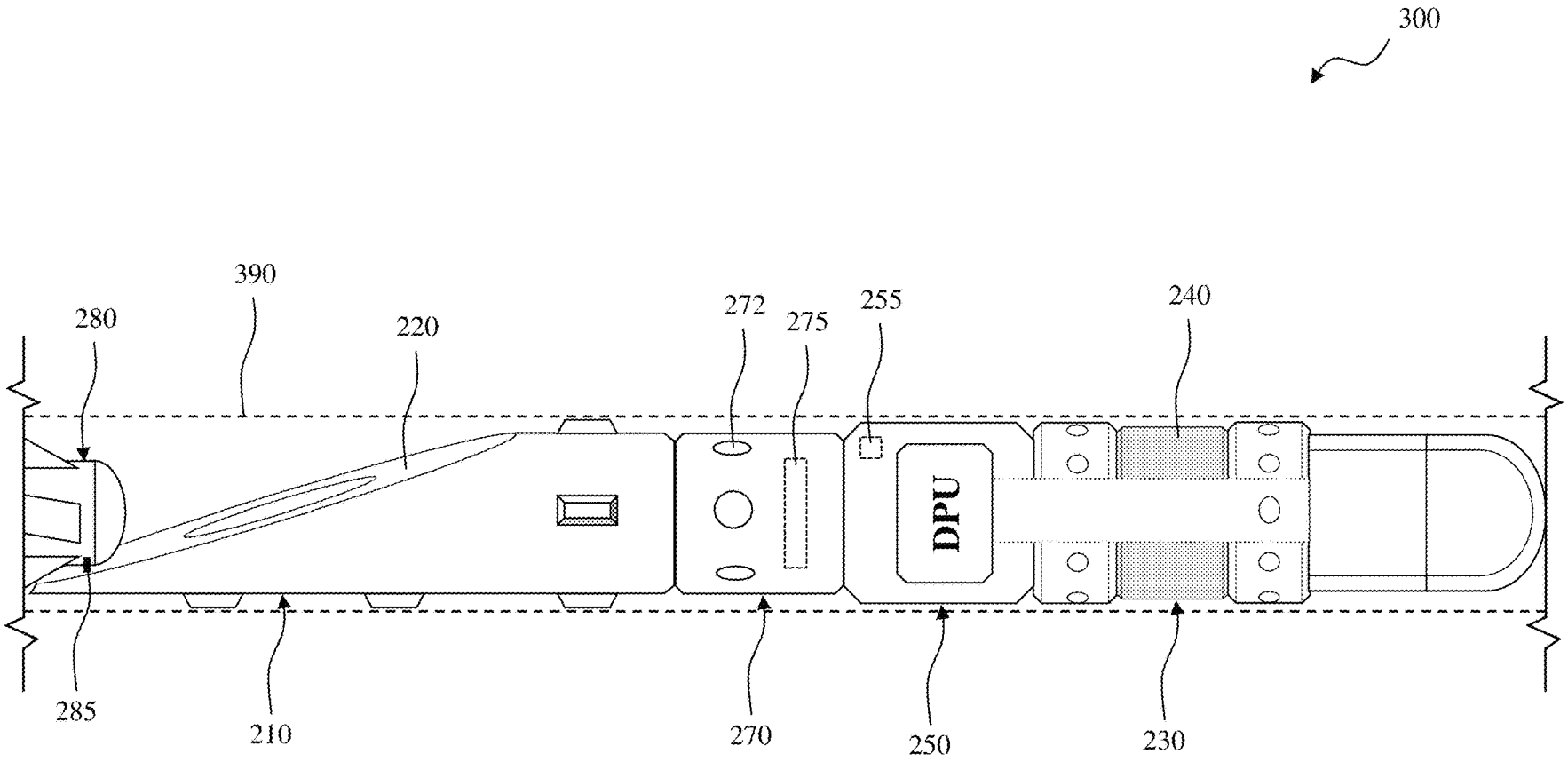
FIGS. 3A and 3B illustrate different views of a downhole tool according to one or more embodiments of the disclosure positioned within a wellbore (e.g., a main wellbore)
Figure 3B:
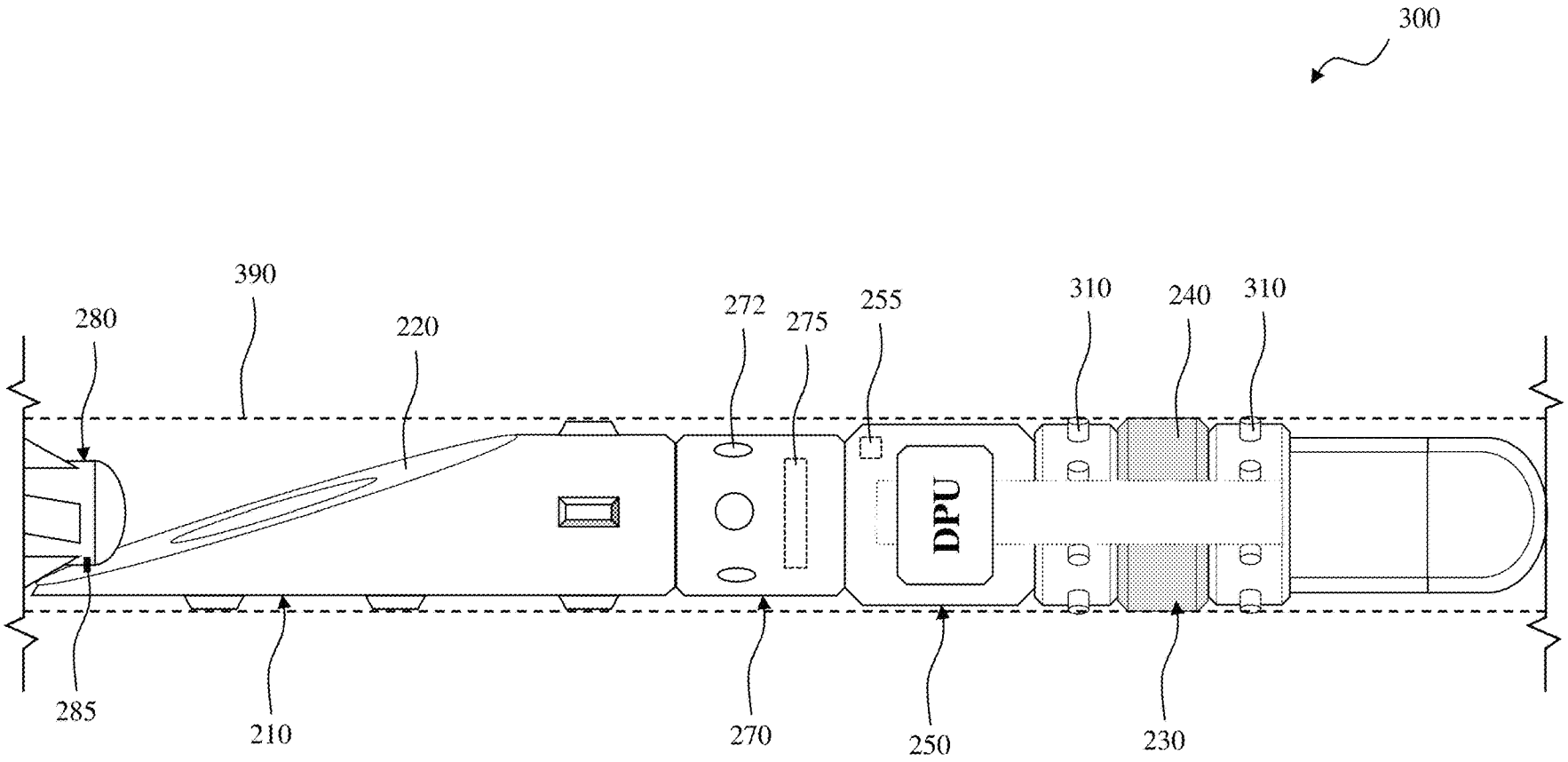

Turning to FIGS. 3A and 3B, illustrated are different views of a downhole tool 300 designed, manufactured and/or operated according to one or more embodiments of the disclosure positioned within a wellbore 390 (e.g., a main wellbore). The downhole tool 300 of FIGS. 3A and 3B is similar in many respects to the downhole tool 200 of FIG. 2. Accordingly, like reference numbers have been used to indicate similar, if not identical, features.

With reference to FIG. 3A, the downhole tool 300 is configured in a run-in-hole state, and thus its packer element 240 is in its radially retracted state. With reference to FIG. 3B, the downhole tool is configured in a set-in-place state, and thus its packer element 240 is now in its radially expanded state. Accordingly, in at least one embodiment, the set packer element 240 may seal portions of the wellbore 390 above the set packer element from portions of the wellbore 390 below the set packer element 240. Furthermore, in the embodiment of FIG. 3B, anchor elements 310 of the packer assembly 230 are axially and rotationally fixing the downhole tool 300 within the wellbore 390. In at least one embodiment, the setting of the packer element 240 may be used to set the anchor elements 310. For example, in at least one embodiment, a mechanical element or fluid pressure may be used to set the anchor elements 310.

Figure 4:
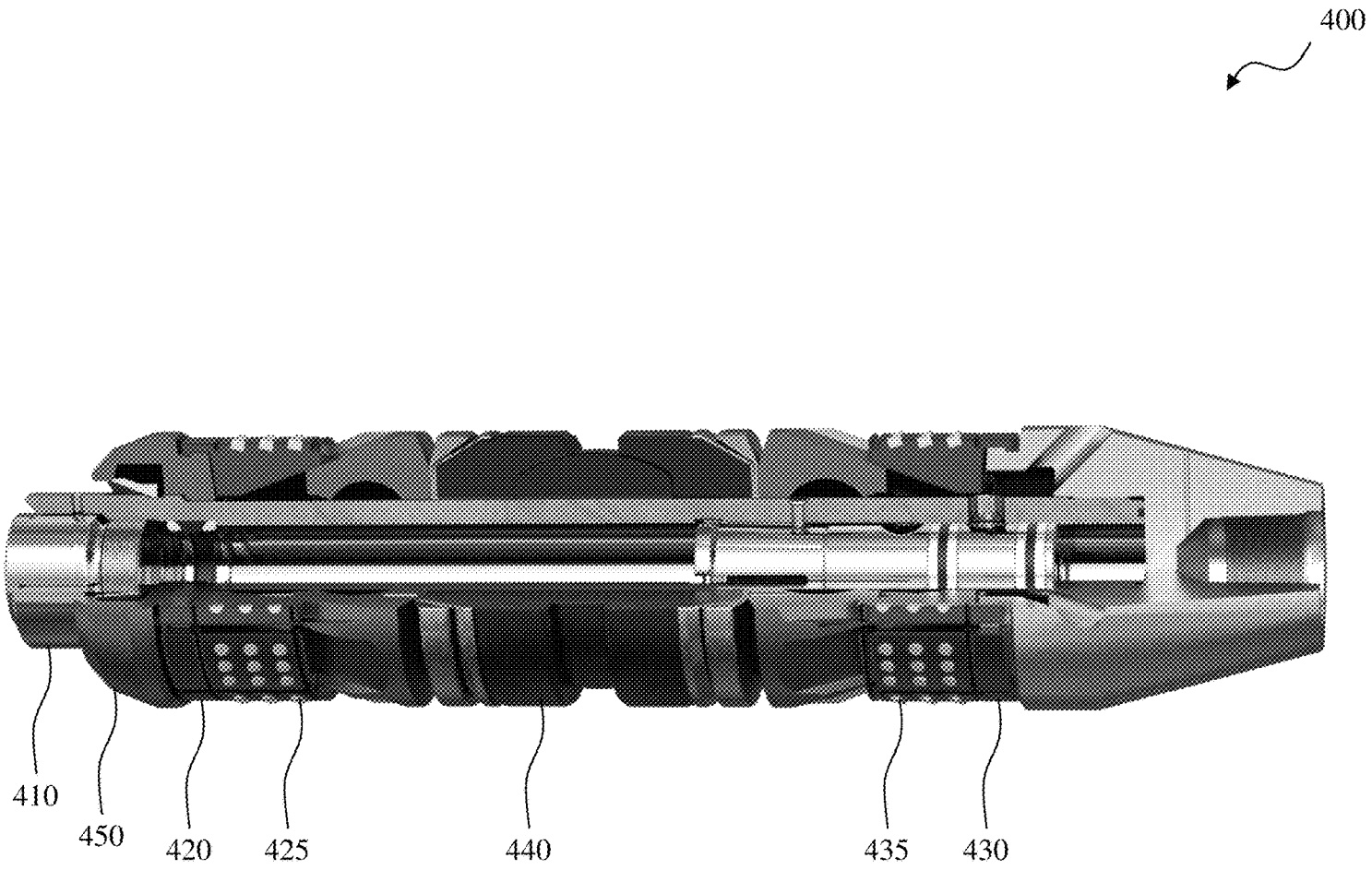
FIG. 4 illustrates a packer assembly as might be used as part of the downhole tool of FIG. 2, designed, manufactured and/or formed according to one embodiment of the disclosure.

Turning to FIG. 4, illustrated is a packer assembly 400, as might be used as part of the downhole tool of FIGS. 2, 3A and/or 3B, designed, manufactured and/or operated according to one embodiment of the disclosure. The packer assembly 400, in the illustrated embodiment, includes an inner mandrel 410. The inner mandrel 410, in one or more embodiments, is a metal inner mandrel. Nevertheless, other materials for the inner mandrel 410 may be used and remain within the scope of the disclosure.

The packer assembly 400, in the illustrated embodiment, further includes upper slips 420 and lower slips 430, each positioned about the inner mandrel 410. The upper slips 420 and lower slips 430, in one or more embodiments, may additionally include anchor elements 425, 435, respectively.

The packer assembly 400, in the illustrated embodiment, may further include a packer element 440 positioned about the inner mandrel 410, and for example located between the upper slips 420 and the lower slips 430. The packer element 440, as understood in the art, may be configured to move between a radially retracted state (e.g., set apart from the wellbore or tubular it is located within) and a radially expanded state (e.g., engaged with the wellbore or tubular it is located within). The packer assembly 400, in the illustrated embodiment, may further include a lock ring housing 450 positioned uphole of the upper slips 420.

In the illustrated embodiment, the inner mandrel 410 is configured to axially slide to move the upper slips 420 and lower slips 430 toward one another (e.g., slide the lower slips 430 toward the upper slip 420 in the embodiment of FIG. 4) to compress the packer element 440 from its radially retracted state to its radially expanded state. In this embodiment, the lock ring housing 450 holds an uphole side of the packer element 440 stationary, such that the packer element 440 may be compressed when moving the inner mandrel 410. While one specific type of packer assembly 400 has been illustrated and described with respect to FIG. 4, other embodiments of the disclosure may use a different type of packer assembly and remain within the scope of the disclosure.

Figure 5:
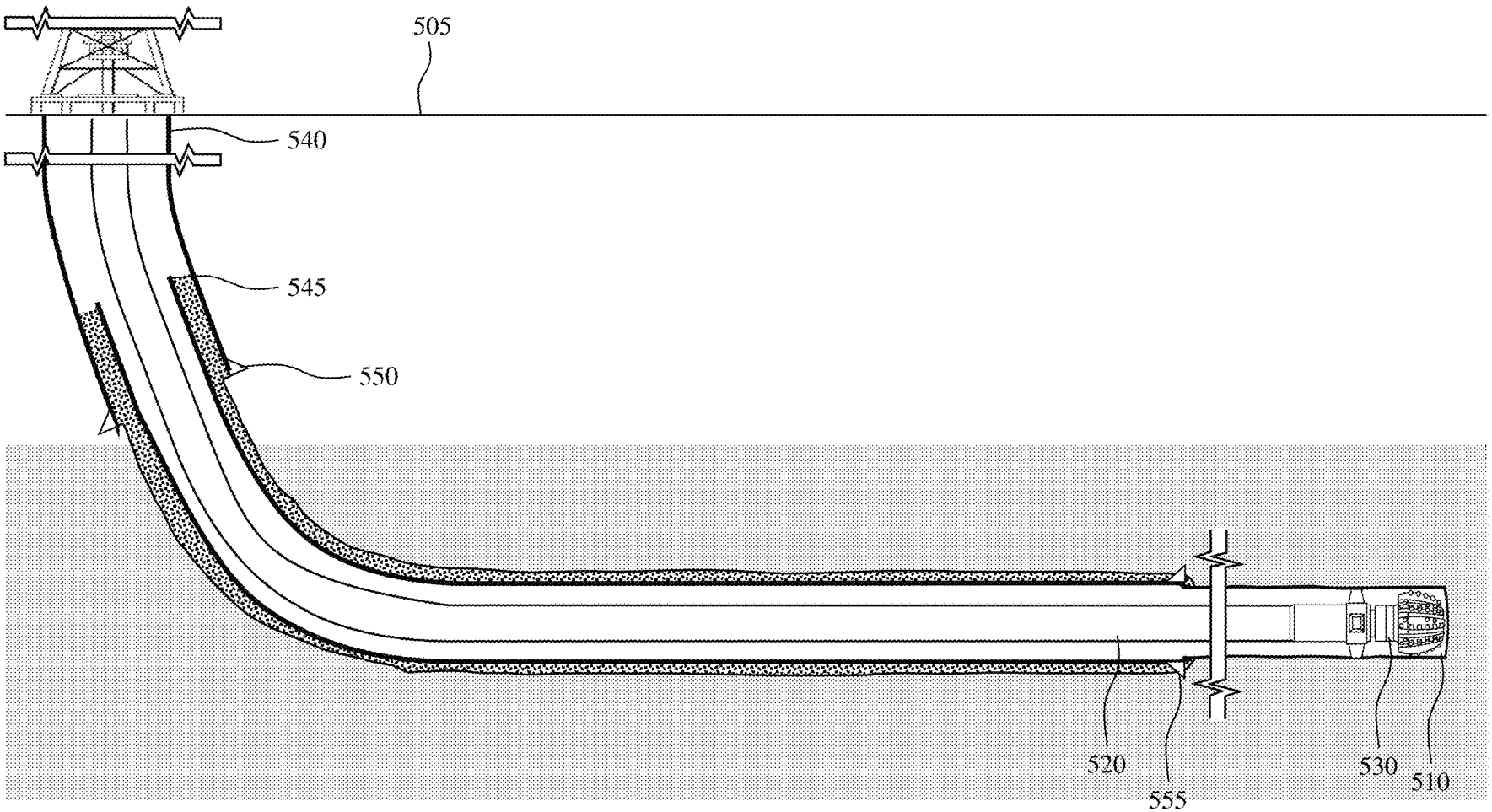
FIGS. 5 through 16 illustrate a method for forming, accessing, and/or producing from a well system according to one embodiment of the disclosure.

Turning now to FIGS. 5 through 16, illustrated is a method for forming, accessing, and/or producing from a well system 500 designed, manufactured and/or operated according to one or more embodiments of the disclosure. FIG. 5 illustrates a schematic of the well system 500 at the initial stages of formation. A main wellbore 510 may be drilled, for example by a rotary steerable system 530 at the end of a drill string 520, and may extend from a well origin, such as the earth's surface 505 or a sea bottom. The main wellbore 510 may be lined by one or more casings 540, 545, each of which may be terminated by a shoe 550, 555.

Figure 6:
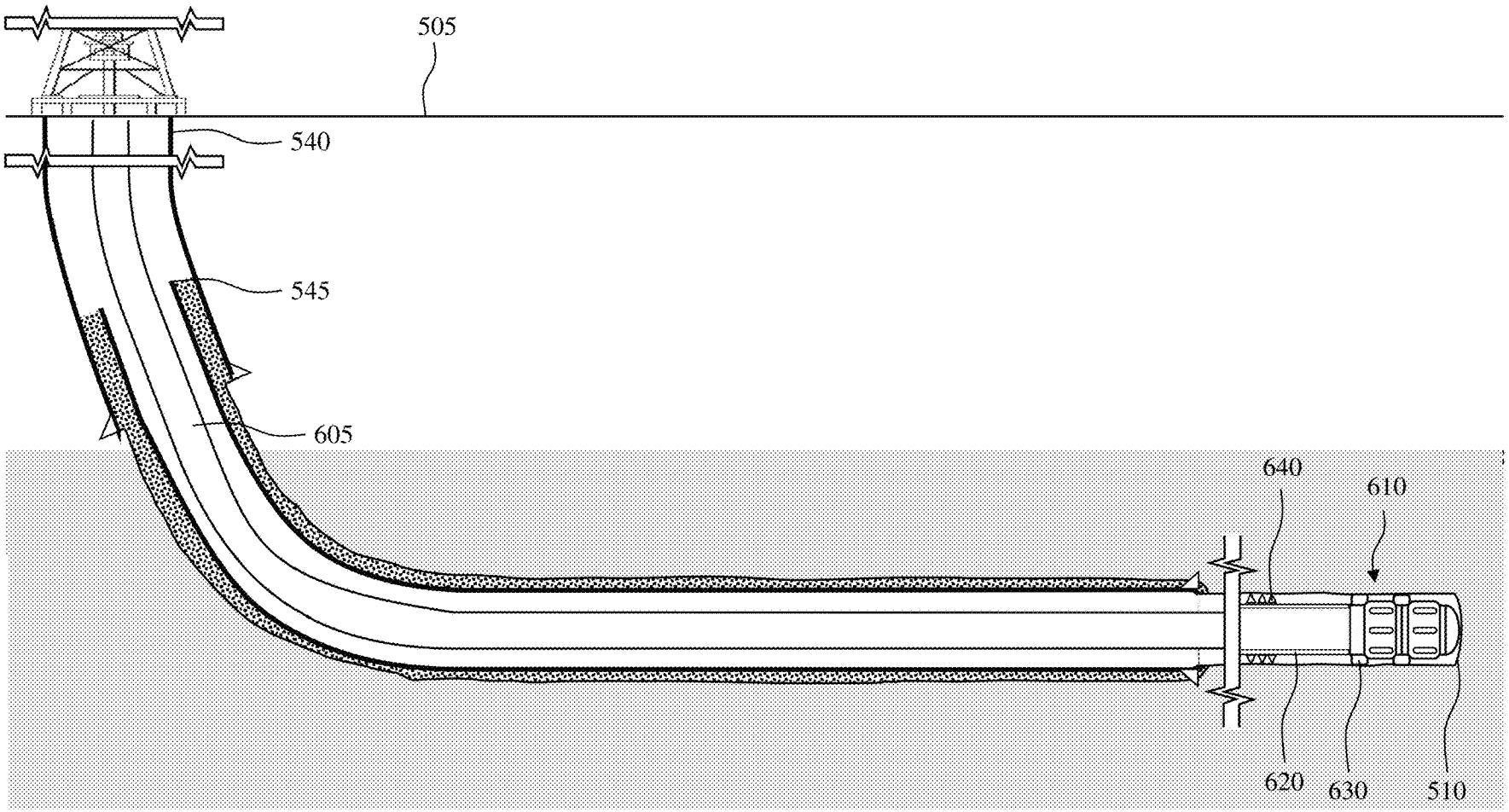

Turning to FIG. 6, illustrated is the well system 500 of FIG. 5 after positioning a main wellbore completion 610 within the main wellbore 510, for example using a conveyance 605. The main wellbore completion 610 may, in certain embodiments, include a main wellbore liner 620 (e.g., with frac sleeves in one embodiment), as well as one or more packers 630 (e.g., swell packers in one embodiment). The main wellbore liner 620 and the one or more packer 630 may, in certain embodiments, be fixed using an anchor assembly 640.

Figure 7:
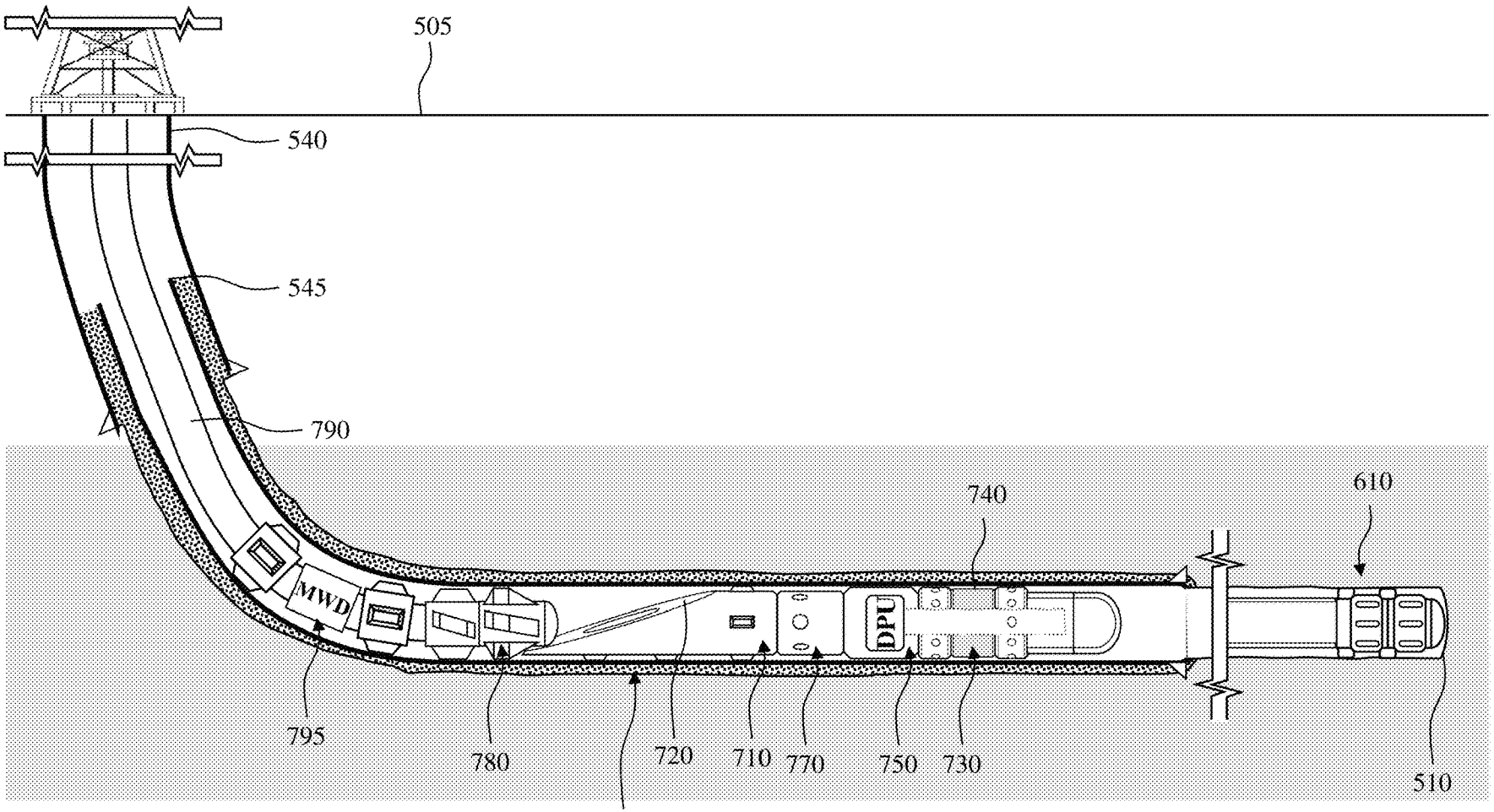
Figure 8:
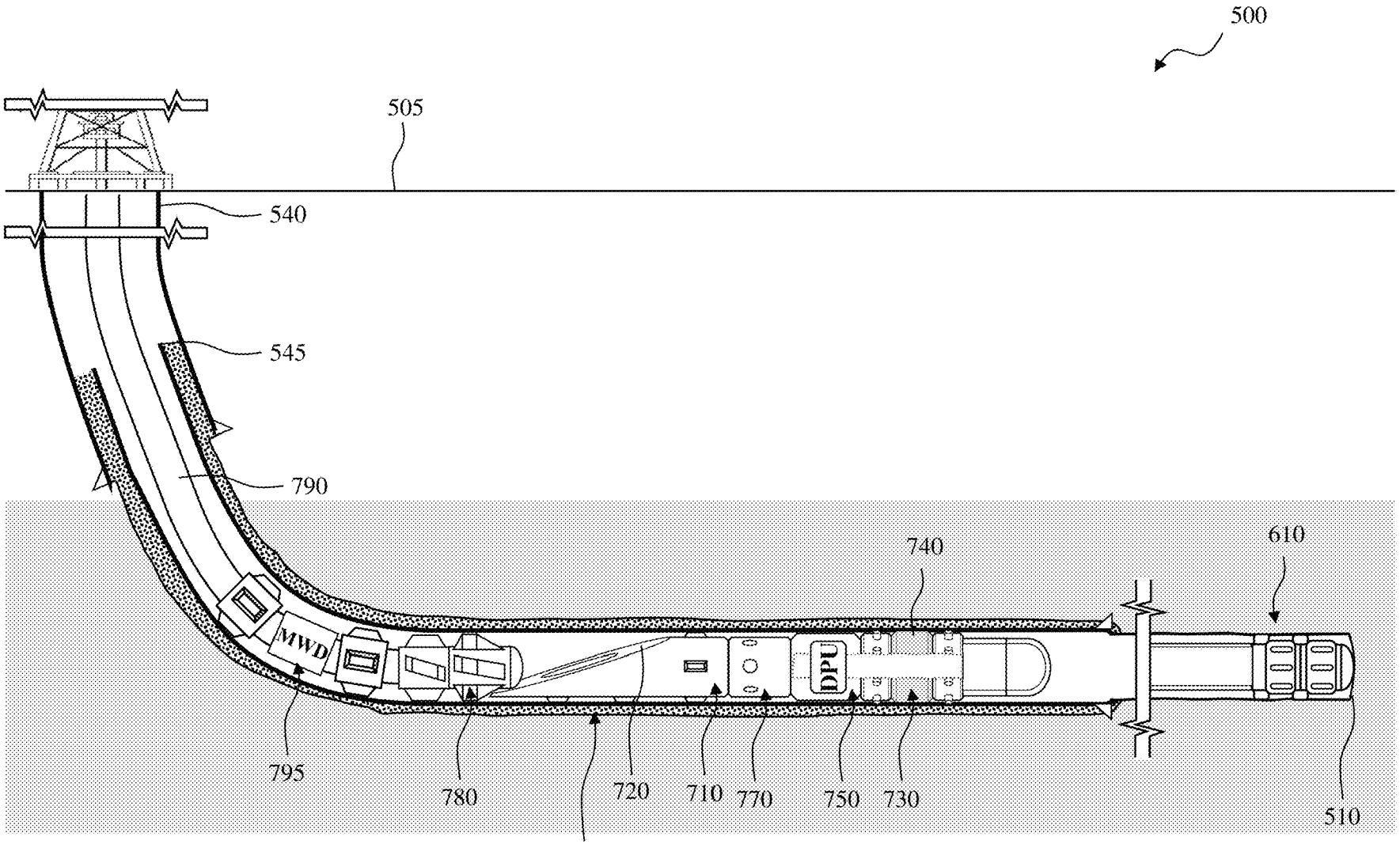

Turning to FIG. 7, illustrated is the well system 500 of FIG. 6 after positioning a downhole tool 705 (e.g., similar to the downhole tool 200, 300 of FIGS. 2 through 3B) designed, manufactured and/or operated according to one or more embodiments of the disclosure downhole at a location where a lateral wellbore is to be formed. The downhole tool 705, in at least one embodiment, includes a whipstock assembly 710, for example including a whipface 720. The downhole tool 705, in at least one embodiment, further includes a packer assembly 730 coupled to the whipstock assembly 710, the packer assembly 730 including a packer element 740 configured to move between a radially retracted state (e.g., as shown in FIG. 7) and a radially expanded state (e.g., as shown in FIG. 8). The downhole tool 705, in at least one embodiment, further includes a downhole power unit 750 coupled to the packer assembly 730, the downhole power unit 750 configured to move the packer element 740 between the radially retracted state (e.g., as shown in FIG. 7) and the radially expanded state (e.g., as shown in FIG. 8). The downhole tool 705, in one or more other embodiments, may include a ported sub 770 coupled to the downhole power unit 750, the ported sub 770 configured to hydraulically connect activation fluid to the downhole power unit 750.

In certain embodiments, such as that shown in FIG. 7, the downhole tool 705 further includes a milling assembly 780 coupled with the whipstock assembly 710. For example, in at least one embodiment, a lead mill bit of the milling assembly 780 is coupled to the whipface 720 of the whipstock assembly 710, for example using a shear feature. In this embodiment, the downhole tool 705 (e.g., an entirety of the downhole tool 705) may be run-in-hole with a drill string 790 coupled to the milling assembly 780. Furthermore, a workstring orientation tool/measuring while drilling tool (WOT/MWD) tool 795 may be employed to orient (e.g., both axially and rotationally orient) the downhole tool 705 as it is being run-in-hole.

Turning to FIG. 8, illustrated is the well system 500 of FIG. 7 after setting the downhole tool 705, and thus moving the packer element 740 from its radially retracted state (e.g., as shown in FIG. 7) to its radially expanded state (e.g., as shown in FIG. 8). In at least one embodiment, this may be achieved by hydraulically connecting activation fluid with the downhole power unit 750. In at least one embodiment, the ported sub 770 provides a fluid path for the activation fluid to connect with the downhole power unit 750. For example, a blowout preventor (BOP) located at the earth's surface 505 could be closed, and then the annulus between the drill string 790 and the main wellbore 510 pressurized to a pre-determined activation pressure, as discussed above.

Once the downhole power unit 750 is subjected to the pre-determined activation pressure (e.g., via the ported sub 770), the setting sequence for the packer assembly 730 could initiate. As discussed above, in certain instances, a pressure sensor associated with the downhole power unit 750 may initiate the setting sequence, and in other instances the bursting of a burst disc associated with the ported sub 770 or the downhole power unit 750 may initiate the setting sequence. While the pressure sensor and burst disc have been described as possible solutions to initiate the setting sequence, those skilled in the art understand that other undisclosed solutions could be used and achieve the same result. After the setting sequence is complete, the user may confirm the correct setting of the packer assembly 730 by setting weight down and/or pulling on the packer assembly 730.

Figure 9:
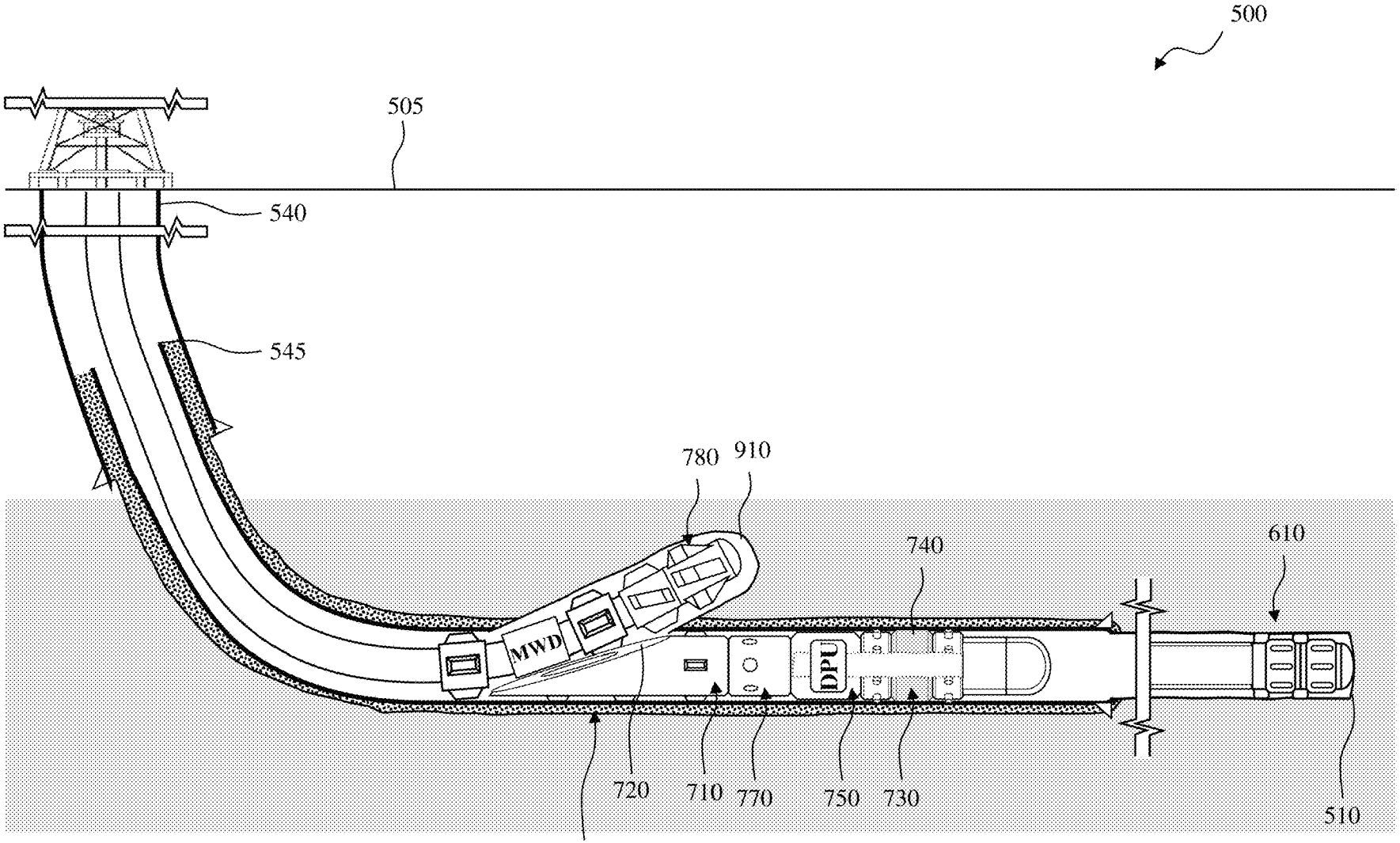

Turning to FIG. 9, illustrated is the well system 500 of FIG. 8 after setting down weight to shear the shear feature between the milling assembly 780 and the and the whipstock assembly 710, and then milling an initial window pocket 910 using the milling assembly 780. In certain embodiments, the initial window pocket 910 is between 1.5 m and 7.0 m long, and in certain other embodiments about 2.5 m long, and extends through the casing 545. Thereafter, a circulate and clean process could occur, and then the drill string 790 and milling assembly 780 may be pulled out-of-hole.

Figure 10:
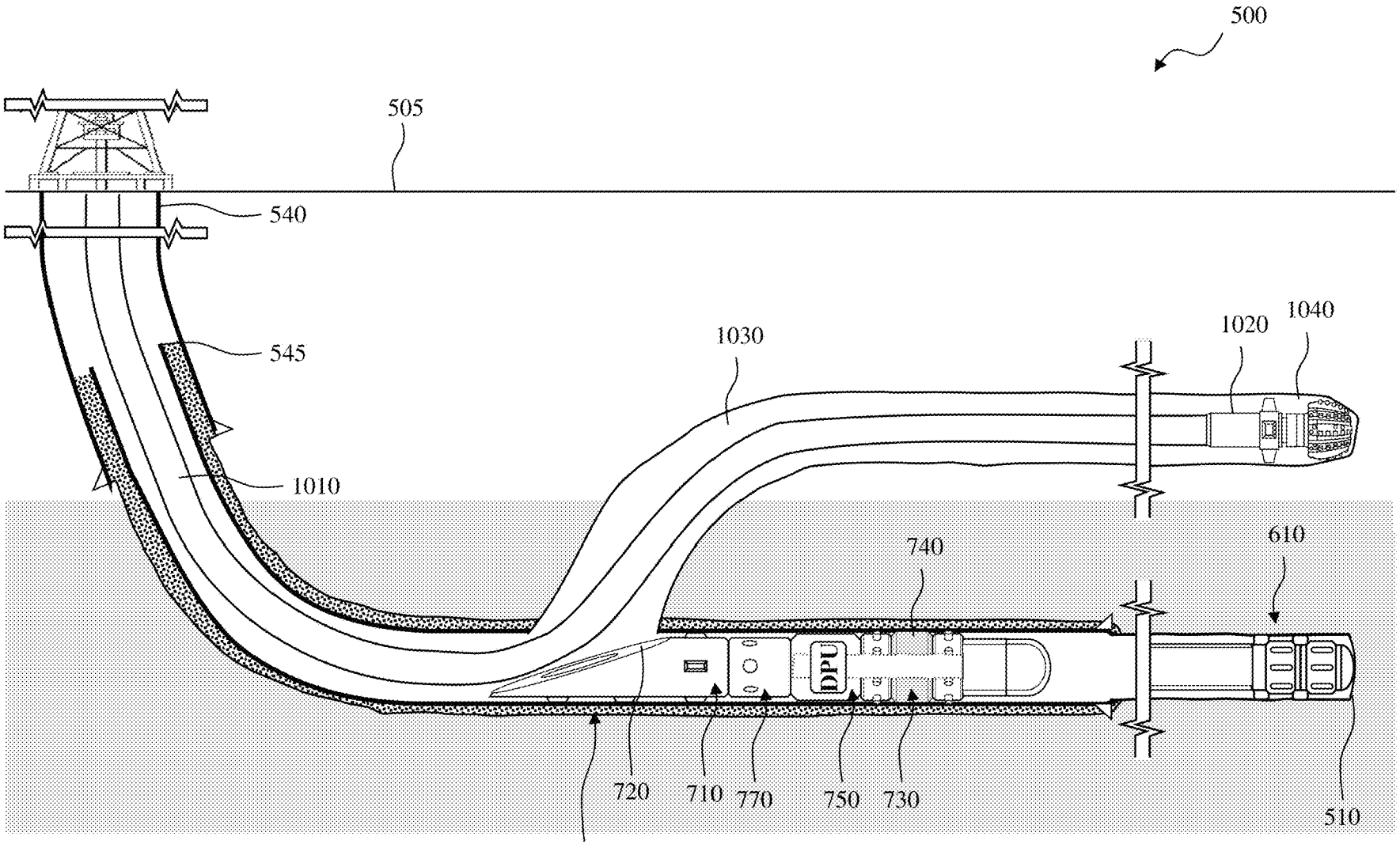

Turning to FIG. 10, illustrated is the well system 500 of FIG. 9 after running in hole a drill string 1010 with a rotary steerable assembly 1020, drilling a tangent 1030 following an inclination of the whipstock assembly 710, and then continuing to drill the lateral wellbore 1040 to depth. Thereafter, the drill string 1010 and rotary steerable assembly 1020 may be pulled out of hole, as shown in FIG. 11.

Figure 11:
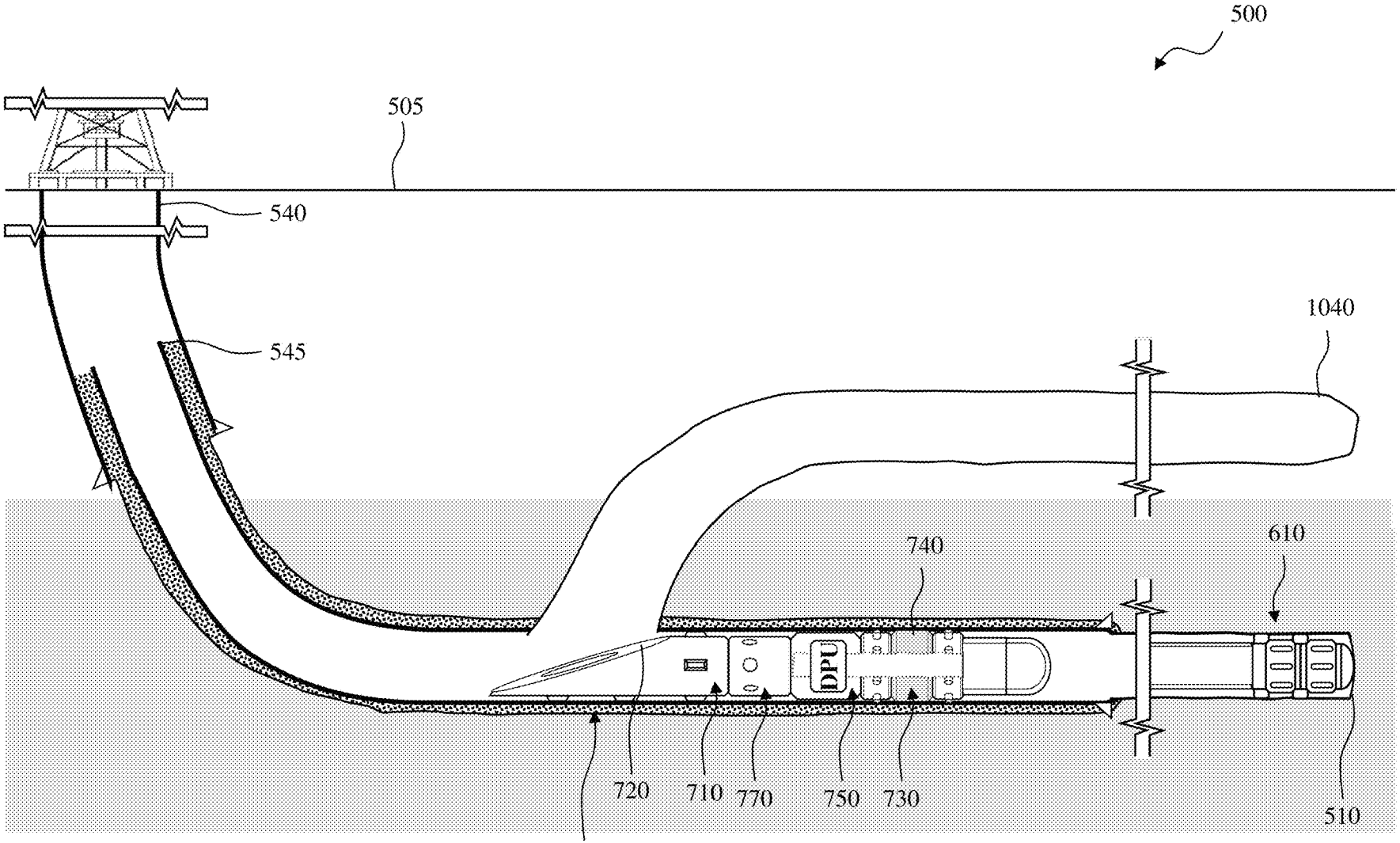
Figure 12:
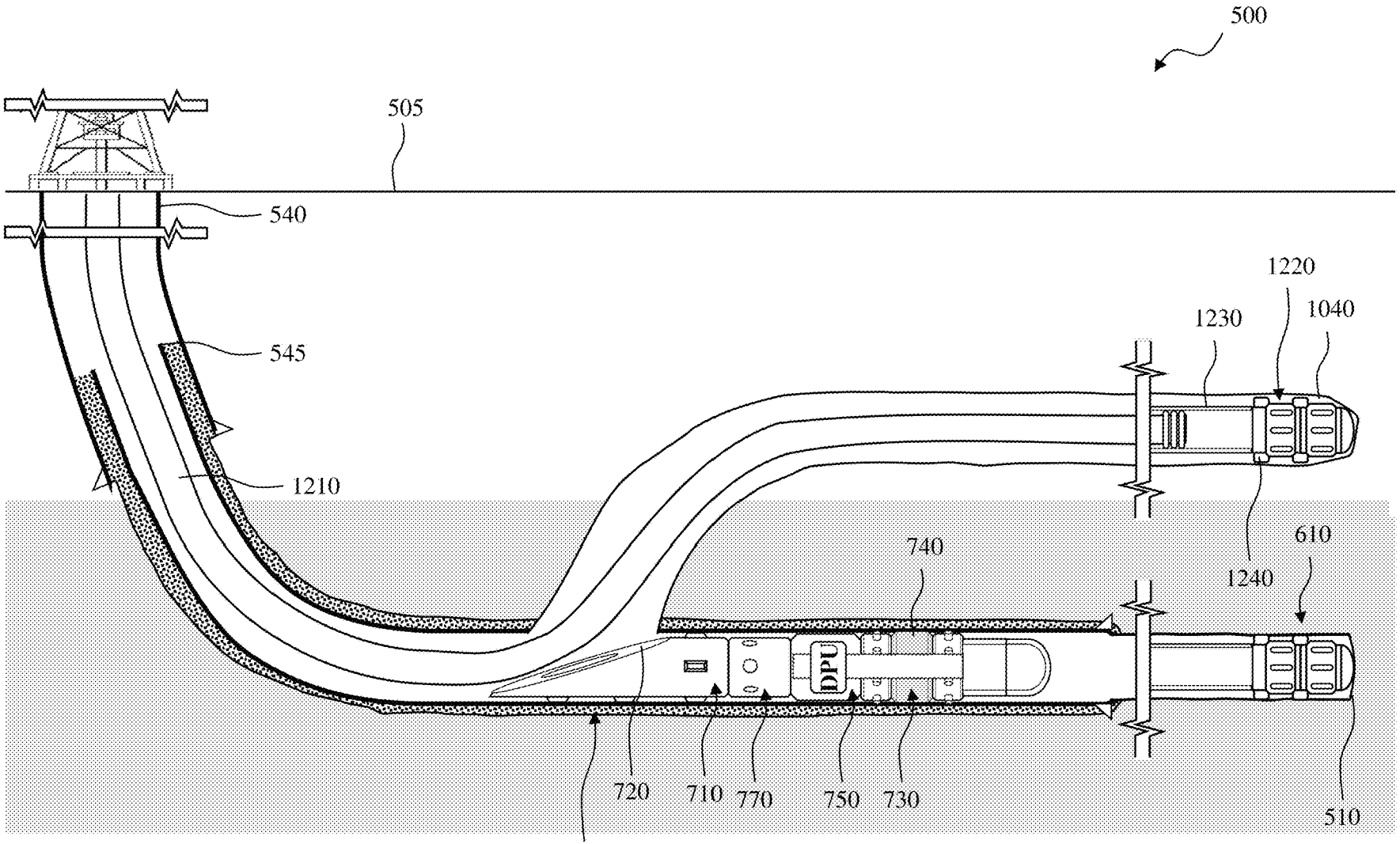

Turning to FIG. 12, illustrated is the well system 500 of FIG. 11 after employing an inner string 1210 to position a lateral wellbore completion 1220 in the lateral wellbore 1040. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled out of hole, as shown in FIG. 13.

Figure 13:
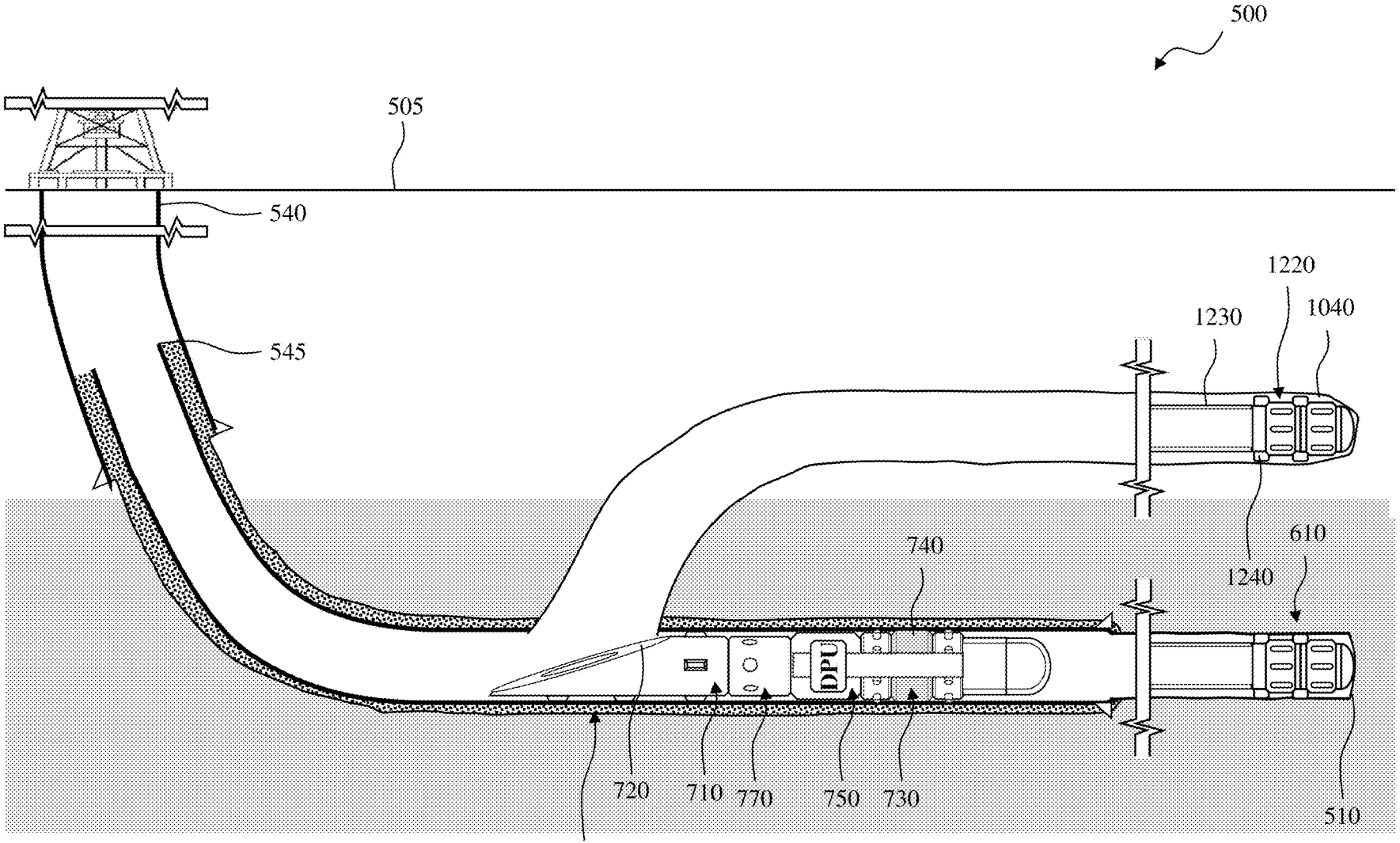
Figure 14:
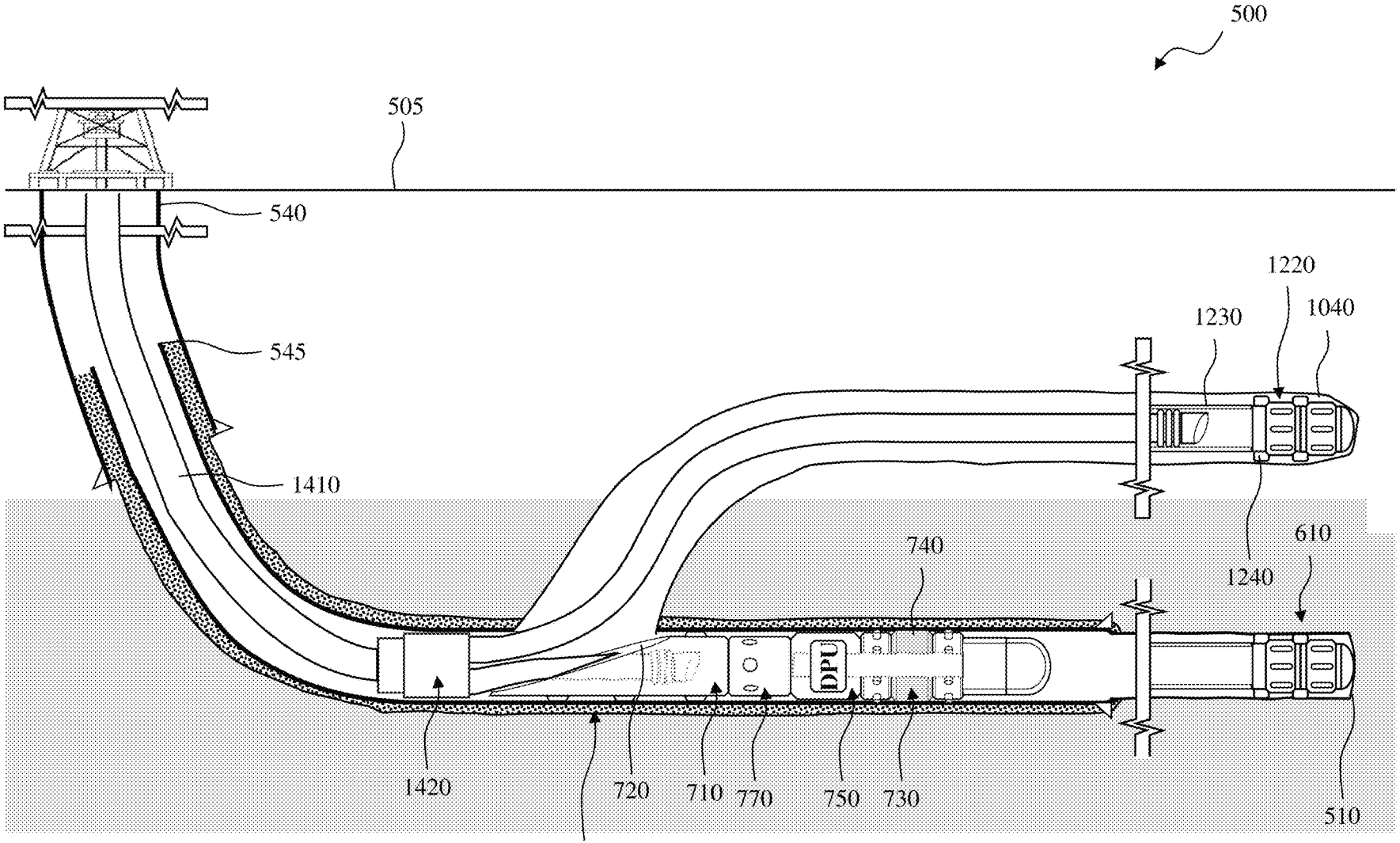

Turning to FIG. 14, illustrated is the well system 500 of FIG. 13 after employing a running tool 1410 to place a multilateral junction 1420 proximate an intersection between the main wellbore 510 and the lateral wellbore 1040.

Figure 15:
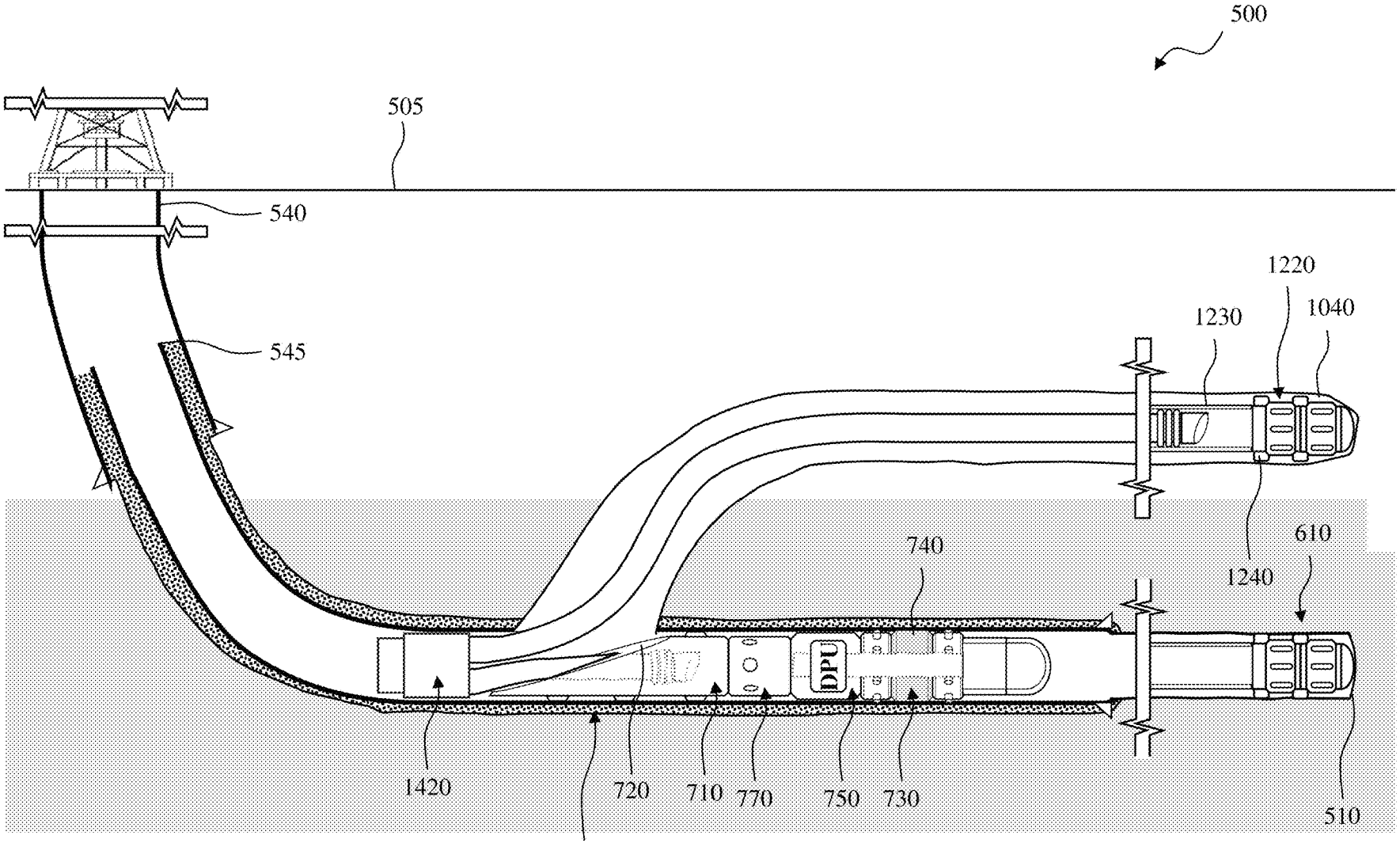

Turning to FIG. 15, illustrated is the well system 500 of FIG. 14 after removing the running tool 1410 from the main wellbore 510, leaving the multilateral junction 1420 in place.

Figure 16:
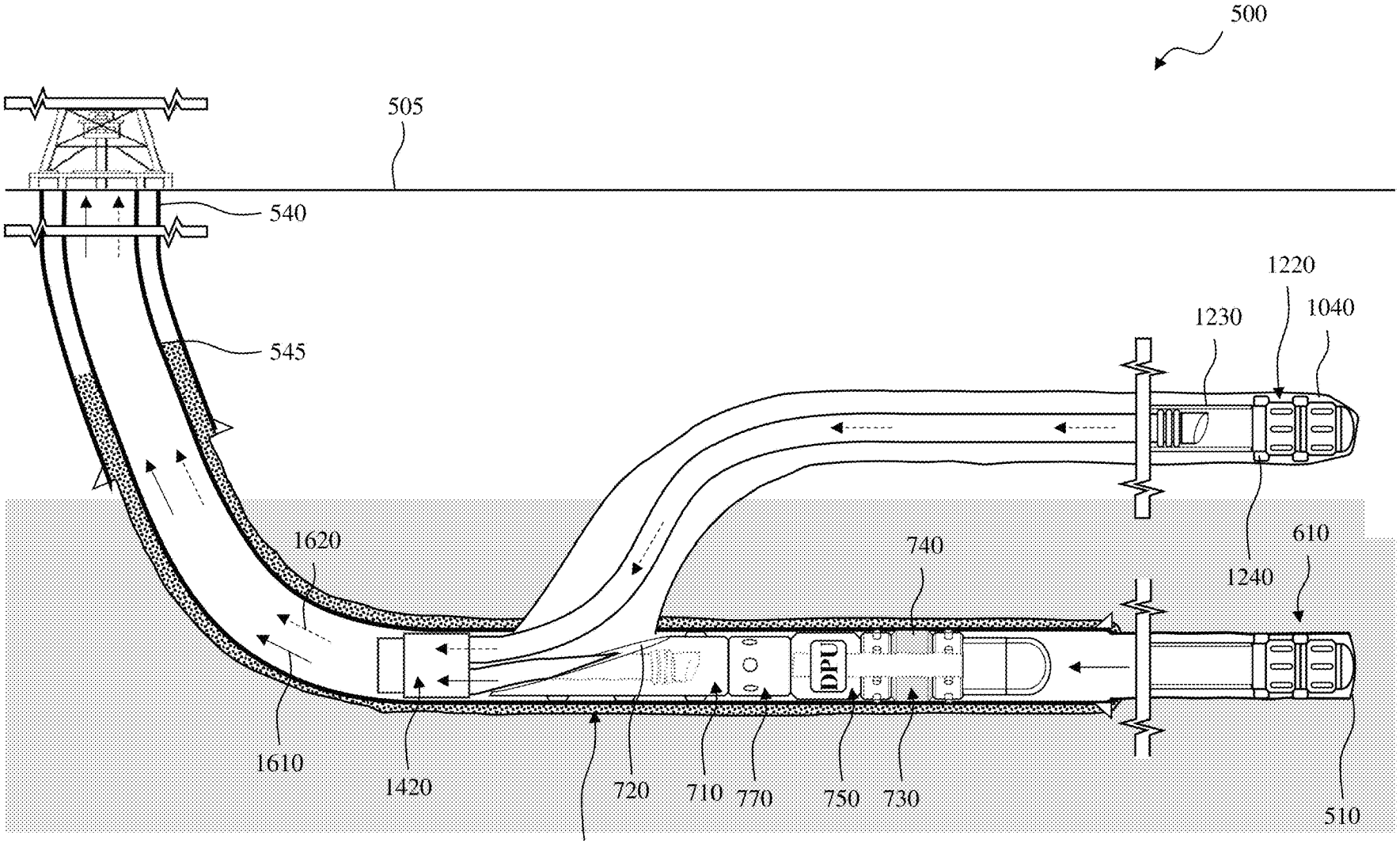
Figure 17:
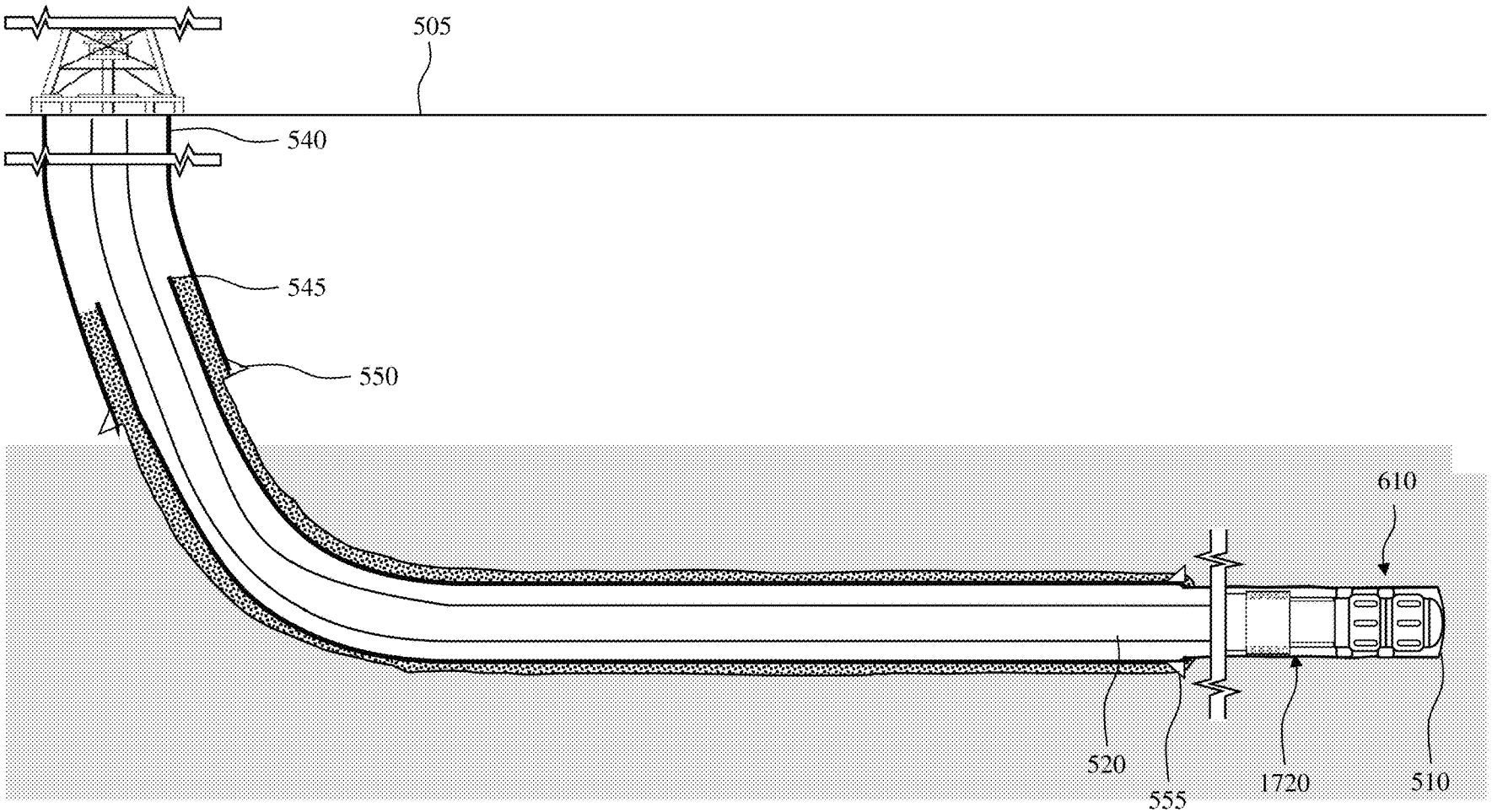
FIGS. 17 through 28 illustrate a method for forming, accessing, and/or producing from a well system according to an alternative embodiment of the disclosure.

Turning to FIG. 16, illustrated is the well system 500 of FIG. 15 after producing fluids 1610 from the main wellbore 510, and producing fluids 1620 from the lateral wellbore 1040. The producing of the fluids 1610, 1620, in at least one embodiment, may occur through the multilateral junction 1420.

Figure 18:
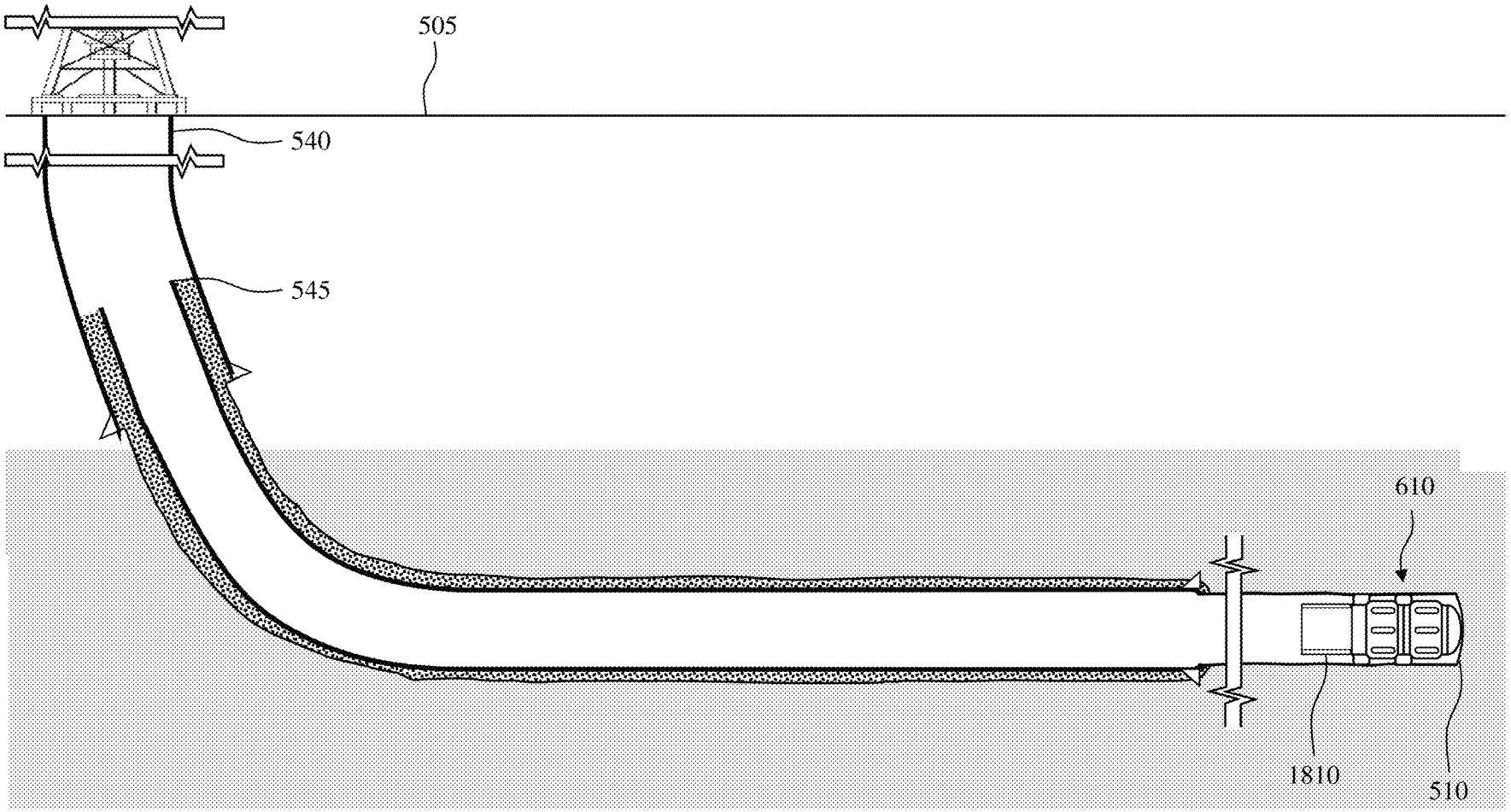
Figure 19:
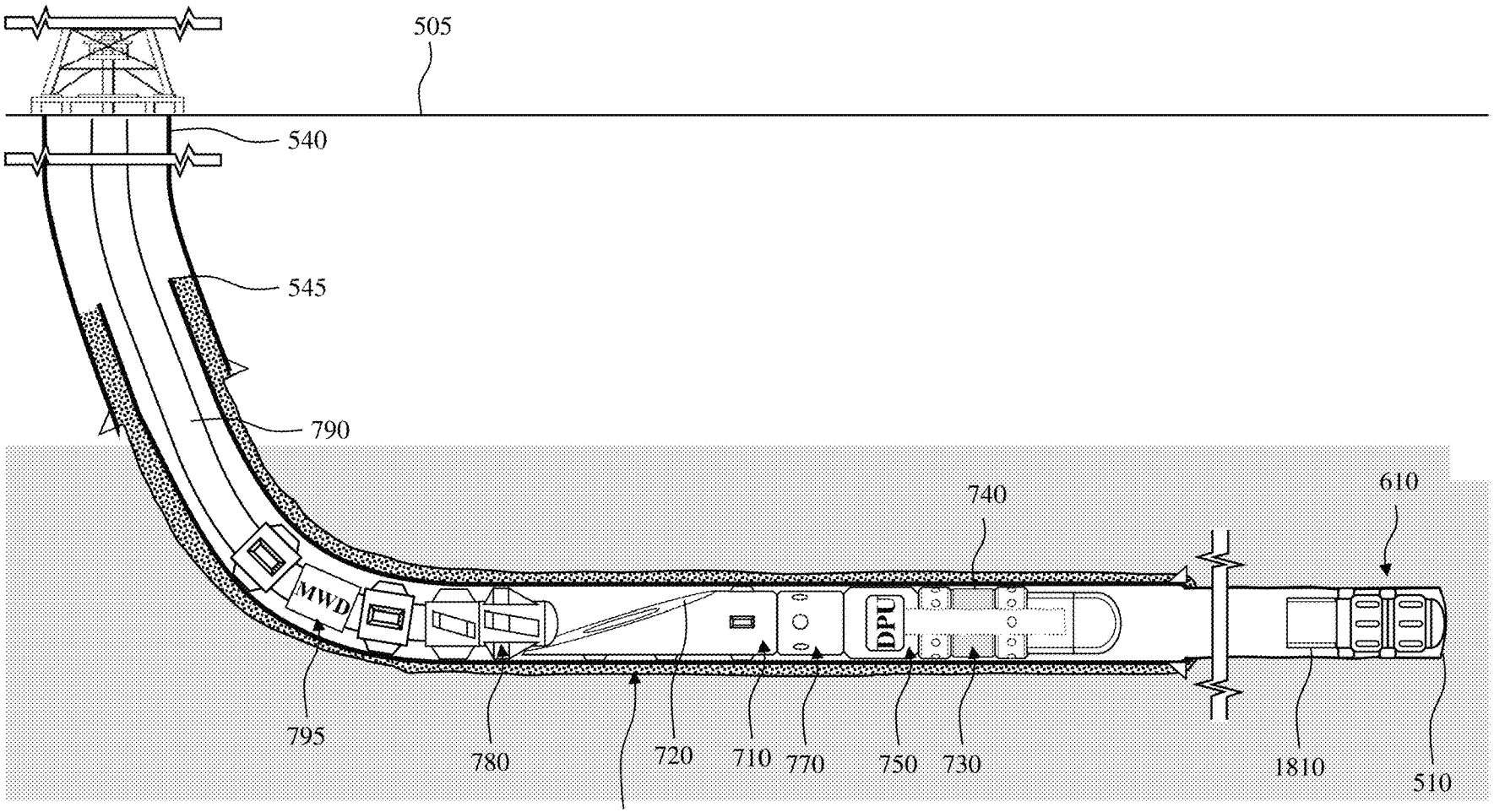
Figure 20:
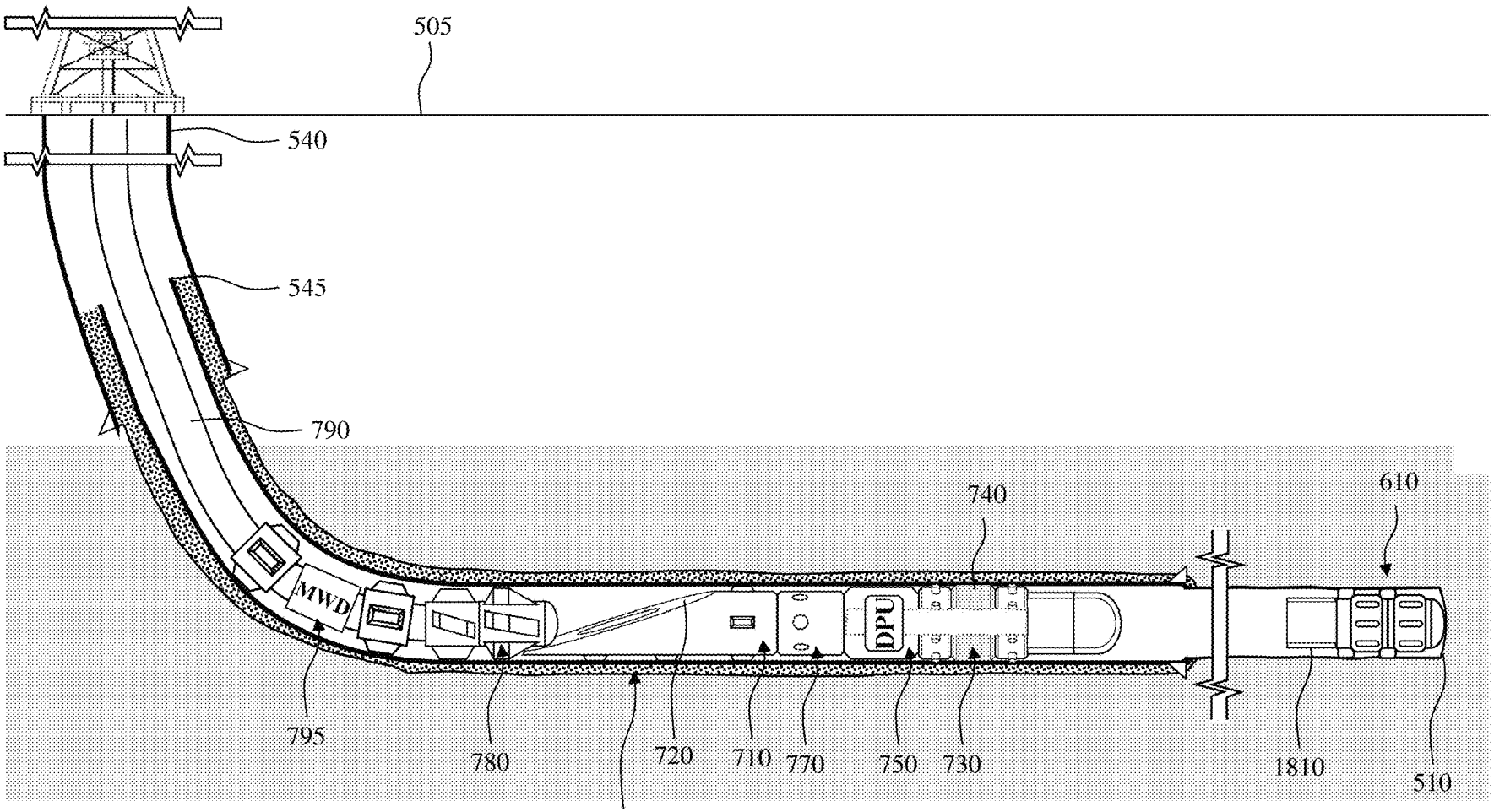
Figure 21:
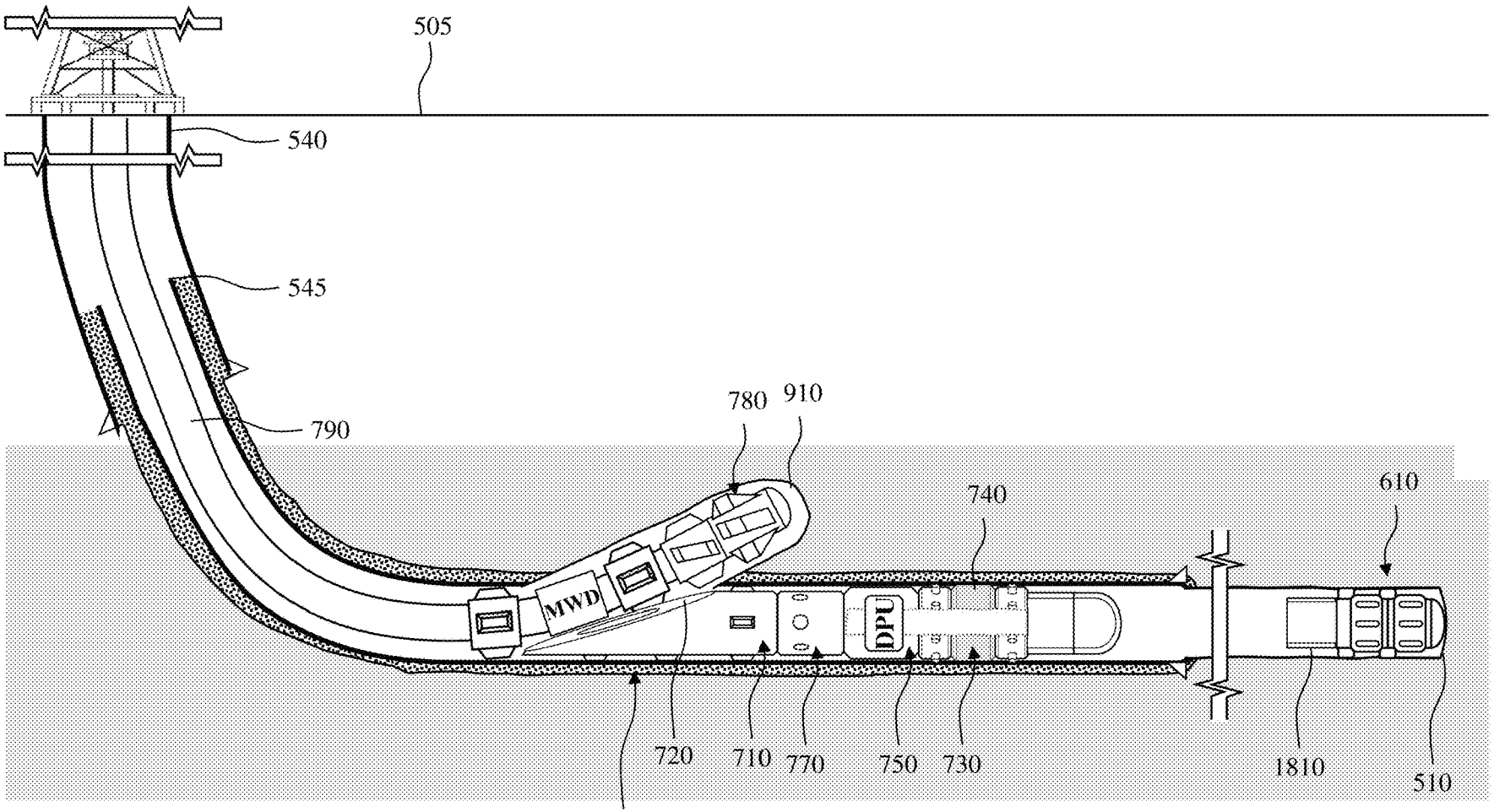
Figure 22:
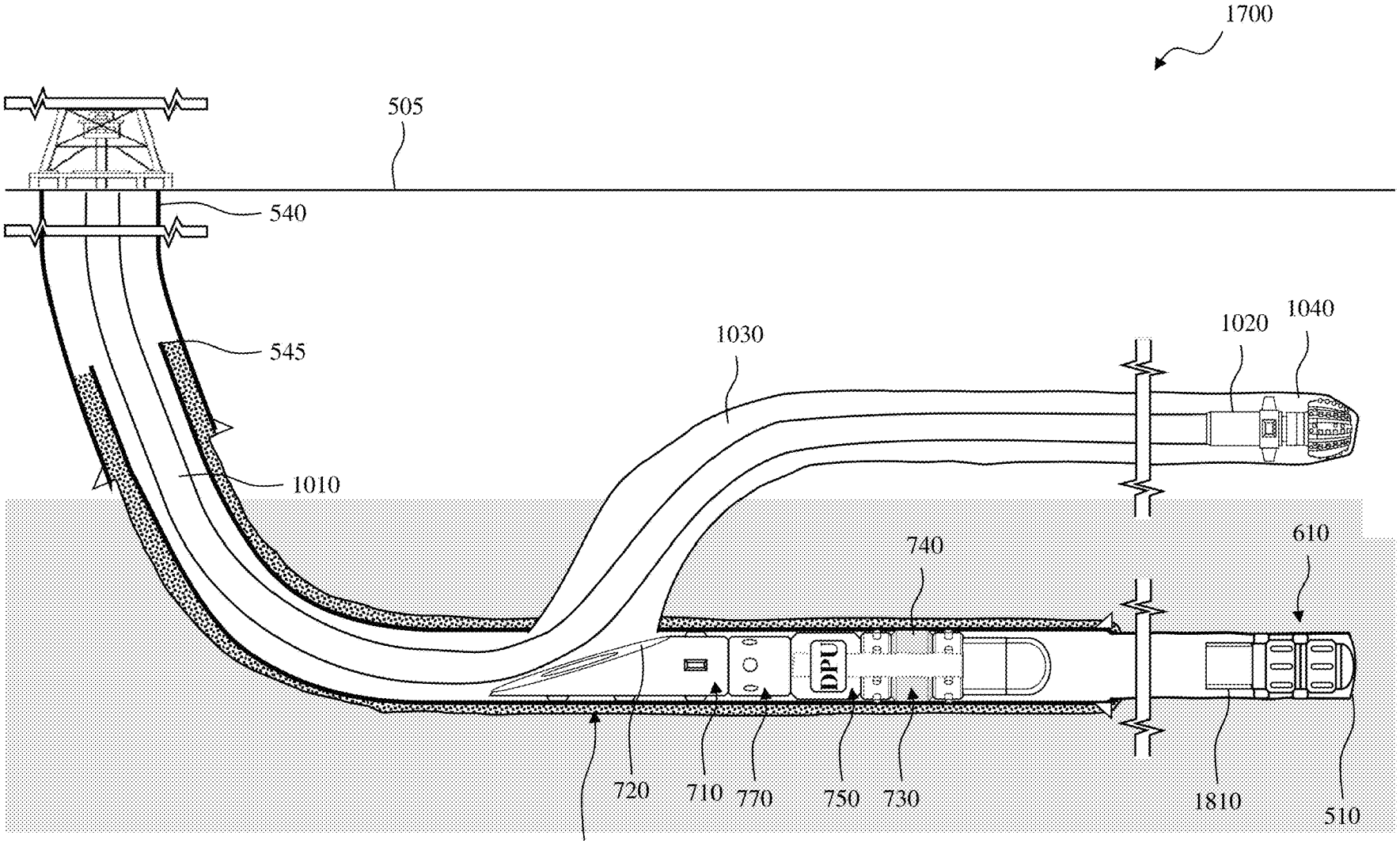
Figure 23:
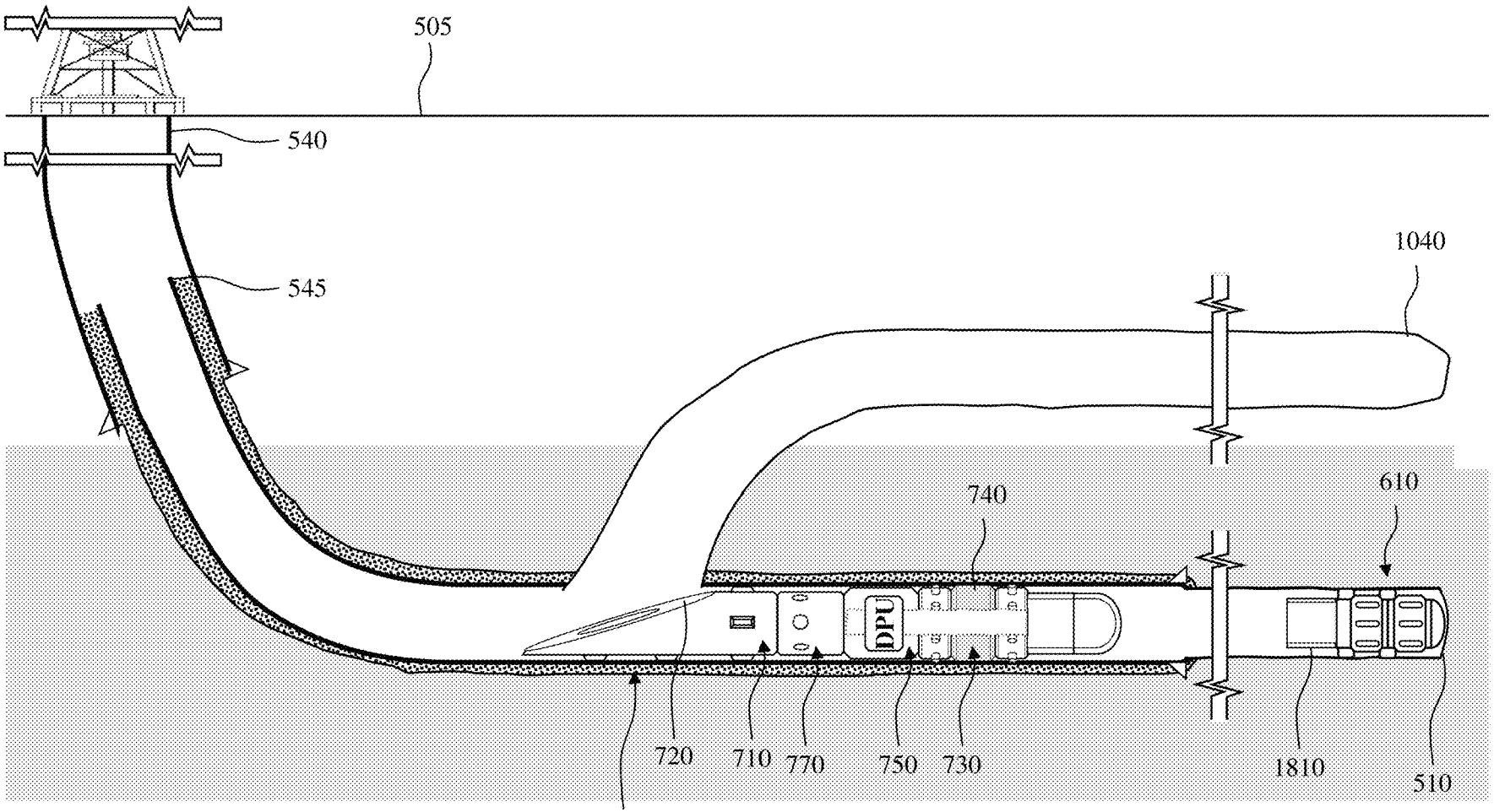
Figure 24:
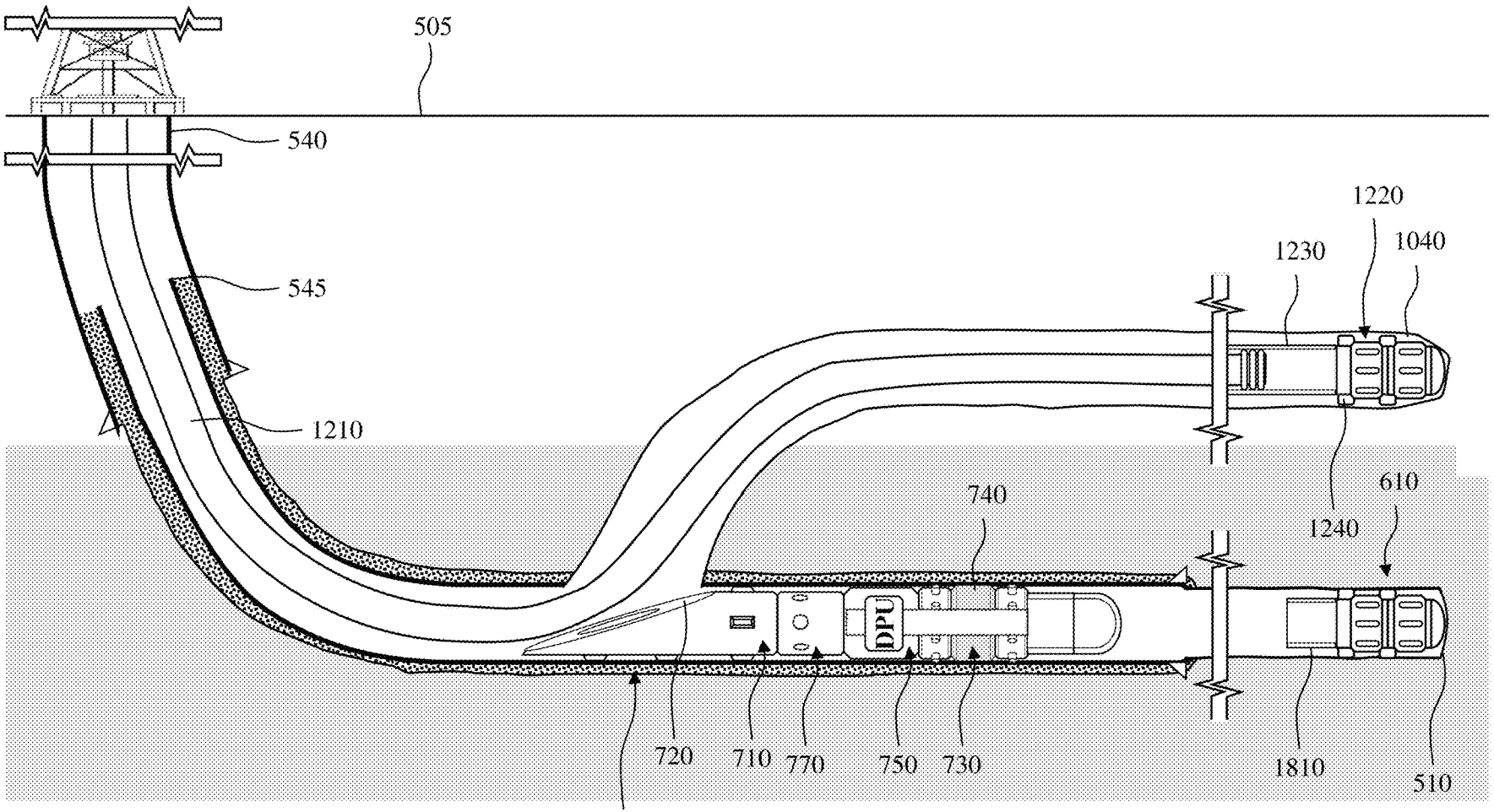
Figure 25:
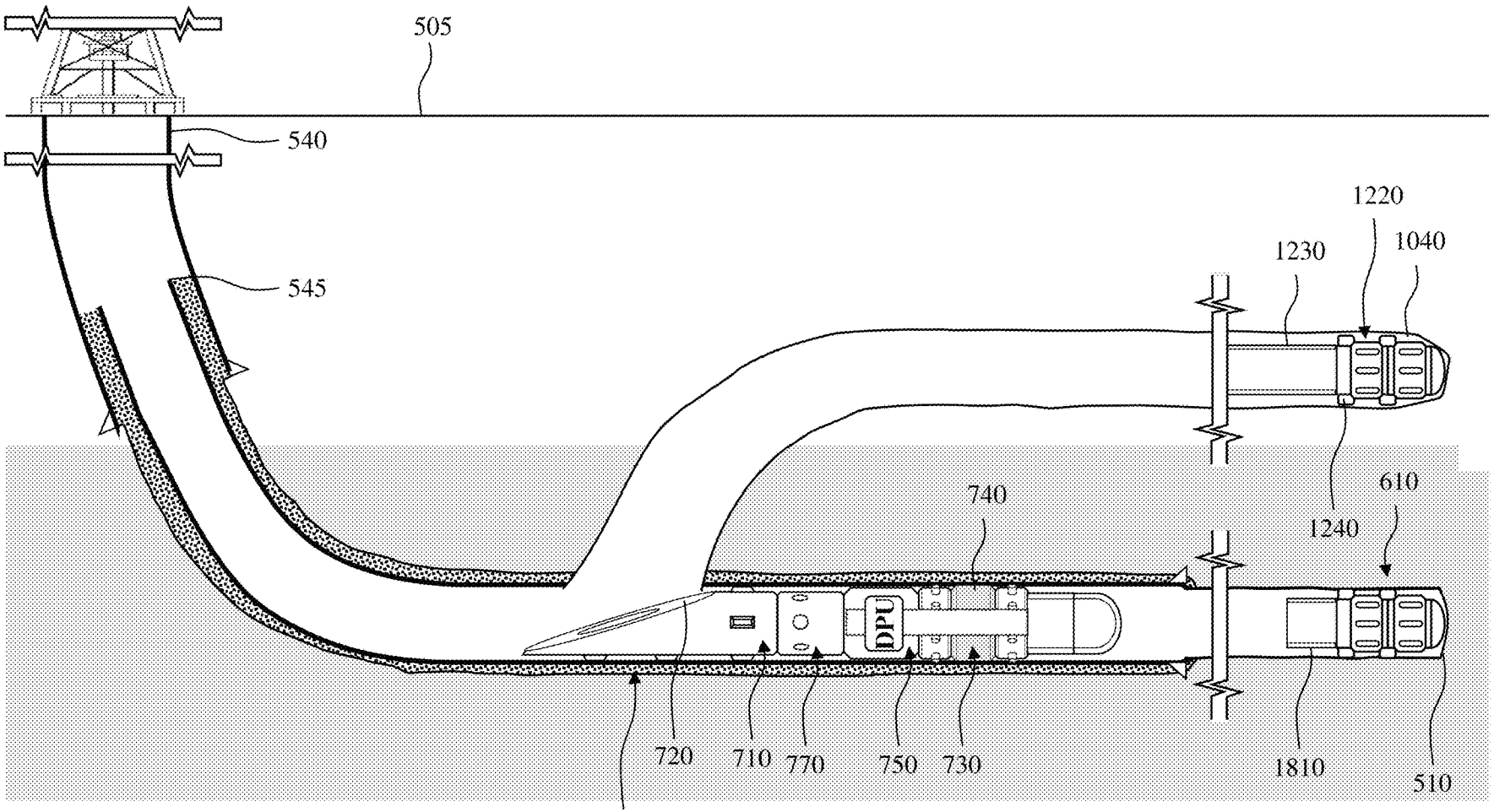
Figure 26:
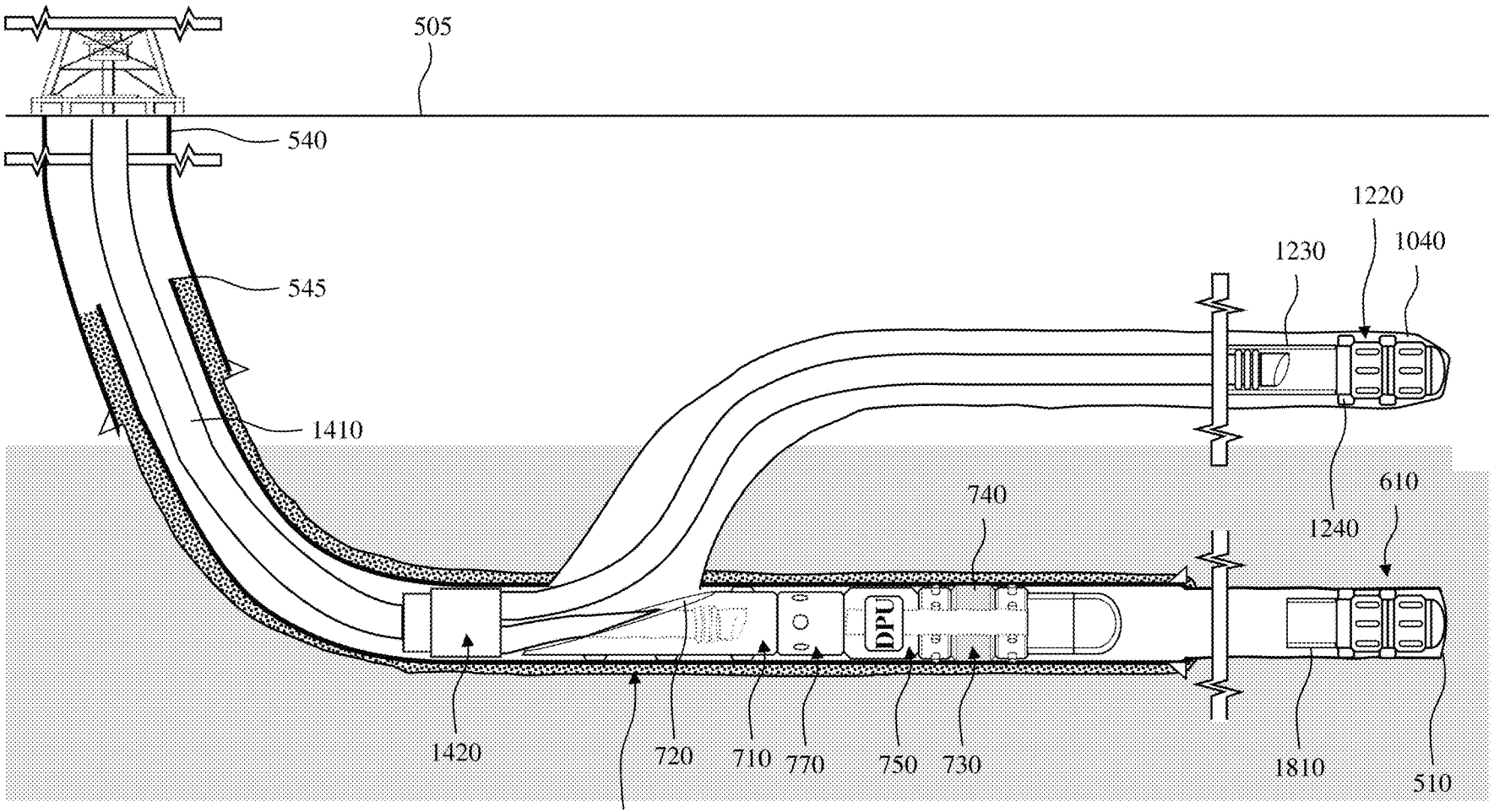
Figure 27:
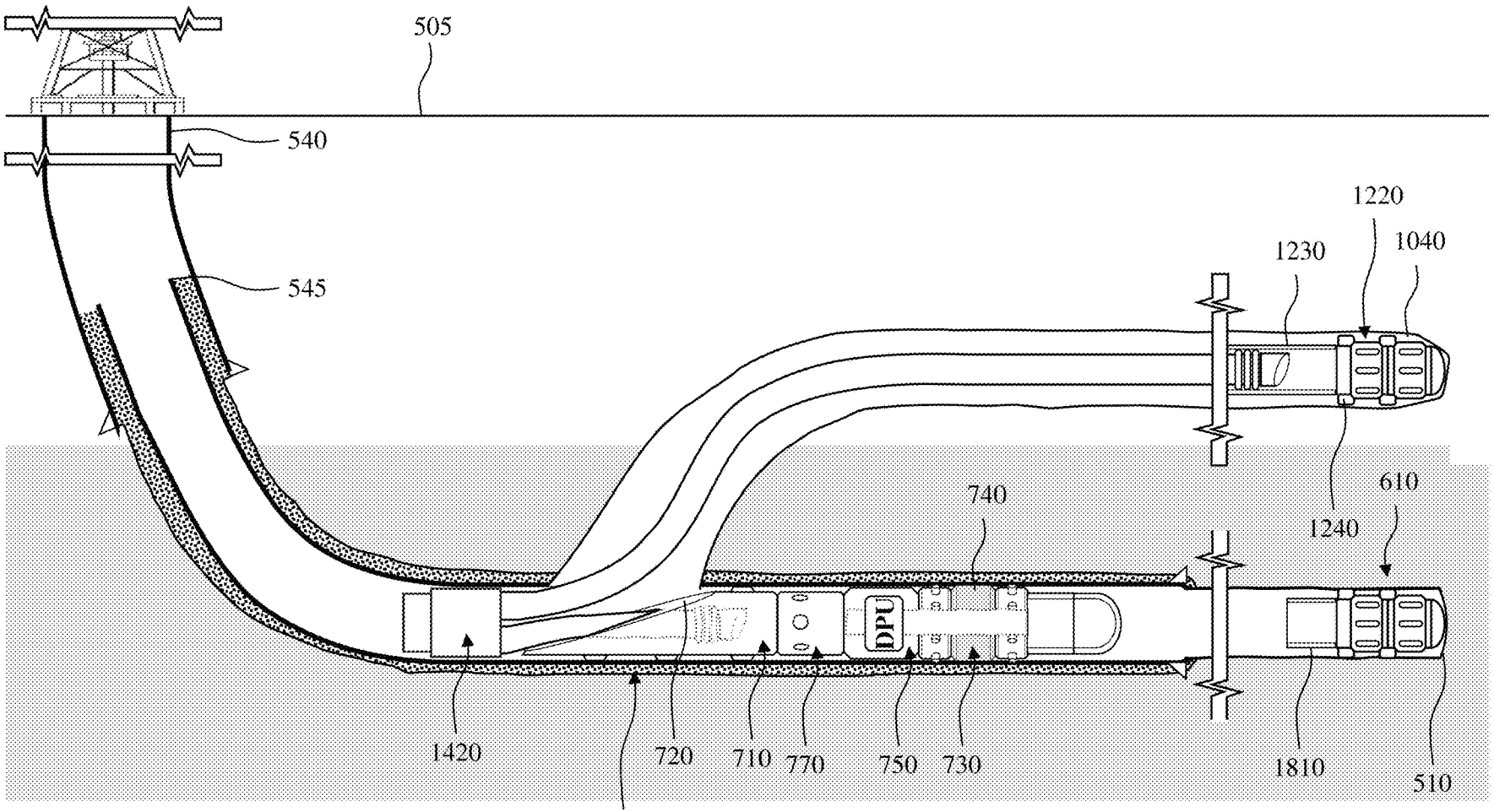
Figure 28:
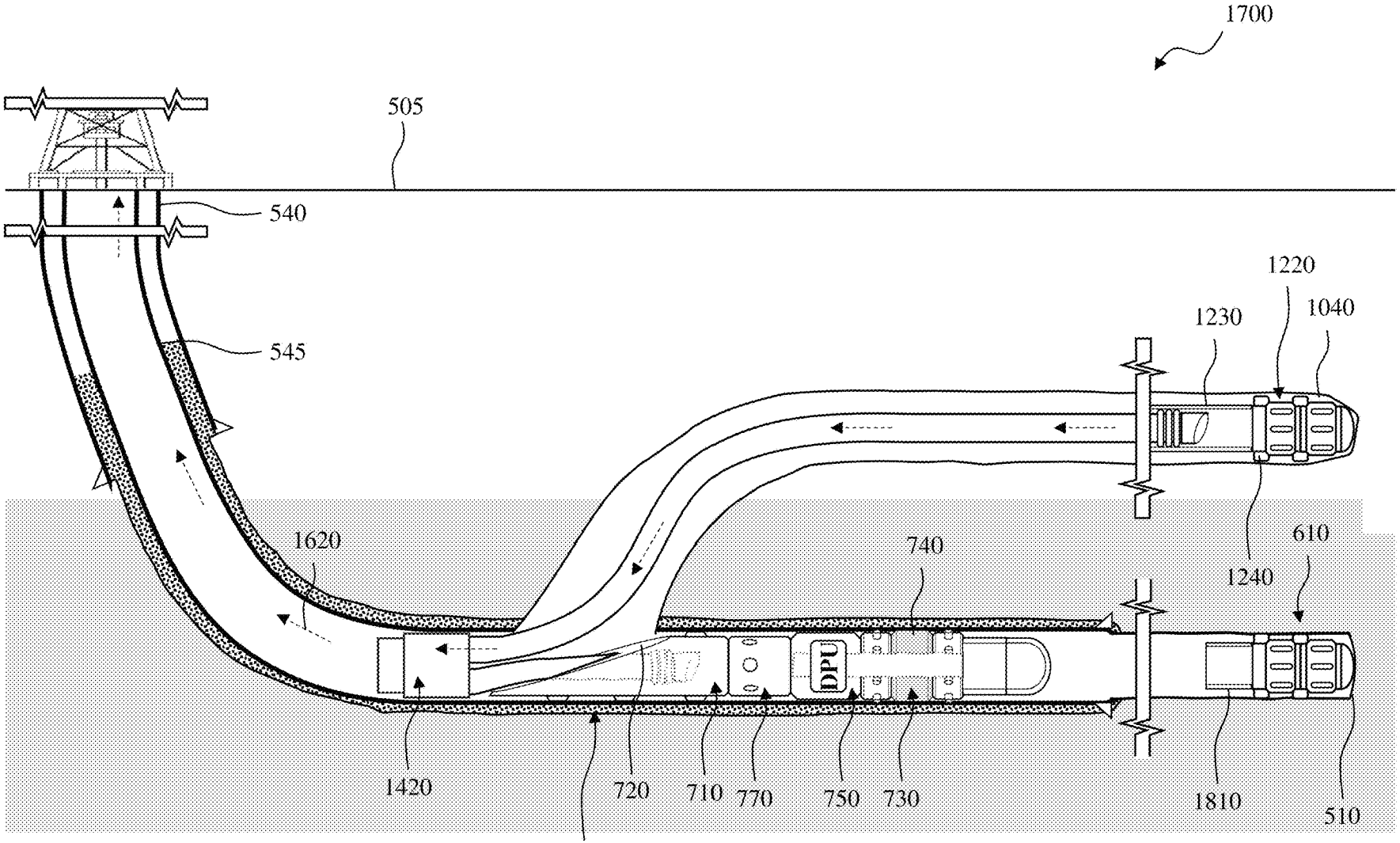

Turning now to FIGS. 17 through 28, illustrated is a method for forming, accessing, and/or producing from a well system 1700 designed, manufactured and/or operated according to one or more alternative embodiments of the disclosure. The method of FIGS. 17 through 28 is similar, in many respects, to the method of FIGS. 5 through 16. Accordingly, like reference numbers have been used to indicate similar features. The well system 1700 of the method of FIGS. 17 through 28 differs, for the most part, from the well system 500 of the method of FIGS. 5 through 16, in that the well system 1700 does not employ a working main wellbore completion 610, but in turn has cut and removed at least a portion of the main wellbore completion 610 (e.g., using a tubing cutter 1720), thus leaving cut tubing section 1810 (FIG. 18). In this embodiment, the downhole tool 705 would ultimately be sealing the main wellbore 510, such that the lateral wellbore 1040 could now be formed and produced therefrom (e.g., solely therefrom and without production from the cut tubing section 1810).

Turning now to FIGS. 29 through 35 illustrate a method for forming, accessing, and/or producing from a well system 2900 according to an alternative embodiment of the disclosure. The method of FIGS. 29 through 35 is similar, in many respects, to the methods of FIGS. 5 through 28. Accordingly, like reference numbers have been used to indicate similar features. The well system 2900 of the method of FIGS. 29 through 35 differs, for the most part, from the well systems 500, 1700 of the method of FIGS. 5 through 28, in that the well system 2900 is an existing completion 2910 that needs to be revamped.

Figure 29:
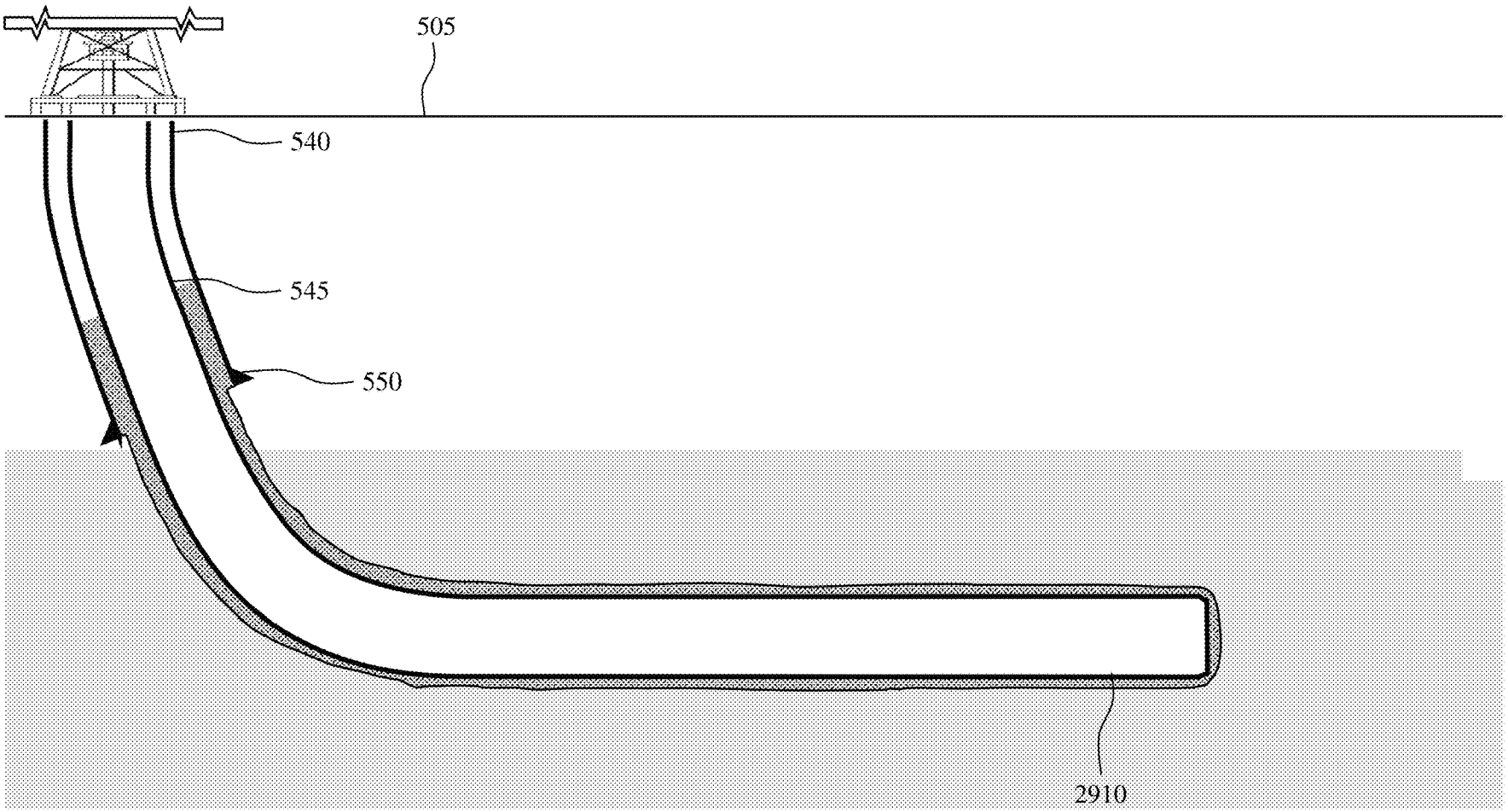
FIGS. 29 through 35 illustrate a method for forming, accessing, and/or producing from a well system according to an alternative embodiment of the disclosure.
Figure 30:
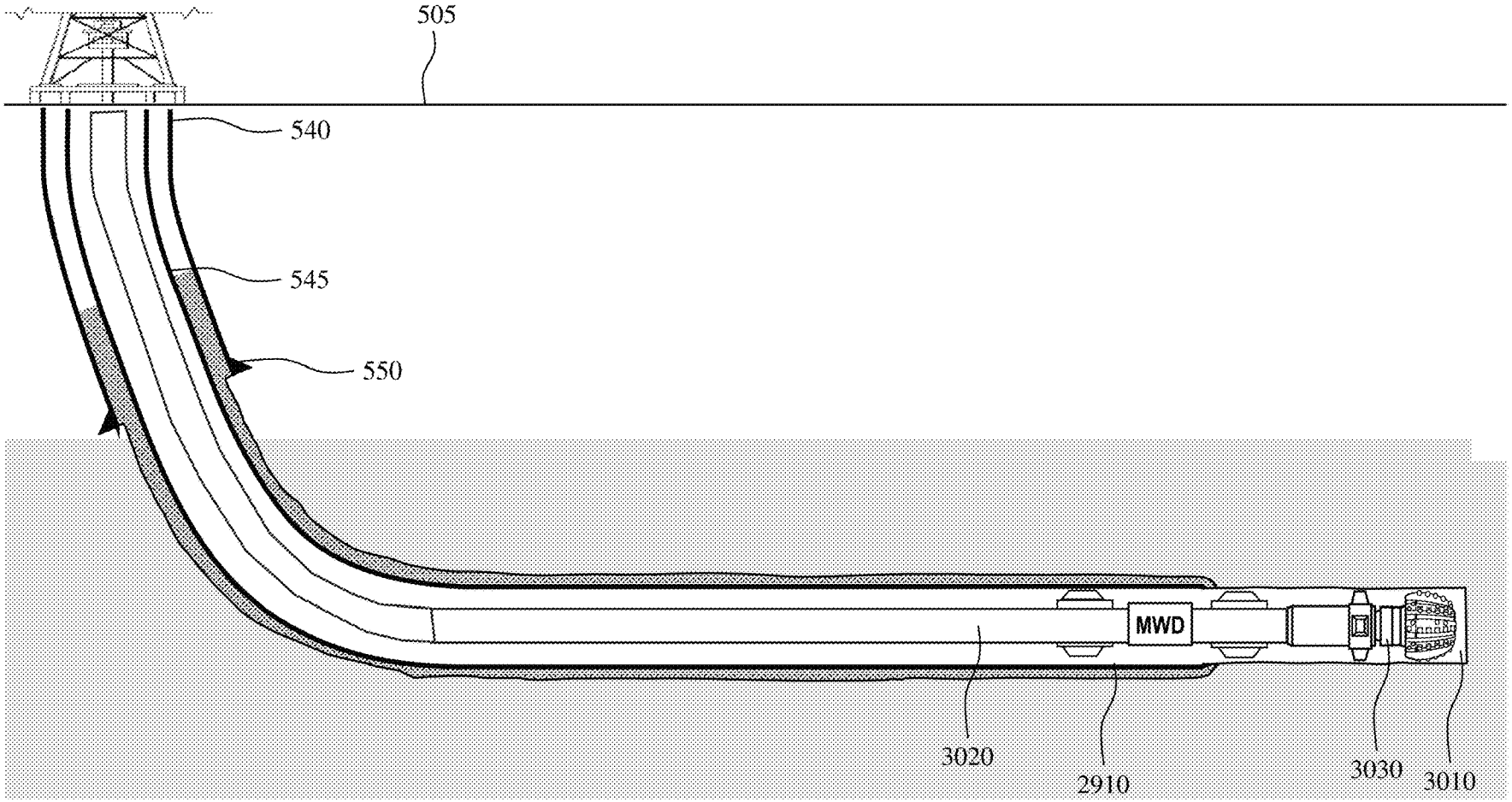

Turning to FIG. 30, illustrated is the well system 2900 of FIG. 29 after drilling an extended main wellbore 3010 to depth, for example using a rotary steerable system 3030 at the end of a drill string 3020.

Figure 31:
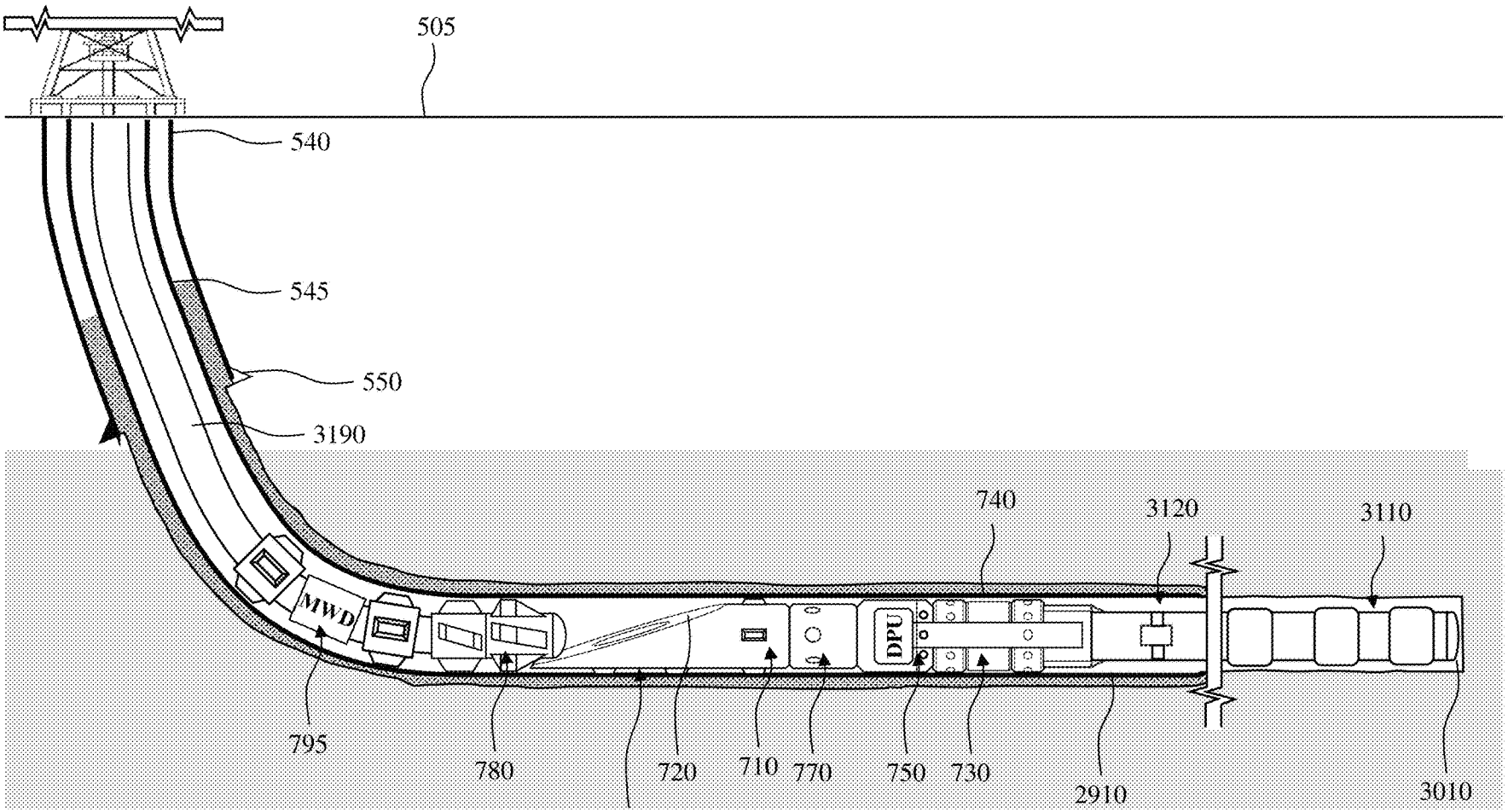
Figure 32:
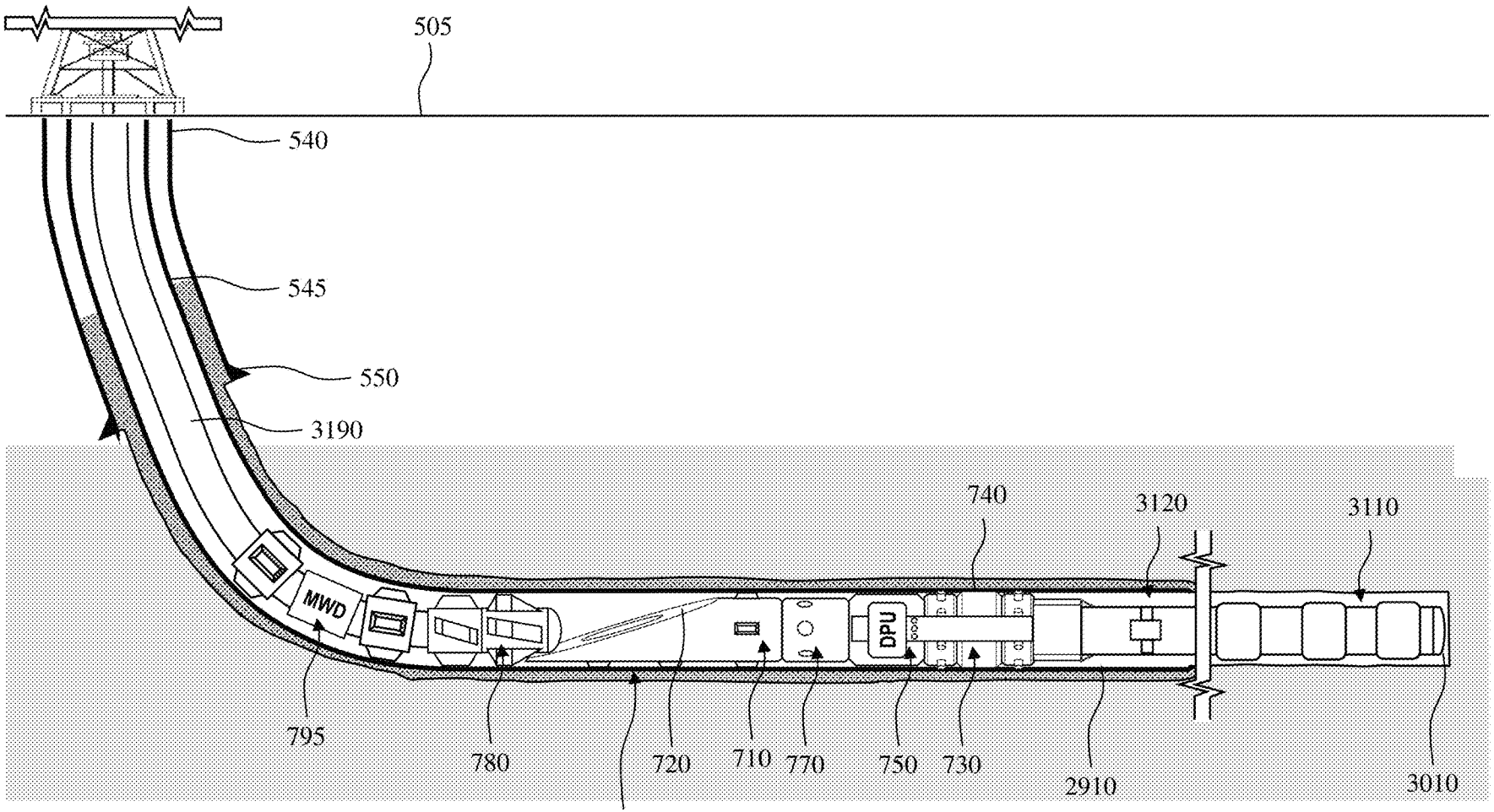

Turning to FIG. 31, illustrated is the well system 2900 of FIG. 30 after positioning a downhole tool 3105 (e.g., somewhat similar to the downhole tools 200, 300, 705 of FIGS. 2 through 28) designed, manufactured and/or operated according to one or more embodiments of the disclosure downhole at a location where a lateral wellbore is to be formed. The downhole tool 3105, in at least one embodiment, includes a whipstock assembly 710, for example including a whipface 720. The downhole tool 3105, in at least one embodiment, further includes a packer assembly 730 coupled to the whipstock assembly 710, the packer assembly 730 including a packer element 740 configured to move between a radially retracted state (e.g., as shown in FIG. 31) and a radially expanded state (e.g., as shown in FIG. 32). The downhole tool 3105, in at least one embodiment, further includes a downhole power unit 750 coupled to the packer assembly 730, the downhole power unit 750 configured to move the packer element 740 between the radially retracted state (e.g., as shown in FIG. 31) and the radially expanded state (e.g., as shown in FIG. 32). The downhole tool 705, in one or more other embodiments, may include a ported sub 770 coupled to the downhole power unit 750, the ported sub 770 configured to hydraulically connect activation fluid to the downhole power unit 750. The downhole tool 705, however, is not limited to the downhole power unit 750 to actuate the packer assembly 730. In contrast, any mechanism and/or method could be used to actuate the packer assembly 730 and remain within the scope of the disclosure.

The downhole tool 3105, in at least this listed embodiment, further includes main wellbore completion 3110 coupled to a downhole end thereof. The main wellbore completion 3110, in one or more embodiments, may include a screen liner. The main wellbore completion 3110 may, in certain embodiments, additionally include a main wellbore liner (e.g., with frac sleeves in one embodiment), as well as one or more packers (e.g., swell packers in one embodiment). As shown, the main wellbore completion 3110, in this embodiment, may be fixed in place using the packer assembly 730.

The downhole tool 3105 may additionally include a remote open/close valve 3120 (e.g., being run-in-hole in the closed position) associated with the main wellbore completion 3110. In at least the illustrated embodiment, the remote open/close valve 3120 is configured to move between a closed state and an open state based upon a remote signal it receives (e.g., pressure, temperature, time, an acoustic signal, etc.). The remote open/close valve 3120, in the illustrated embodiment, is positioned between the packer assembly 730 and the main wellbore completion 3110, but it may be located elsewhere. While the embodiment of FIG. 31 employs a remote open/close valve 3120, in yet another embodiment a different isolation device (e.g., an isolation device that is opened with pressure, such as a glass plug) may be used.

In certain embodiments, such as that shown in FIG. 31, the downhole tool 3105 further includes a milling assembly 780 coupled with the whipstock assembly 710. For example, in at least one embodiment, a lead mill bit of the milling assembly 780 is coupled to the whipface 720 of the whipstock assembly 710, for example using a shear feature. In this embodiment, the downhole tool 3105 (e.g., an entirety of the downhole tool 3105) may be run-in-hole with a drill string 3190 coupled to the milling assembly 780. Furthermore, a workstring orientation tool/measuring while drilling tool (WOT/MWD) tool 795 may be employed to orient (e.g., both axially and rotationally orient) the downhole tool 3105 as it is being run-in-hole.

Turning to FIG. 32, illustrated is the well system 2900 of FIG. 31 after setting the downhole tool 3105, and thus moving the packer element 740 from its radially retracted state (e.g., as shown in FIG. 31) to its radially expanded state (e.g., as shown in FIG. 32). In at least one embodiment, this may be achieved by hydraulically connecting activation fluid with the downhole power unit 750. In at least one embodiment, the ported sub 770 provides a fluid path for the activation fluid to connect with the downhole power unit 750. For example, a blowout preventor (BOP) located at the earth's surface 505 could be closed, and then the annulus between the drill string 790 and the main wellbore 510 pressurized to a pre-determined activation pressure, as discussed above.

Once the downhole power unit 750 is subjected to the pre-determined activation pressure (e.g., via the ported sub 770), the setting sequence for the packer assembly 730 could initiate. As discussed above, in certain instances, a pressure sensor associated with the downhole power unit 750 may initiate the setting sequence, and in other instances the bursting of a burst disc associated with the ported sub 770 or the downhole power unit 750 may initiate the setting sequence. While the pressure sensor and burst disc have been described as possible solutions to initiate the setting sequence, those skilled in the art understand that other undisclosed solutions could be used and achieve the same result. After the setting sequence is complete, the user may confirm the correct setting of the packer assembly 730 by setting weight down and/or pulling on the packer assembly 730.

Figure 33A:
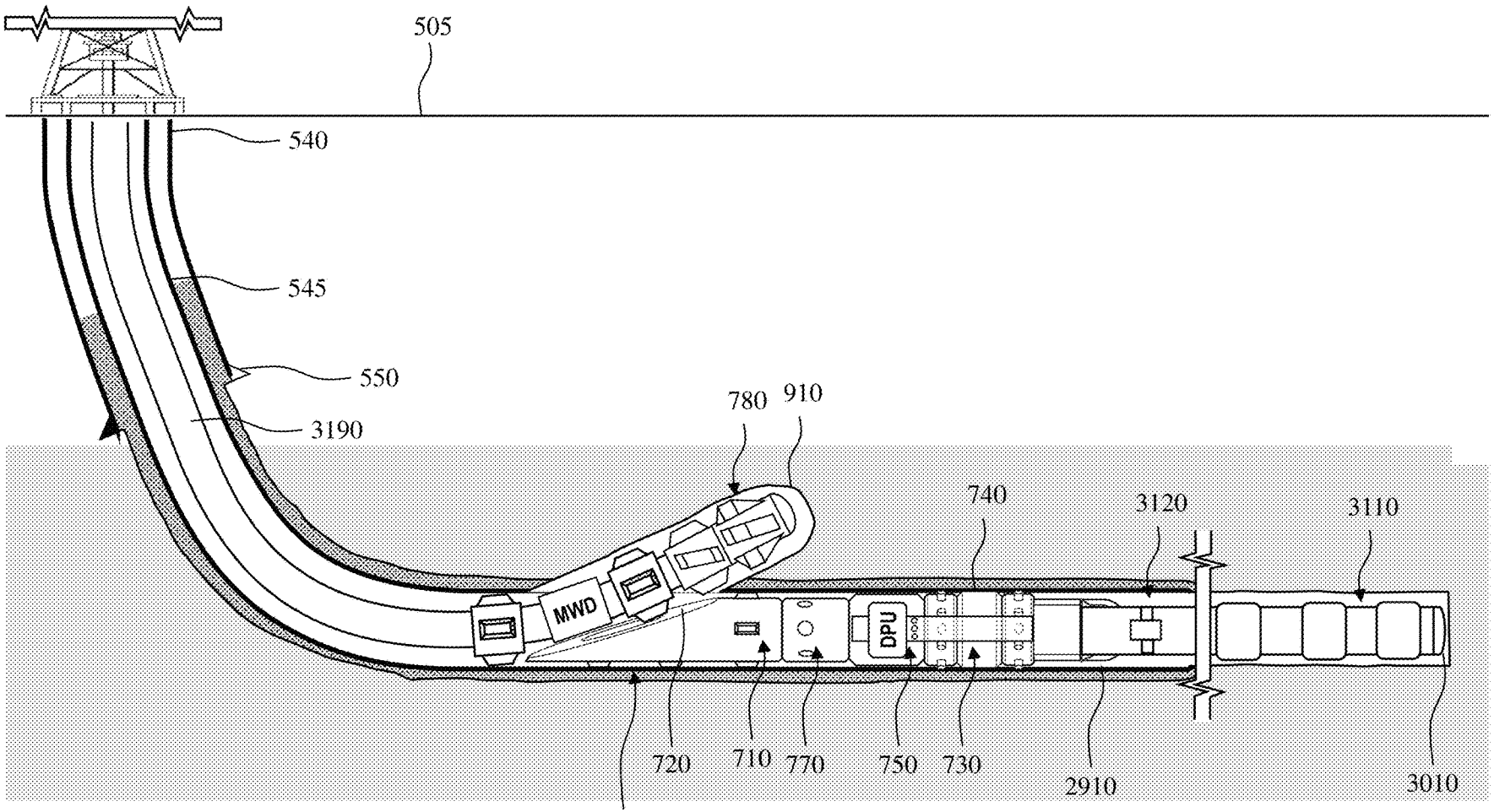

Turning to FIG. 33A, illustrated is the well system 2900 of FIG. 32 after setting down weight to shear the shear feature between the milling assembly 780 and the whipstock assembly 710, and then milling an initial window pocket 910 using the milling assembly 780. In certain embodiments, the initial window pocket 910 is between 1.5 m and 7.0 m long, and in certain other embodiments about 2.5 m long, and extends through the casing 545. Thereafter, a circulate and clean process could occur, and then the drill string 790 and milling assembly 780 may be pulled out-of-hole.

Figure 33B:
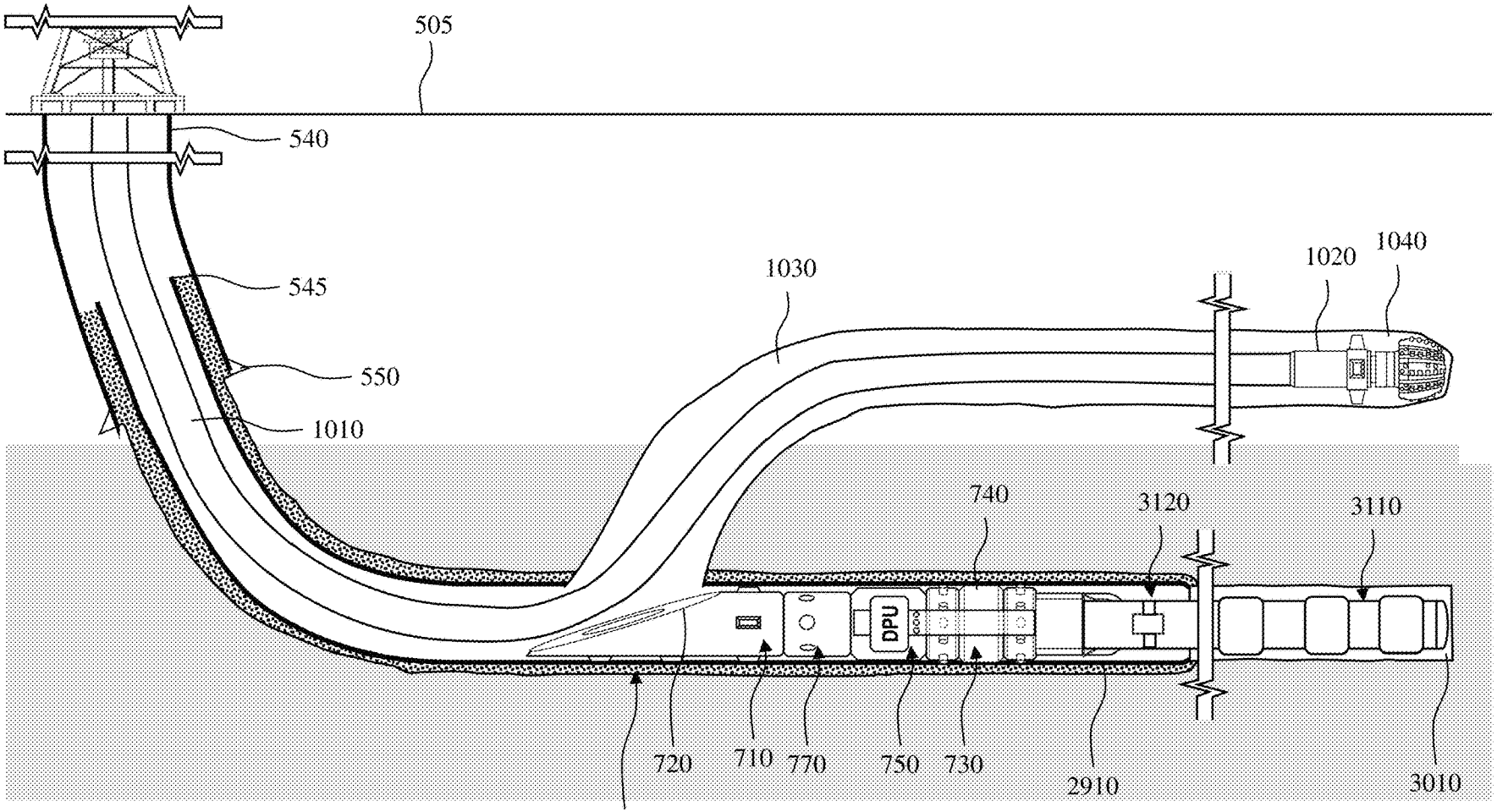

Turning to FIG. 33B, illustrated is the well system 2900 of FIG. 33A after running in hole a drill string 1010 with a rotary steerable assembly 1020, drilling a tangent 1030 following an inclination of the whipstock assembly 710, and then continuing to drill the lateral wellbore 1040 to depth. Thereafter, the drill string 1010 and rotary steerable assembly 1020 may be pulled out of hole, as shown in FIG. 33C.

Figure 33C:
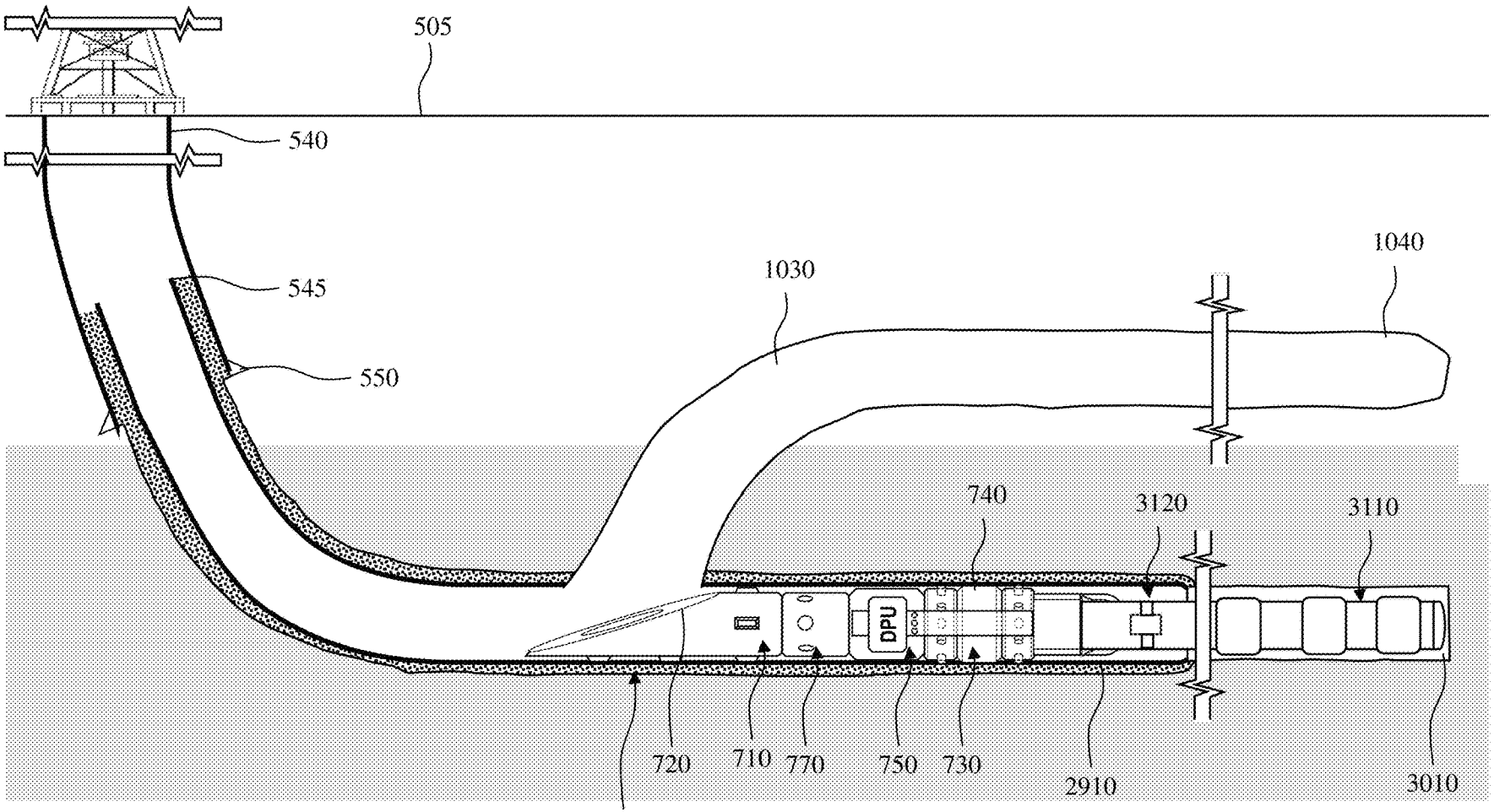
Figure 34A:
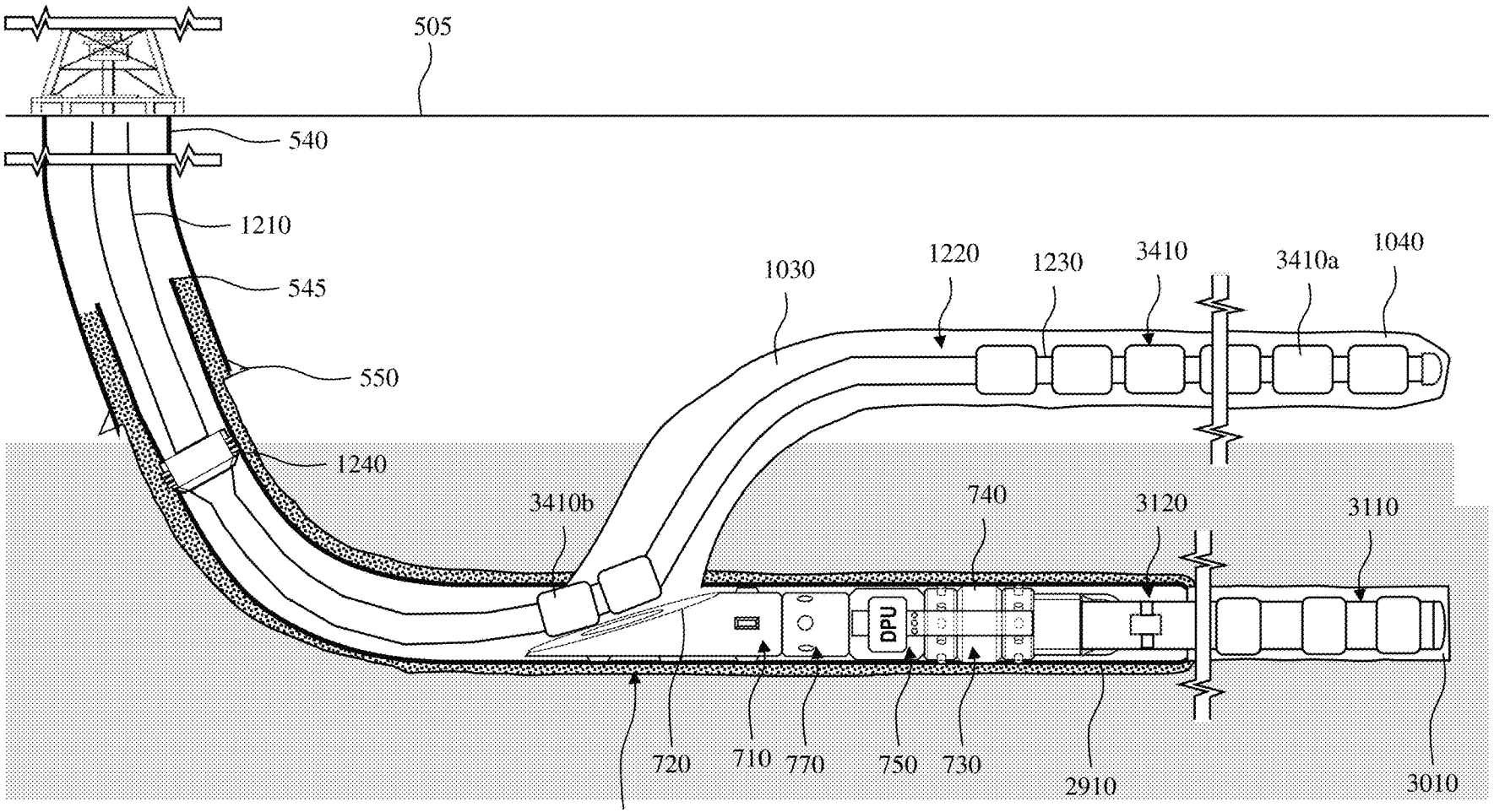

Turning to FIG. 34A, illustrated is the well system 2900 of FIG. 33C after employing an inner string 1210 to position a lower lateral wellbore completion 1220 in the lateral wellbore 1040. The lower lateral wellbore completion 1220 may, in certain embodiments, include a lateral wellbore liner 1230 (e.g., with frac sleeves in one embodiment), as well as one or more packers 1240 (e.g., swell packers in one embodiment). The lower lateral wellbore completion 1220, in one or more embodiments, may further include one or more screens 3410 (e.g., sand screens). In at least one embodiment, screens 3410*a* are located in the lateral reservoir (e.g., lateral wellbore 1040) and other screens 3410*b* are located across the whipstock assembly 710 to receive main-bore production that is funneled therein via the one or more packers 1240. Thereafter, the inner string 1210 may be pulled out of hole, as shown in FIG. 34B.

Figure 34B:
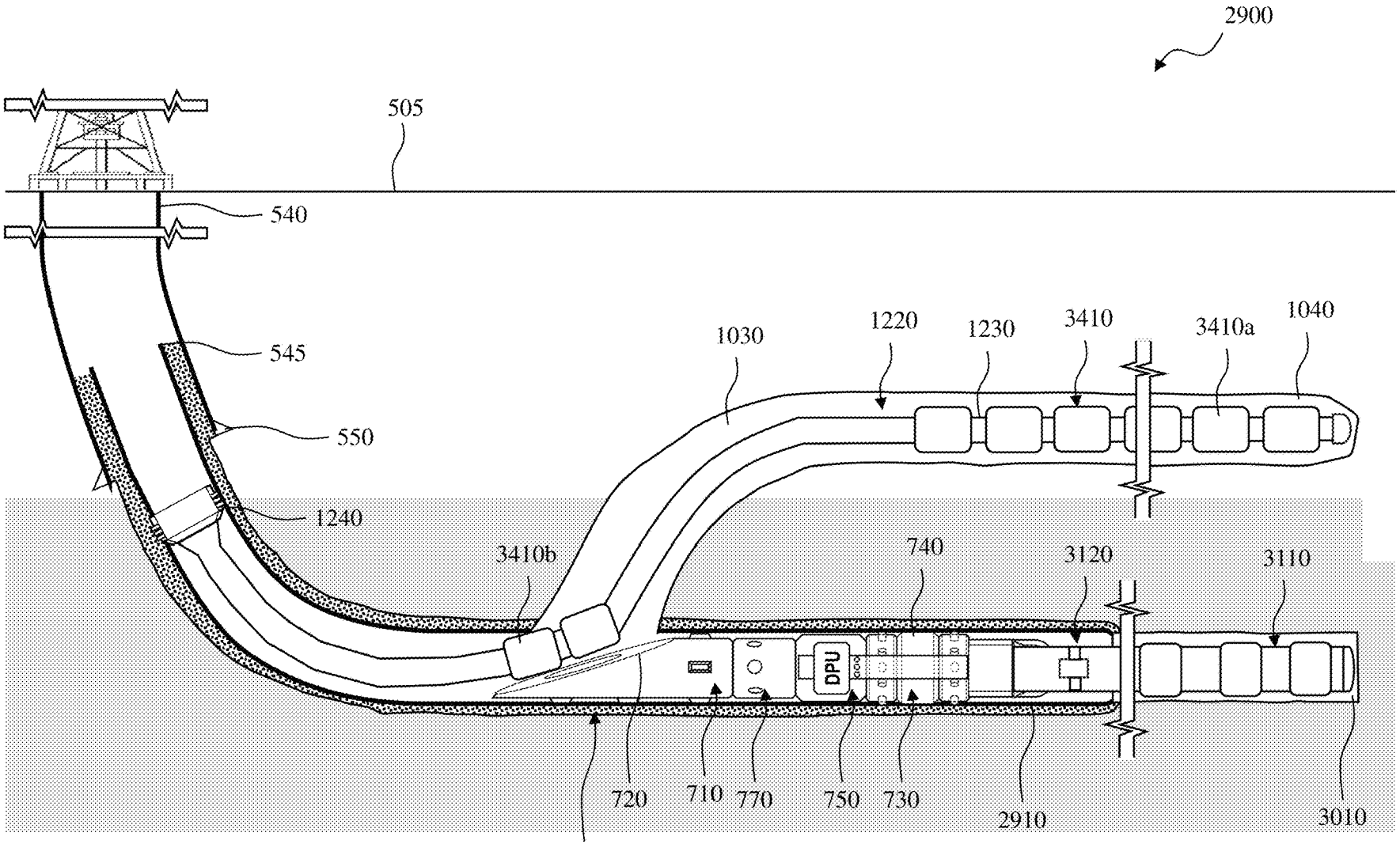
Figure 35:
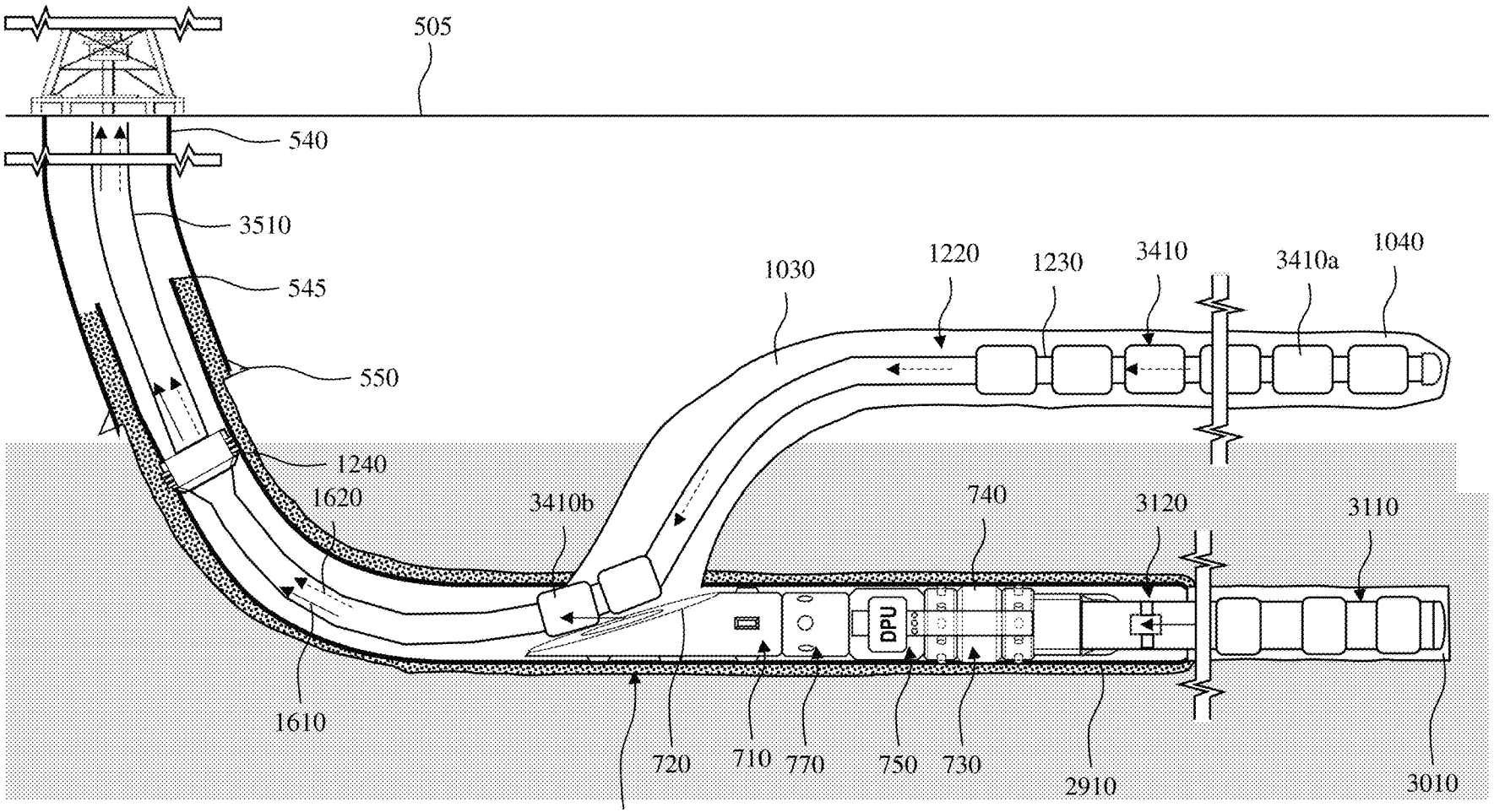

Turning to FIG. 35, illustrated is the well system 2900 of FIG. 34B after running an upper completion 3510 within the main wellbore 3010, and for example stabbing into the lower lateral wellbore completion 1220. Thereafter, the remote open/close valve 3120 may be cycled open, thus allowing for the production of fluids 1610 from the main wellbore 3010, and producing of fluids 1620 from the lateral wellbore 1040. The producing of the fluids 1610, 1620, in at least one embodiment, may occur through at least a portion of the lower lateral wellbore completion 1220.

Figure 36:
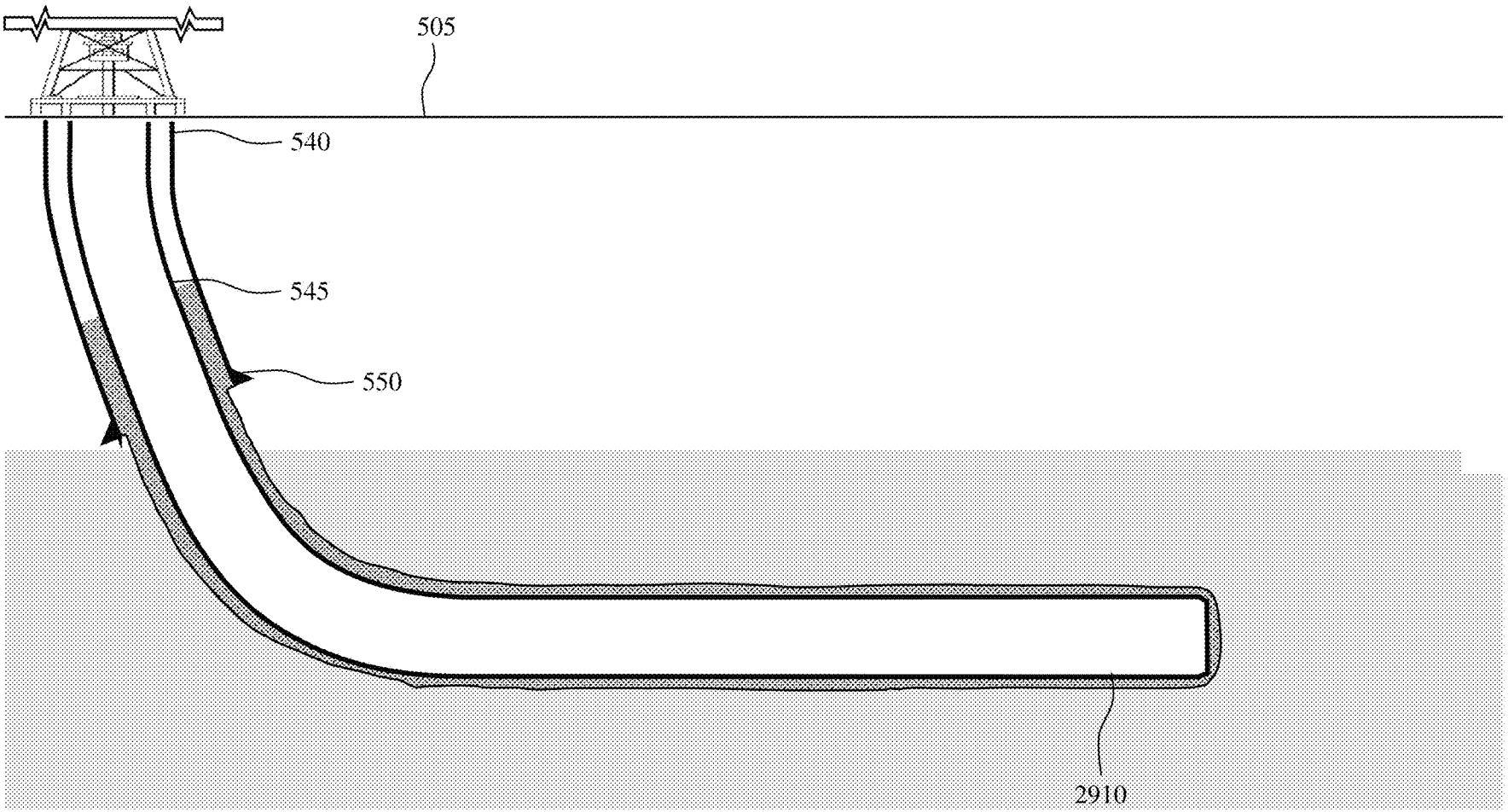
FIGS. 36 through 43 illustrate a method for forming, accessing, and/or producing from a well system according to an alternative embodiment of the disclosure.

Turning now to FIGS. 36 through 43 illustrate a method for forming, accessing, and/or producing from a well system 3600 according to an alternative embodiment of the disclosure. The method of FIGS. 36 through 43 is similar, in many respects, to the methods of FIGS. 5 through 35. Accordingly, like reference numbers have been used to indicate similar features. With reference to FIG. 36, the well system 3600 includes an existing completion 2910 that needs to be revamped.

Figure 37:
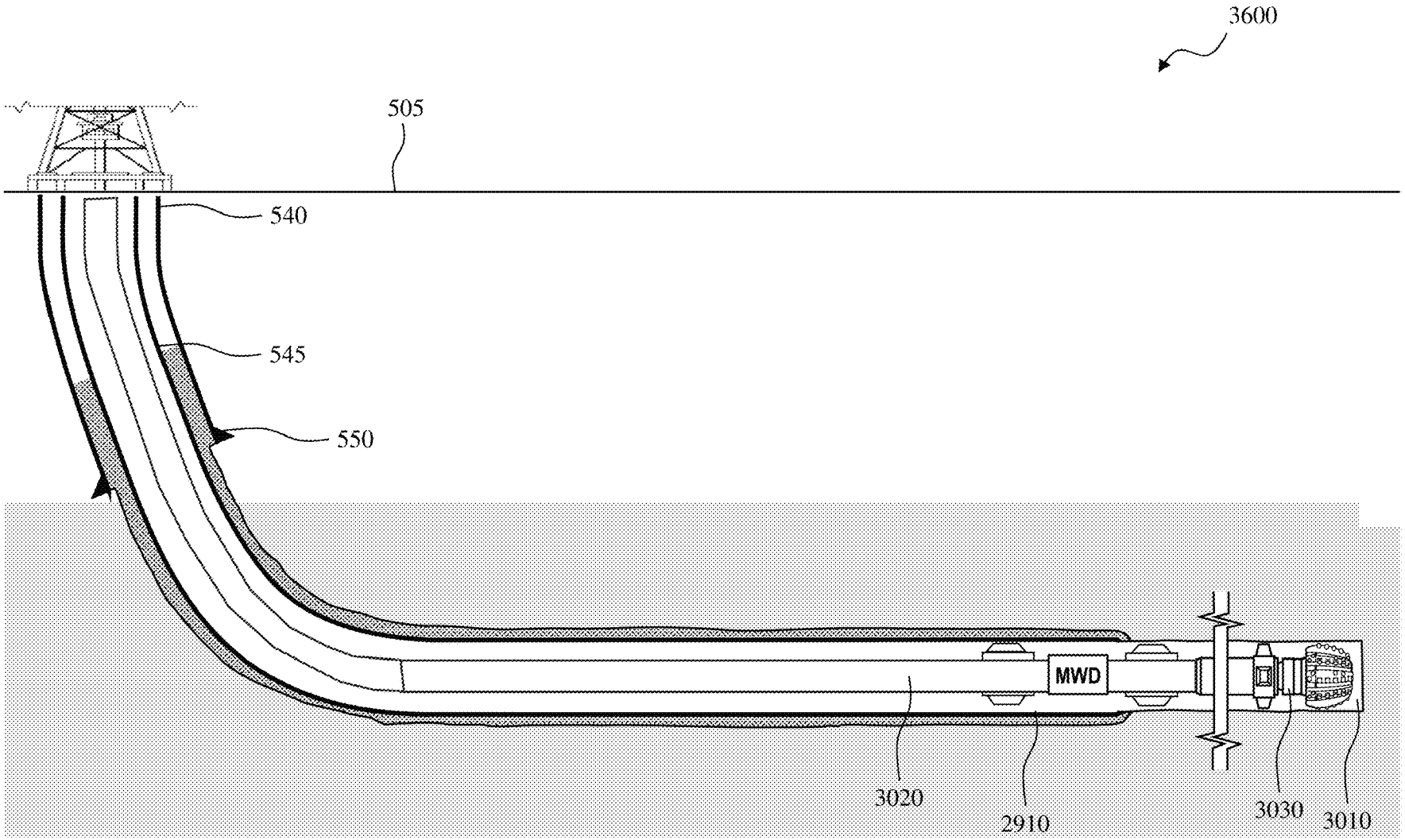

Turning to FIG. 37, illustrated is the well system 3600 of FIG. 36 after drilling an extended main wellbore 3010 to depths, for example using a rotary steerable system 3030 at the end of a drill string 3020.

Figure 38:
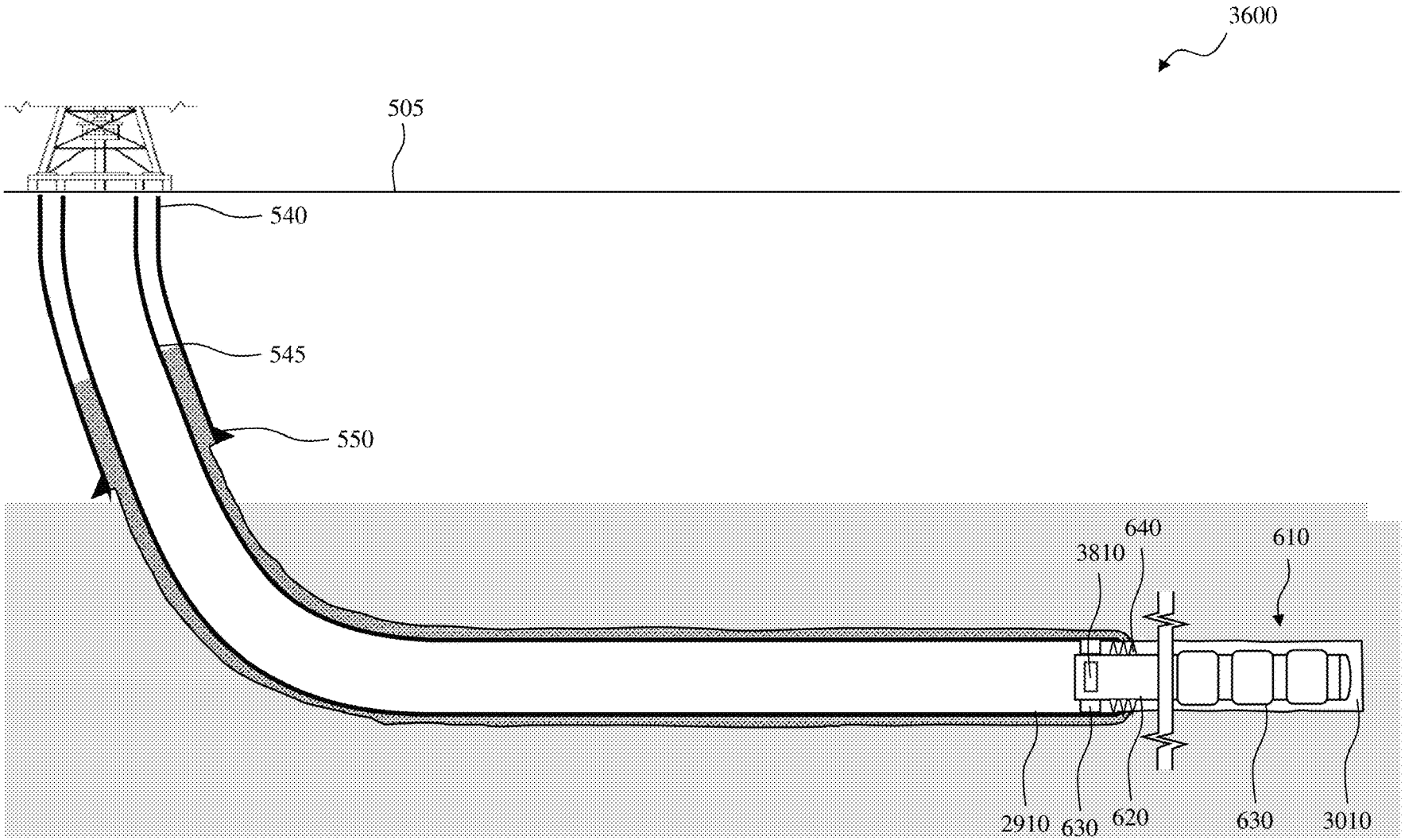

Turning to FIG. 38, illustrated is the well system 3600 of FIG. 37 after positioning a main wellbore completion 610 within the main wellbore 3010, for example using a conveyance. The main wellbore completion 610 may, in certain embodiments, include a main wellbore liner 620 (e.g., with frac sleeves in one embodiment), as well as one or more packers 630 (e.g., swell packers in one embodiment). The main wellbore liner 620 and the one or more packer 630 may, in certain embodiments, be fixed using an anchor assembly 640.

In at least one embodiment, the main wellbore liner 620 includes a plug 3810 therein. The plug 3810 is configured to go from a closed state stopping the flow of fluid uphole of the main wellbore completion 610 and an open state allowing the flow of fluid uphole of the main wellbore completion 610. In at least one embodiment, the plug 3810 is a glass plug or a remote open/close valve (e.g., as discussed above). Nevertheless, any type of plug 3810 may be used and remain within the scope of the disclosure. Moreover, while a plug 3810 is illustrated in this embodiment, other embodiments may employ the use of heavy fluids positioned on top of the uphole end of the main wellbore completion 610 to prevent the flow of fluids uphole therefrom.

Figure 39:
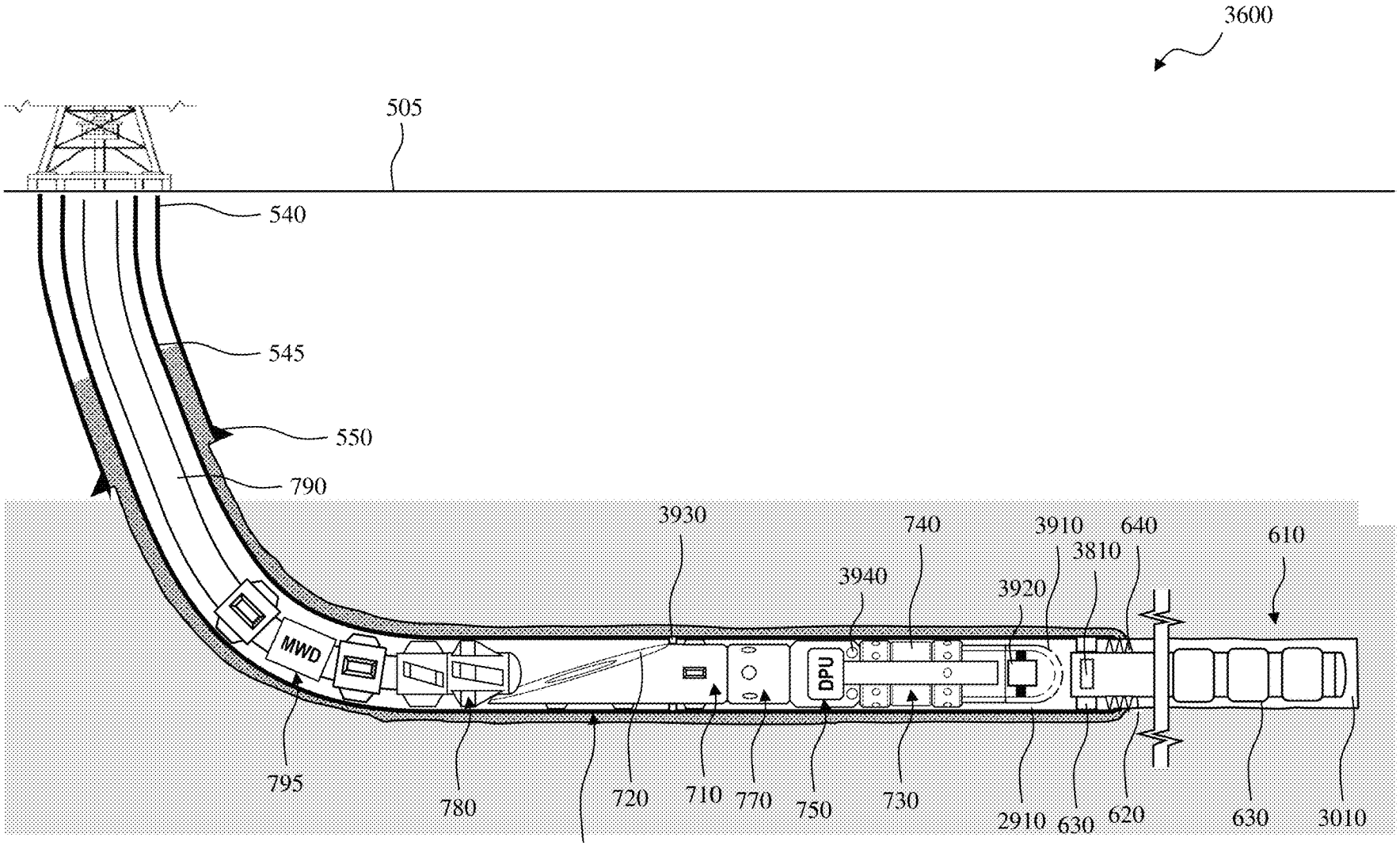
Figure 40:
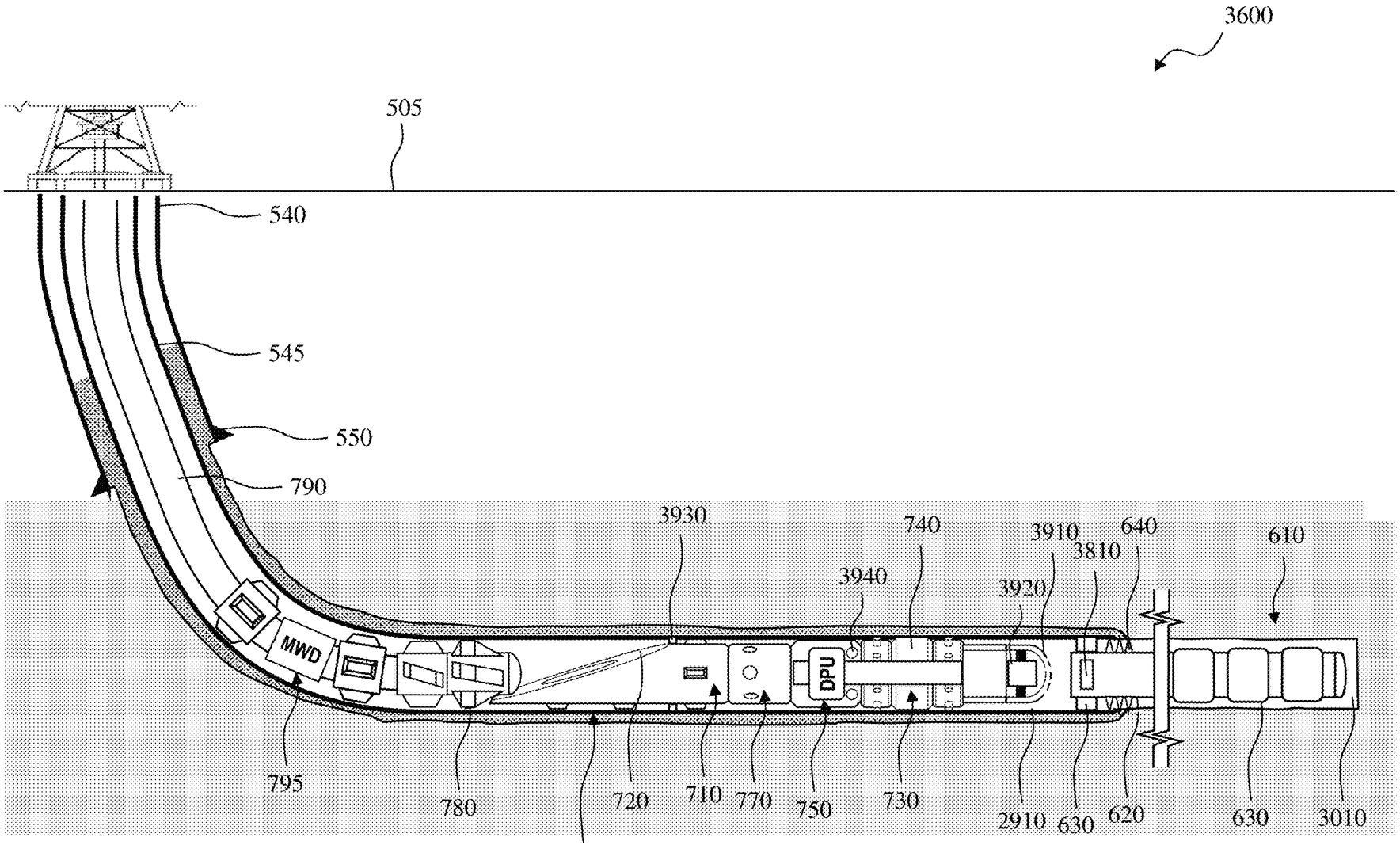

Turning to FIG. 39, illustrated is the well system 3600 of FIG. 38 after positioning a downhole tool 3905 (e.g., somewhat similar to the downhole tools 200, 300, 705, 3105 of FIGS. 2 through 35) designed, manufactured and/or operated according to one or more embodiments of the disclosure. The downhole tool 3905, in at least one embodiment, includes a whipstock assembly 710, for example including a whipface 720. The downhole tool 3905, in at least one embodiment, further includes a packer assembly 730 coupled to the whipstock assembly 710, the packer assembly 730 including a packer element 740 configured to move between a radially retracted state (e.g., as shown in FIG. 39) and a radially expanded state (e.g., as shown in FIG. 40). The downhole tool 3905, in at least one embodiment, may further include a downhole power unit 750 coupled to the packer assembly 730, the downhole power unit 750 configured to move the packer element 740 between the radially retracted state (e.g., as shown in FIG. 39) and the radially expanded state (e.g., as shown in FIG. 40). While the downhole tool 3905 of FIG. 39 includes the downhole power unit 750, other embodiments may exist wherein the downhole tool 3905 does not include the downhole power unit 750. The downhole tool 3905, in one or more other embodiments, may include a ported sub 770 coupled to the downhole power unit 750, the ported sub 770 configured to hydraulically connect activation fluid to the downhole power unit 750.

In one or more embodiments, the downhole tool 3905 additionally includes a downhole ported sub 3910 (e.g., including a filter in certain embodiments) for the entry of production fluids from the main wellbore 3010. Coupled with the downhole ported sub 3910, in one or more embodiments, may be a remote open/close valve 3920. The remote open/close valve 3920 may comprise many of the same features as the remote open/close valve 3120 disclose above, as well as any other valve that could be used downhole to restrict/allow fluid from the downhole tool 3905. In yet another embodiment, the downhole tool 3905 may include one or more magnets 3930, for example as might be used to collect milling debris and other ferromagnetic debris. In yet another embodiment, the downhole tool 3905 may include production ports 3940 located between the whipstock assembly 710 and the packer assembly 730, the production ports 3940 coupling an inside diameter of the downhole tool 3905 with an outside diameter of the downhole tool 3905.

In certain embodiments, such as that shown in FIG. 39, the downhole tool 3905 further includes a milling assembly 780 coupled with the whipstock assembly 710. For example, in at least one embodiment, a lead mill bit of the milling assembly 780 is coupled to the whipface 720 of the whipstock assembly 710, for example using a shear feature. In this embodiment, the downhole tool 3905 (e.g., an entirety of the downhole tool 3905) may be run-in-hole with a drill string 790 coupled to the milling assembly 780. Furthermore, a workstring orientation tool/measuring while drilling tool (WOT/MWD) tool 795 may be employed to orient (e.g., both axially and rotationally orient) the downhole tool 3905 as it is being run-in-hole.

Turning to FIG. 40, illustrated is the well system 3600 of FIG. 39 after setting the downhole tool 3905, and thus moving the packer element 740 from its radially retracted state (e.g., as shown in FIG. 39) to its radially expanded state (e.g., as shown in FIG. 40). In at least one embodiment, this may be achieved by hydraulically connecting activation fluid with the downhole power unit 750. In at least one embodiment, the ported sub 770 provides a fluid path for the activation fluid to connect with the downhole power unit 750. For example, a blowout preventor (BOP) located at the earth's surface 505 could be closed, and then the annulus between the drill string 790 and the main wellbore 3010 pressurized to a pre-determined activation pressure, as discussed above.

Once the downhole power unit 750 is subjected to the pre-determined activation pressure (e.g., via the ported sub 770), the setting sequence for the packer assembly 730 could initiate. As discussed above, in certain instances, a pressure sensor associated with the downhole power unit 750 may initiate the setting sequence, and in other instances the bursting of a burst disc associated with the ported sub 770 or the downhole power unit 750 may initiate the setting sequence. While the pressure sensor and burst disc have been described as possible solutions to initiate the setting sequence, those skilled in the art understand that other undisclosed solutions could be used and achieve the same result. After the setting sequence is complete, the user may confirm the correct setting of the packer assembly 730 by setting weight down and/or pulling on the packer assembly 730. As discussed above, the present embodiment is not limited to the use of the downhole power unit 750, thus any other mechanism for setting the packer element 740 may be used and remain within the scope of the disclosure.

Figure 41A:
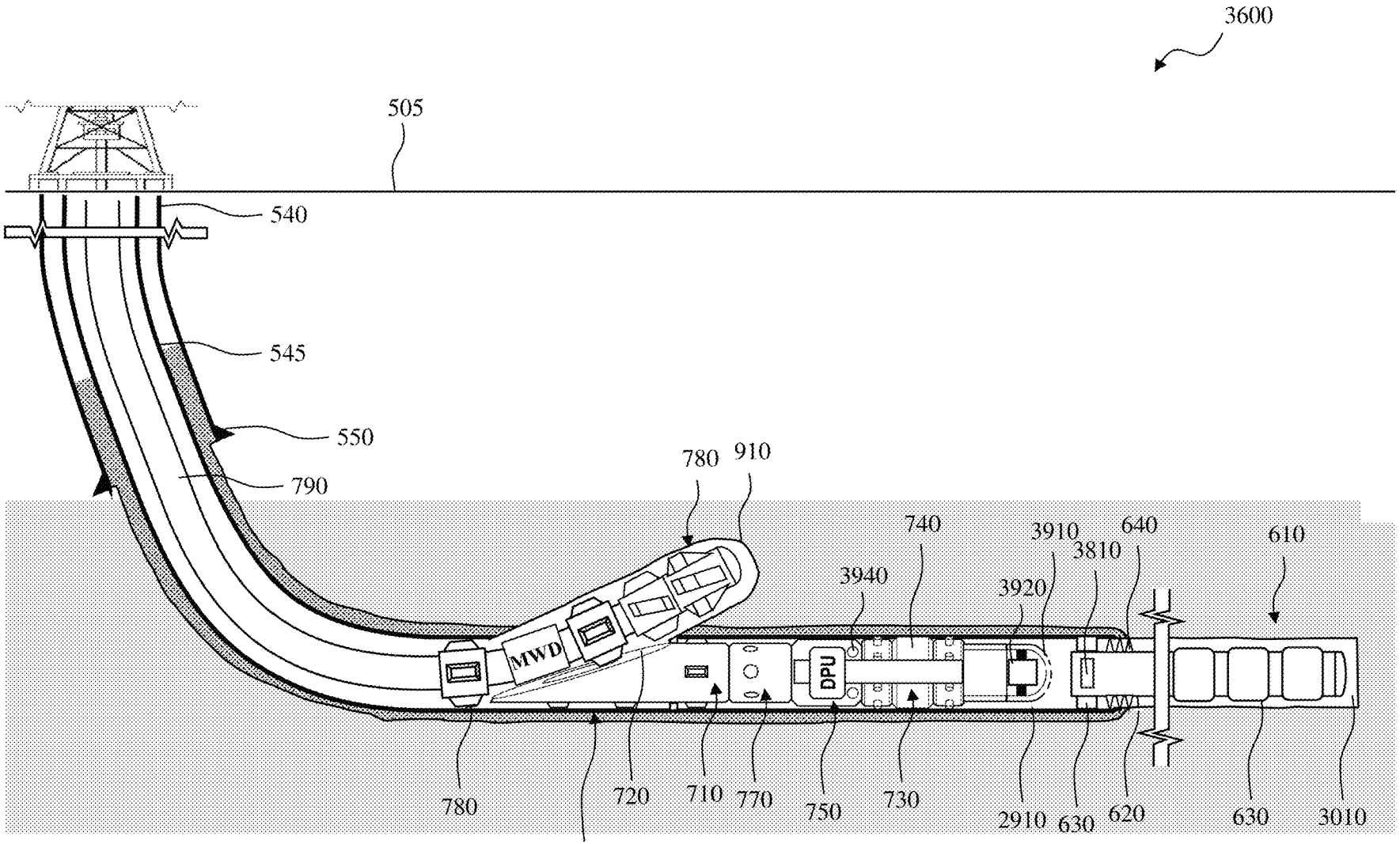

Turning to FIG. 41A, illustrated is the well system 3600 of FIG. 40 after setting down weight to shear the shear feature between the milling assembly 780 and the and the whipstock assembly 710, and then milling an initial window pocket 910 using the milling assembly 780. In certain embodiments, the initial window pocket 910 is between 1.5 m and 7.0 m long, and in certain other embodiments about 2.5 m long, and extends through the casing 545. Thereafter, a circulate and clean process could occur, and then the drill string 790 and milling assembly 780 may be pulled out-of-hole.

Figure 41B:
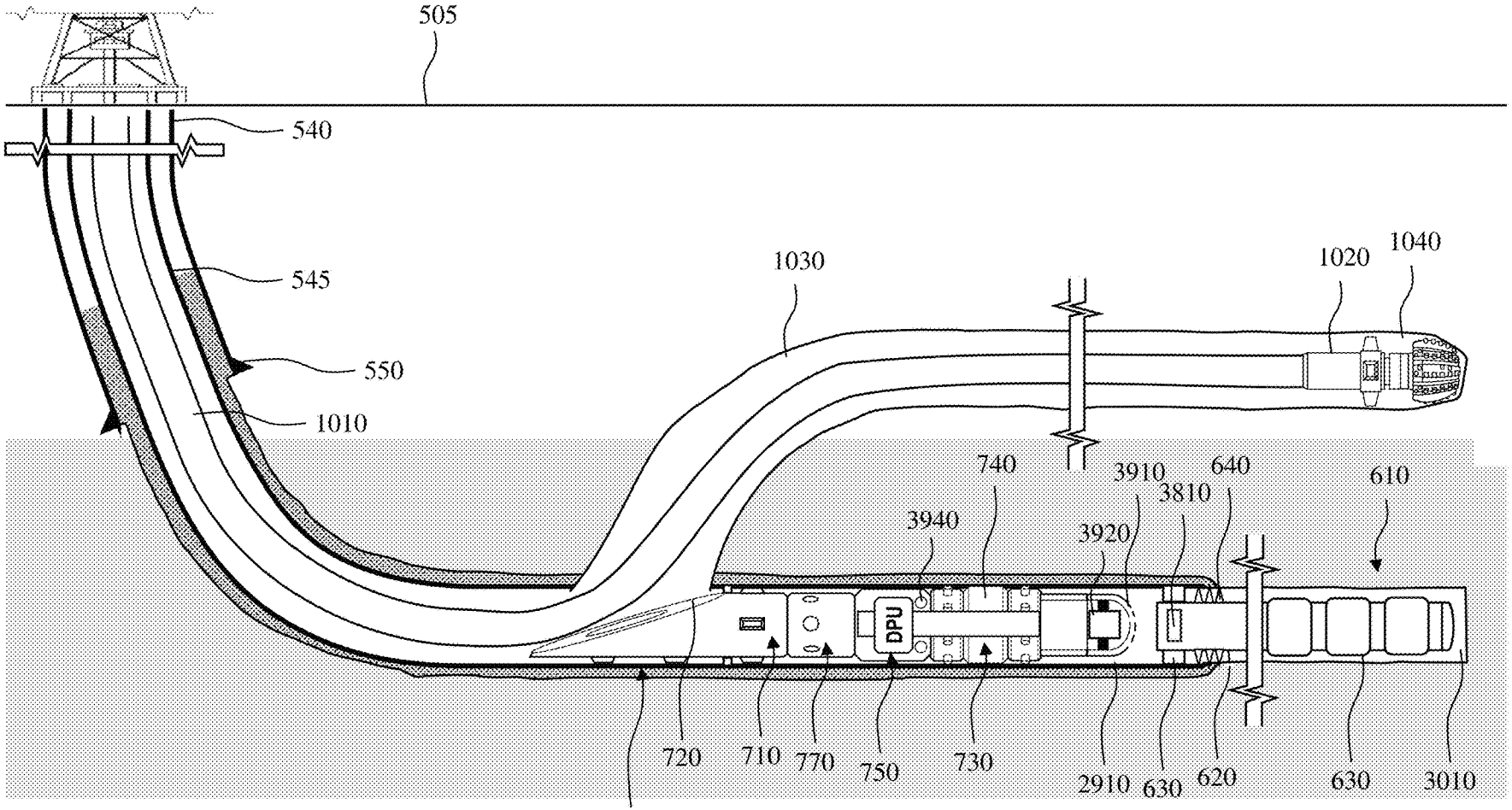

Turning to FIG. 41B, illustrated is the well system 3600 of FIG. 41A after running in hole a drill string 1010 with a rotary steerable assembly 1020, drilling a tangent 1030 following an inclination of the whipstock assembly 710, and then continuing to drill the lateral wellbore 1040 to depth. Thereafter, the drill string 1010 and rotary steerable assembly 1020 may be pulled out of hole, as shown in FIG. 41C.

Figure 41C:
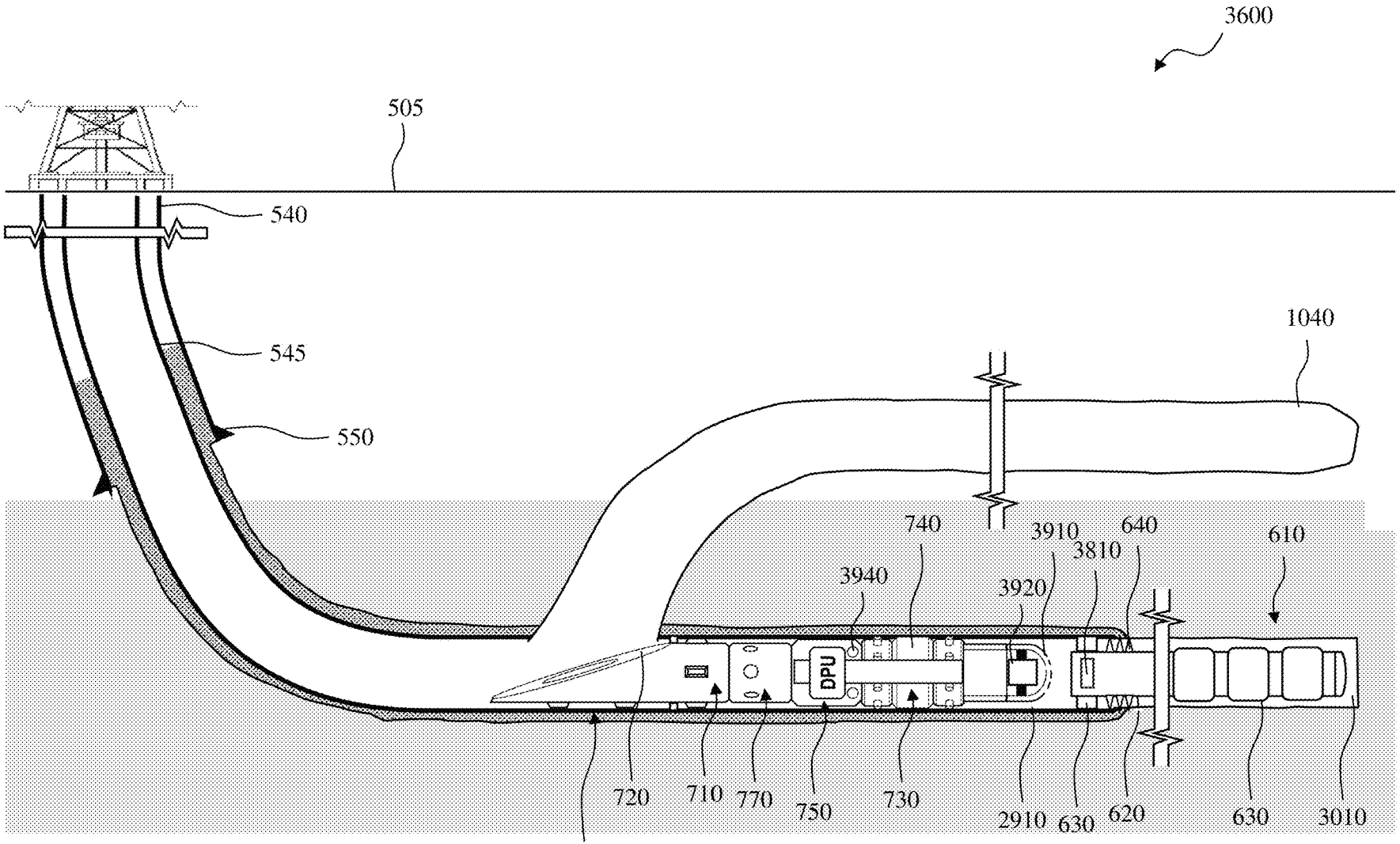
Figure 42A:
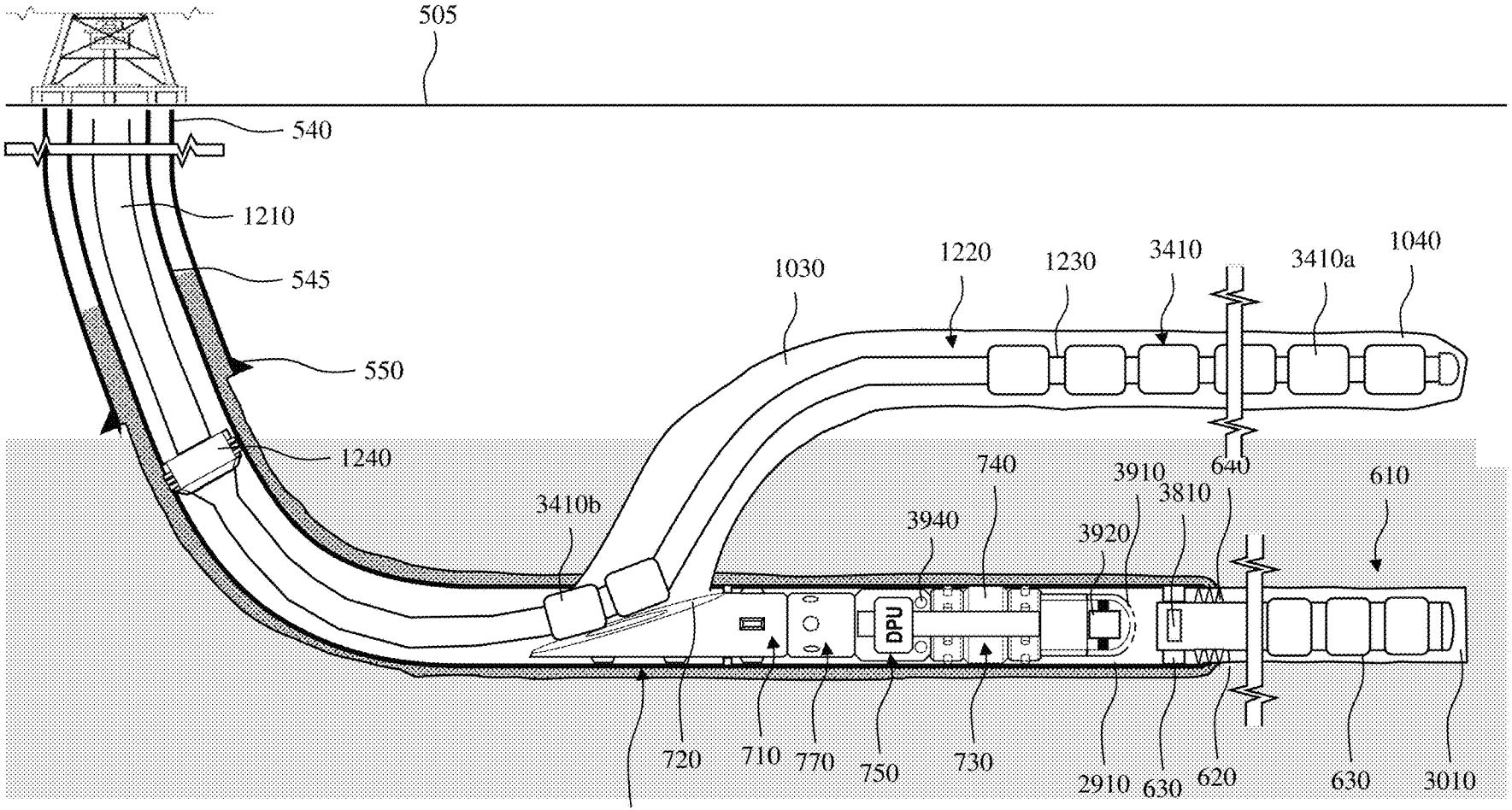

Turning to FIG. 42A, illustrated is the well system 3600 of FIG. 41C after employing an inner string 1210 to position a lower lateral wellbore completion 1220 in the lateral wellbore 1040. The lower lateral wellbore completion 1220 may, in certain embodiments, include a lateral wellbore liner 1230 (e.g., with frac sleeves in one embodiment), as well as one or more packers 1240 (e.g., swell packers in one embodiment). The lower lateral wellbore completion 1220, in one or more embodiments, may further include one or more screens 3410 (e.g., sand screens). In at least one embodiment, screens 3410*a* are located in the lateral reservoir (e.g., lateral wellbore 1040) and other screens 3410*b* are located across the whipstock assembly 710 to receive main-bore production that is funneled therein via the one or more packers 1240. Thereafter, the inner string 1210 may be pulled out of hole, as shown in FIG. 42B.

Figure 42B:
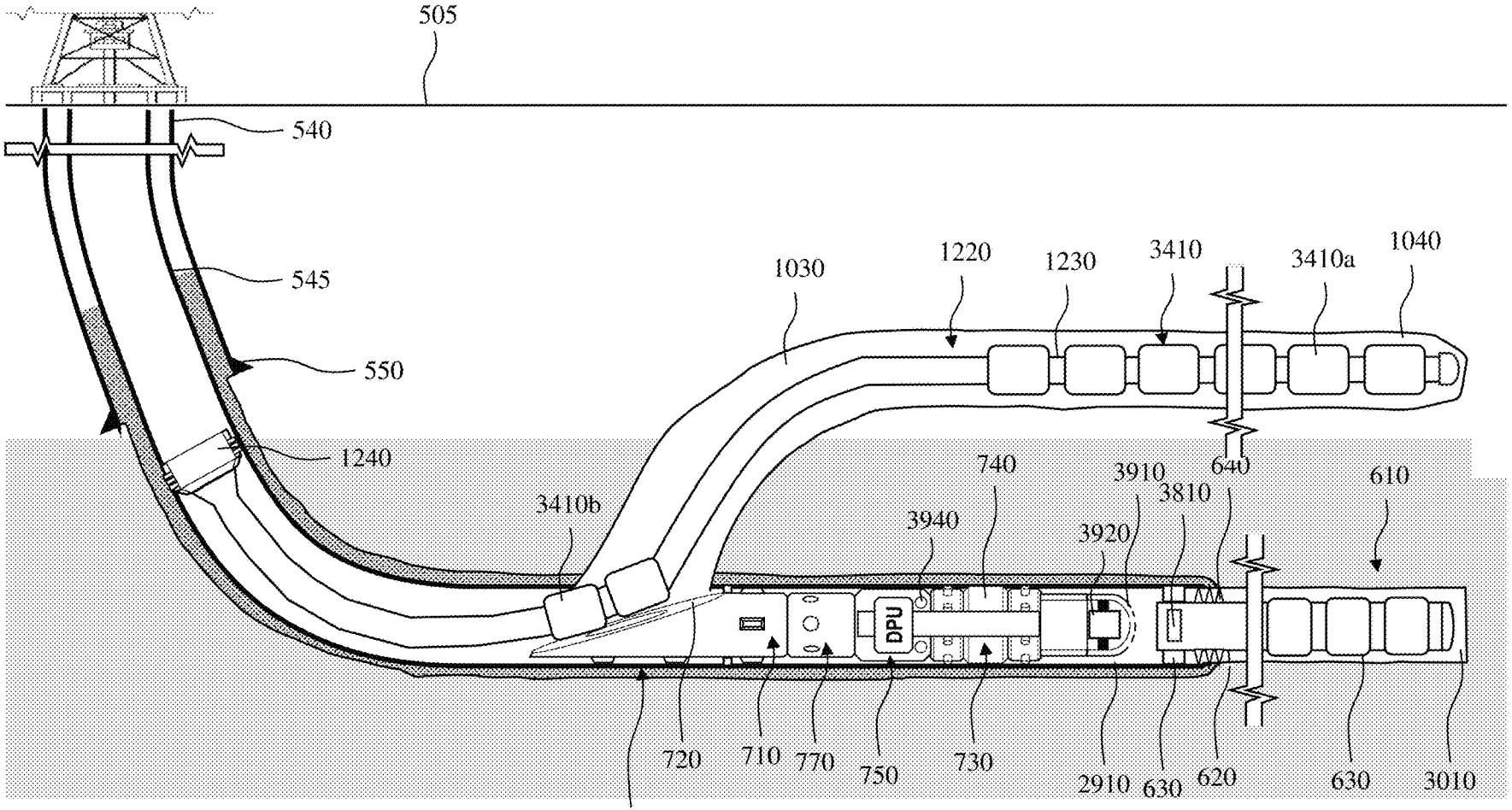
Figure 43:
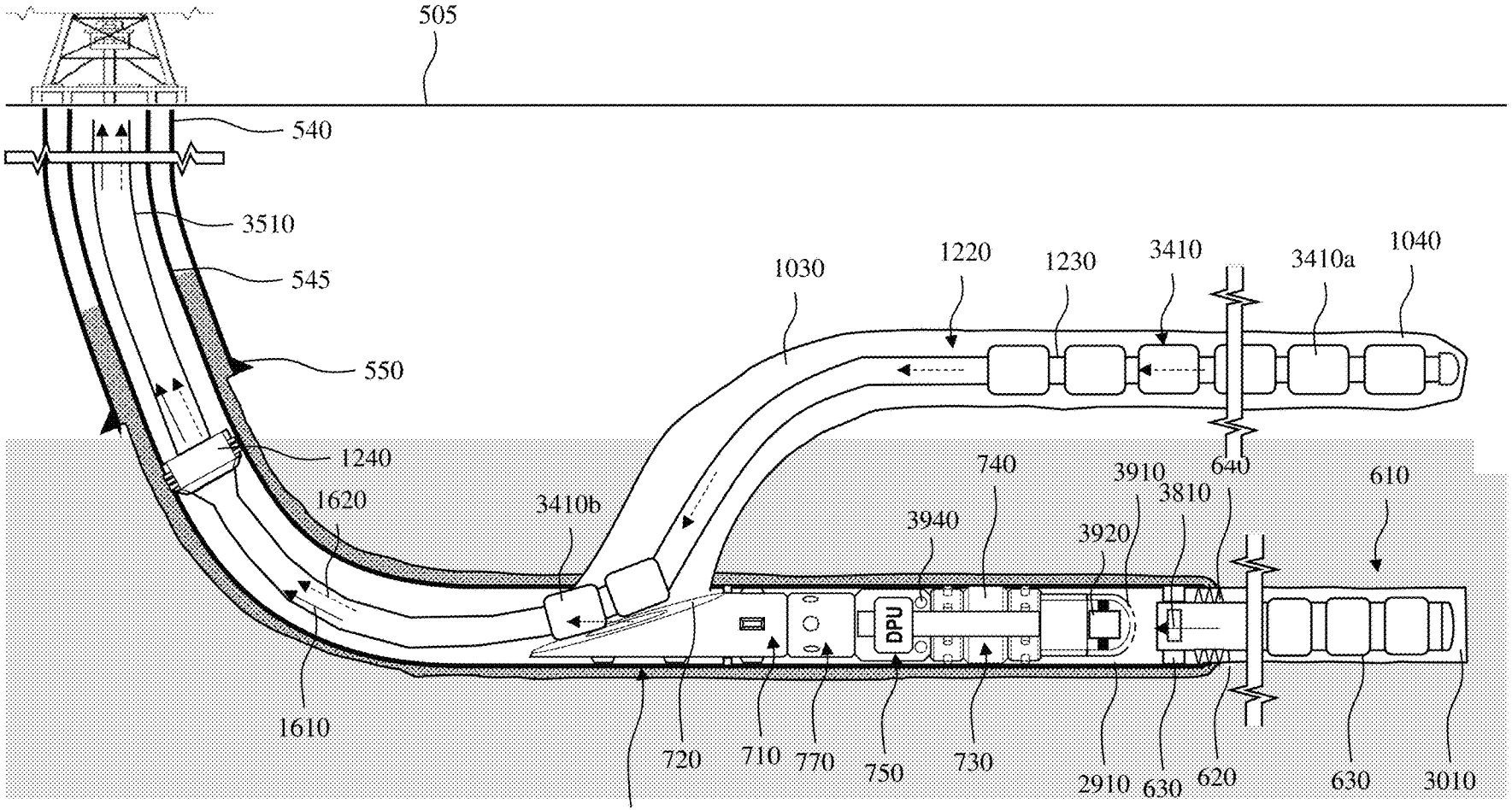

Turning to FIG. 43, illustrated is the well system 3600 of FIG. 42B after running an upper completion 3510 within the main wellbore 3010, and for example stabbing into the lower lateral wellbore completion 1220. Thereafter, the remote open/close valve 3920 may be cycled open, thus allowing for the production of fluids 1610 from the main wellbore 3010, and producing fluids 1620 from the lateral wellbore 1040. The producing of the fluids 1610, 1620, in at least one embodiment, may occur through the lower lateral wellbore completion 1220.

Aspects Disclosed Herein Include:

A. A downhole tool, the downhole tool including: 1) a whipstock assembly, the whipstock assembly including a whipface; 2) a packer assembly coupled to the whipstock assembly, the packer assembly including a packer element configured to move between a radially retracted state and a radially expanded state; and 3) a downhole power unit coupled to the packer assembly, the downhole power unit configured to move the packer element between the radially retracted state and the radially expanded state.

B. A well system, the well system including: 1) a main wellbore located in a subterranean formation; 2) a lateral wellbore extending from the main wellbore; and 3) a downhole tool positioned proximate an intersection between the main wellbore and the lateral wellbore, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a downhole power unit coupled to the packer assembly, the downhole power unit configured to move the packer element between the radially retracted state and the radially expanded state.

C. A method, the method including: 1) positioning a downhole tool proximate an intersection between a main wellbore and where a lateral wellbore is to be located, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a downhole power unit coupled to the packer assembly, the downhole power unit configured to move the packer element between the radially retracted state and the radially expanded state; and 2) moving the packer element from the radially retracted state to the radially expanded state to fix the downhole tool within the main wellbore.

D. A downhole tool, the downhole tool including: 1) a whipstock assembly, the whipstock assembly including a whipface; 2) a packer assembly coupled to the whipstock assembly, the packer assembly including a packer element configured to move between a radially retracted state and a radially expanded state; and 3) a lower completion coupled downhole of the whipstock assembly.

E. A well system, the well system including: 1) a main wellbore located in a subterranean formation; 2) a lateral wellbore extending from the main wellbore; and 3) a downhole tool positioned proximate an intersection between the main wellbore and the lateral wellbore, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a lower completion coupled downhole of the whipstock assembly.

F. A method, the method including: 1) positioning a downhole tool proximate an intersection between a main wellbore and where a lateral wellbore is to be located, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a lower completion coupled downhole of the whipstock assembly. And 2) moving the packer element from the radially retracted state to the radially expanded state to fix the downhole tool within the main wellbore.

G. A downhole tool, the downhole tool including: 1) a whipstock assembly, the whipstock assembly including a whipface; 2) a packer assembly coupled to the whipstock assembly, the packer assembly including a packer element configured to move between a radially retracted state and a radially expanded state; and 3) a remote open/close valve positioned to allow fluid into the whipstock assembly.

H. A well system, the well system including: 1) a main wellbore located in a subterranean formation; 2) a lateral wellbore extending from the main wellbore; and 3) a downhole tool positioned proximate an intersection between the main wellbore and the lateral wellbore, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a remote open/close valve positioned to allow fluid into the whipstock assembly.

I. A method, the method including: 1) positioning a downhole tool proximate an intersection between a main wellbore and where a lateral wellbore is to be located, the downhole tool including: a) a whipstock assembly, the whipstock assembly including a whipface; b) a packer assembly coupled to the whipstock assembly, the packer assembly including a packer element configured to move between a radially retracted state and a radially expanded state; and c) a remote open/close valve positioned to allow fluid into the whipstock assembly; and 2) moving the packer element from the radially retracted state to the radially expanded state to fix the downhole tool within the main wellbore.

Aspects A, B, C, D, E, F, G, H, and I may have one or more of the following additional elements in combination: Element 1: further including a ported sub coupled to the downhole power unit, the ported sub configured to hydraulically connect activation fluid to the downhole power unit. Element 2: wherein the ported sub is configured to hydraulically connect activation fluid from an annulus of a wellbore to the downhole power unit. Element 3: wherein the downhole power unit has a pre-determined activation pressure, the downhole power unit configured to initiate a setting sequence of the packer assembly after receiving activation fluid having at least the pre-determined activation pressure from the ported sub. Element 4: wherein the downhole power unit has a pressure sensor, the pressure sensor configured to sense for at least the pre-determined activation pressure before initiating the setting sequence. Element 5: wherein the ported sub or the downhole power unit has a burst disc, the burst disc configured to burst upon receiving at least the pre-determined activation pressure before initiating the setting sequence. Element 6: wherein the downhole power unit is configured to immediately initiate the setting sequence of the packer assembly after receiving the activation fluid having at least the pre-determined activation pressure from the ported sub. Element 7: wherein the downhole power unit is configured to start a pre-determined countdown to initiate the setting sequence of the packer assembly after receiving the activation fluid having at least the pre-determined activation pressure from the ported sub. Element 8: wherein the downhole power unit is positioned between the whipstock assembly and the packer assembly. Element 9: further including a milling assembly removably coupled to the whipface. Element 10: wherein the milling assembly is removably coupled to the whipface using a shear feature. Element 11: wherein the packer assembly includes an inner mandrel, upper slips positioned about the inner mandrel, lower slips positioned about the inner mandrel, and the packer element positioned about the inner mandrel between the upper slips and the lower slips, wherein the inner mandrel is configured to axially slide to move the upper slips and lower slips toward one another to compress the packer element from its radially retracted state to its radially expanded state. Element 12: wherein the downhole power unit is configured to receive an activation signal along wired drill string. Element 13: wherein the activation signal is an acoustic signal. Element 14: wherein moving the packer from the radially retracted state to the radially expanded state includes hydraulically connecting the activation fluid to the downhole power unit using the ported sub. Element 15: wherein the lower completion includes one or more liner assemblies. Element 16: further including a remote open/close valve positioned between the one or more liner assemblies and the whipstock assembly. Element 17: further including production ports located between the whipstock assembly and the packer assembly, the production ports coupling an inside diameter of the downhole tool with an outside diameter of the downhole tool. Element 18: further including a downhole power unit coupled to the packer assembly, the downhole power unit configured to move the packer element between the radially retracted state and the radially expanded state, and further including a ported sub coupled to the downhole power unit, the ported sub configured to hydraulically connect activation fluid to the downhole power unit. Element 19: wherein the ported sub is configured to hydraulically connect activation fluid from an annulus of a wellbore to the downhole power unit. Element 20: wherein the downhole power unit has a pre-determined activation pressure, the downhole power unit configured to initiate a setting sequence of the packer assembly after receiving activation fluid having at least the pre-determined activation pressure from the ported sub. Element 21: wherein the downhole power unit has a pressure sensor, the pressure sensor configured to sense for at least the pre-determined activation pressure before initiating the setting sequence. Element 22: wherein the lower completion is coupled downhole of the whipstock assembly and the downhole power unit. Element 23: wherein the lower completion is coupled downhole of the whipstock assembly, the downhole power unit, and the packer assembly. Element 24: further including a downhole power unit coupled to the packer assembly, the downhole power unit configured to move the packer element between the radially retracted state and the radially expanded state. Element 25: further including a downhole ported sub, the downhole ported sub coupled downhole of the whipstock assembly and the downhole power unit. Element 26: further including a downhole ported sub, the downhole ported sub coupled downhole of the whipstock assembly, the downhole power unit, and the packer assembly. Element 27: wherein the remote open/close valve is positioned downhole of the packer assembly. Element 28: wherein the remote open/close valve is positioned in the downhole ported sub. Element 29: further including production ports located between the whipstock assembly and the packer assembly, the production ports coupling an inside diameter of the downhole tool with an outside diameter of the downhole tool. Element 30: further including a second ported sub coupled to the downhole power unit, the second ported sub configured to hydraulically connect activation fluid to the downhole power unit. Element 31: wherein the second ported sub is configured to hydraulically connect activation fluid from an annulus of a wellbore to the downhole power unit. Element 32: wherein the downhole power unit has a pre-determined activation pressure, the downhole power unit configured to initiate a setting sequence of the packer assembly after receiving activation fluid having at least the pre-determined activation pressure from the second ported sub.

Those skilled in the art to which this application relates will appreciate that other and further additions, deletions, substitutions and modifications may be made to the described embodiments.

What is claimed is:

1. A downhole tool, comprising:

a whipstock assembly, the whipstock assembly including a whipface;

a packer assembly coupled to the whipstock assembly, the packer assembly including a packer element configured to move between a radially retracted state and a radially expanded state;

a remote open/close valve positioned to allow fluid into the whipstock assembly;

a downhole power unit coupled to the packer assembly, the downhole power unit configured to move the packer element between the radially retracted state and the radially expanded state; and a downhole ported sub, the downhole ported sub coupled downhole of the whipstock assembly, the downhole power unit, and the packer assembly.

2. The downhole tool as recited in claim 1, wherein the remote open/close valve is positioned downhole of the packer assembly.

3. The downhole tool as recited in claim 2, wherein the remote open/close valve is positioned in the downhole ported sub.

4. The downhole tool as recited in claim 1, further including production ports located between the whipstock assembly and the packer assembly, the production ports coupling an inside diameter of the downhole tool with an outside diameter of the downhole tool.

5. The downhole tool as recited in claim 1, further including a second ported sub coupled to the downhole power unit, the second ported sub configured to hydraulically connect activation fluid to the downhole power unit.

6. The downhole tool as recited in claim 5, wherein the second ported sub is configured to hydraulically connect activation fluid from an annulus of a wellbore to the downhole power unit.

7. The downhole tool as recited in claim 6, wherein the downhole power unit has a pre-determined activation pressure, the downhole power unit configured to initiate a setting sequence of the packer assembly after receiving activation fluid having at least the pre-determined activation pressure from the second ported sub.

8. A well system, comprising:

a main wellbore located in a subterranean formation;

a lateral wellbore extending from the main wellbore; and a downhole tool positioned proximate an intersection between the main wellbore and the lateral wellbore, the downhole tool including:

a whipstock assembly, the whipstock assembly including a whipface;

a packer assembly coupled to the whipstock assembly, the packer assembly including a packer element configured to move between a radially retracted state and a radially expanded state;

a remote open/close valve positioned to allow fluid into the whipstock assembly;

a downhole power unit coupled to the packer assembly, the downhole power unit configured to move the packer element between the radially retracted state and the radially expanded state; and a downhole ported sub, the downhole ported sub coupled downhole of the whipstock assembly, the downhole power unit, and the packer assembly.

9. The well system as recited in claim 8, wherein the remote open/close valve is positioned downhole of the packer assembly.

10. The well system as recited in claim 9, wherein the remote open/close valve is positioned in the downhole ported sub.

11. The well system as recited in claim 8, further including production ports located between the whipstock assembly and the packer assembly, the production ports coupling an inside diameter of the downhole tool with an outside diameter of the downhole tool.

12. The well system as recited in claim 8, further including a second ported sub coupled to the downhole power unit, the second ported sub configured to hydraulically connect activation fluid to the downhole power unit.

13. The well system as recited in claim 12, wherein the second ported sub is configured to hydraulically connect activation fluid from an annulus of a wellbore to the downhole power unit.

14. The well system as recited in claim 13, wherein the downhole power unit has a pre-determined activation pressure, the downhole power unit configured to initiate a setting sequence of the packer assembly after receiving activation fluid having at least the pre-determined activation pressure from the second ported sub.

15. A method, comprising:

positioning a downhole tool proximate an intersection between a main wellbore and where a lateral wellbore is to be located, the downhole tool including:

a whipstock assembly, the whipstock assembly including a whipface;

a packer assembly coupled to the whipstock assembly, the packer assembly including a packer element configured to move between a radially retracted state and a radially expanded state;

a remote open/close valve positioned to allow fluid into the whipstock assembly;

a downhole power unit coupled to the packer assembly, the downhole power unit configured to move the packer element between the radially retracted state and the radially expanded state; and a downhole ported sub, the downhole ported sub coupled downhole of the whipstock assembly, the downhole power unit, and the packer assembly; and moving the packer element from the radially retracted state to the radially expanded state to fix the downhole tool within the main wellbore.

16. A downhole tool, comprising:

a whipstock assembly, the whipstock assembly including a whipface;

a packer assembly coupled to the whipstock assembly, the packer assembly including a packer element configured to move between a radially retracted state and a radially expanded state;

a remote open/close valve positioned to allow fluid into the whipstock assembly;

a downhole power unit coupled to the packer assembly, the downhole power unit configured to move the packer element between the radially retracted state and the radially expanded state; and production ports located between the whipstock assembly and the packer assembly, the production ports coupling an inside diameter of the downhole tool with an outside diameter of the downhole tool.

17. A downhole tool, comprising:

a whipstock assembly, the whipstock assembly including a whipface;

a packer assembly coupled to the whipstock assembly, the packer assembly including a packer element configured to move between a radially retracted state and a radially expanded state;

a remote open/close valve positioned to allow fluid into the whipstock assembly;

a downhole power unit coupled to the packer assembly, the downhole power unit configured to move the packer element between the radially retracted state and the radially expanded state; and a ported sub coupled to the downhole power unit, the ported sub configured to hydraulically connect activation fluid from an annulus of a wellbore to the downhole power unit, wherein the downhole power unit has a pre-determined activation pressure, the downhole power unit configured to initiate a setting sequence of the packer assembly after receiving activation fluid having at least the pre-determined activation pressure from the second ported sub.

* * * * *